US006866990B2

(12) United States Patent
Maeno

(10) Patent No.: US 6,866,990 B2
(45) Date of Patent: Mar. 15, 2005

(54) SILVER HALIDE COLOR REVERSAL PHOTOGRAPHIC LIGHTSENSITIVE MATERIAL

(75) Inventor: Yutaka Maeno, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/368,389

(22) Filed: Feb. 20, 2003

(65) Prior Publication Data

US 2003/0224304 A1 Dec. 4, 2003

(30) Foreign Application Priority Data

Feb. 20, 2002 (JP) ..... 2002-043552

(51) Int. Cl.[7] ..... G03C 1/08; G03C 7/26; G03C 7/32

(52) U.S. Cl. ..... 430/558; 430/567; 430/504; 430/505; 430/506; 430/568; 430/379

(58) Field of Search ..... 430/558, 567, 430/504, 505, 506, 568, 379

(56) References Cited

U.S. PATENT DOCUMENTS 4,705,744 A * 11/1987 Sasaki et al. ..... 430/505
5,166,042 A * 11/1992 Nozawa ..... 430/505
5,206,126 A * 4/1993 Shimazaki et al. ..... 430/503
5,437,965 A * 8/1995 Uchida et al. ..... 430/544
5,932,401 A 8/1999 Chen
6,162,595 A * 12/2000 Chen ..... 430/504
2003/0064329 A1 * 4/2003 Abe et al. ..... 430/567

FOREIGN PATENT DOCUMENTS

JP 2-272450 11/1990

* cited by examiner

*Primary Examiner*—Geraldine Letscher
(74) *Attorney, Agent, or Firm*—Sughrue Mion, PLLC

(57) ABSTRACT

A silver halide color reversal photographic lightsensitive material comprising a support and, superimposed thereon, at least one red-sensitive silver halide emulsion layer, at least one green-sensitive silver halide emulsion layer and at least one blue-sensitive silver halide emulsion layer, the red-sensitive silver halide emulsion layer having a weight-averaged wavelength ($\lambda ra$) of spectral sensitivity distribution satisfying the relationship: 600 nm<$\lambda ra$<625 nm, which silver halide color reversal photographic lightsensitive material contains at least one interimage effect intensifying layer substantially not forming any image, the interimage effect intensifying layer containing:

(a) at least one kind of lightsensitive silver halide grains in an amount of less than 10% in terms of silver quantity based on all the silver halide grains for image formation; and (b) nonlightsensitive silver halide fine grains.

16 Claims, No Drawings

SILVER HALIDE COLOR REVERSAL PHOTOGRAPHIC LIGHTSENSITIVE MATERIAL

CROSS-REFERENCE TO RELATED APPLICATIONS

This application is based upon and claims the benefit of priority from the prior Japanese Patent Application No. 2002-043552, filed Feb. 20, 2002, the entire contents of which are incorporated herein by reference.

BACKGROUND OF THE INVENTION

1. Field of the Invention

The present invention relates to a silver halide color reversal photographic lightsensitive material exhibiting enhanced color reproduction performance.

2. Description of the Related Art

Color reversal films are often used by professional photographers as originals for printing because the films after development can be directly appreciated. That is, the color reversal films function as a color proof for printing. Therefore, the demand on color reproduction is extremely strict, but conventional color reversal films marketed cannot be stated as having satisfactorily met the demand. For example, most of conventional color reversal films have a drawback in that colors of purple series are reproduced with red considerably intensified over the life color and that when photographing is conducted under fluorescent lamps, green fogging occurs overall. The cause of the drawback resides in that the center value of spectral sensitivity of red-sensitive layer is positioned on the side of longer wave (often 630 nm or greater) than the center value (605 nm) of spectral sensitivity of human neuroepitheliale having sensitivity on the longest-wave side. However, simply shifting the spectral sensitivity of red-sensitive emulsion layer to shorter wave would inevitably invite problems of color reproduction, such as conspicuous lowering of red color saturation and deviation of green and bluish green hues toward yellow.

These problems have already been recognized. For example, in Japanese Patent 2,694,363, it is described to introduce a special layer (donor layer) capable of imparting an interimage effect (hereinafter also referred to as "IIE") for faithfully reproducing hues without dropping of red saturation. Therein, as examples of means for imparting IIE, there are mentioned DIR-hydroquinone compounds, mercaptothiadiazole compounds, mercaptobenzothiazole compounds and iodide ions released from a silver halide emulsion containing silver iodide in high proportion. However, these IIE intensifying means have not necessarily exerted satisfactory effects. Similar techniques are disclosed in, for example, U.S. Pat. Nos. 4,663,271, 4,705,744 and 4,707,436 and Jpn. Pat. Appln. KOKAI Publication No. (hereinafter referred to as JP-A-) 62-160448 and JP-A-6-3-89850.

Moreover, JP-A-11-119398 discloses a silver halide reversal lightsensitive material containing an interimage effect intensifying layer (hereinafter also referred to as "IIE intensifying layer"). However, in this publication, there is no particular description regarding spectral sensitivity, and there is disclosed only means for further enhancing an overall color saturation.

BRIEF SUMMARY OF THE INVENTION

It is an object of the present invention to provide a color reversal film of high saturation exhibiting enhanced hue faithfulness performance.

(1) A silver halide color reversal photographic lightsensitive material comprising a support and, superimposed thereon, at least one red-sensitive silver halide emulsion layer, at least one green-sensitive silver halide emulsion layer and at least one blue-sensitive silver halide emulsion layer, the red-sensitive silver halide emulsion layer having a weight-averaged wavelength (λra) of spectral sensitivity distribution satisfying the relationship: 600 nm<λra<625 nm, which silver halide color reversal photographic lightsensitive material contains at least one interimage effect intensifying layer substantially not forming any image, the interimage effect intensifying layer containing:

(a) at least one kind of lightsensitive silver halide grains in an amount of less than 10% in terms of silver quantity based on all the silver halide grains for image formation; and (b) nonlightsensitive silver halide fine grains.

(2) The silver halide color reversal photographic lightsensitive material according to item (1), wherein the above at least one green-sensitive silver halide emulsion layer contains at least one kind of a coupler represented by formula (1) or (2):

Formula (1)

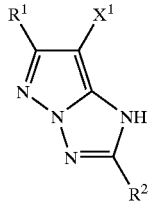

Formula (2)

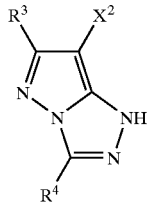

wherein, in the formulae (1) and (2), each of $R^1$, $R^2$, $R^3$ and $R^4$ independently represents a hydrogen atom or a substituent. Each of $X^1$ and $X^2$ independently represents a hydrogen atom or a group which is split off at coupling with developing agent oxidation products, with the proviso that when both the coupler represented by the formula (1) and the coupler represented by the formula (2) are contained in the green-sensitive silver halide emulsion layer, at least one of $X^1$ and $X^2$ is a hydrogen atom.

(3) The silver halide color reversal photographic lightsensitive material according to item (1), wherein at least one green-sensitive silver halide emulsion layer contains a coupler represented by formula (3):

Formula (3)

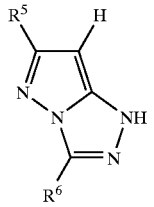

Wherein $R^5$ represents a substituted or unsubstituted secondary alkyl group having 5 to 20 carbon atoms or a substituted or unsubstituted tertiary alkyl group having 4 to 20 carbon atoms. $R^6$ represents a hydrogen atom or a substituent.

(4) The silver halide color reversal photographic light-sensitive material according to item (1), wherein at least one green-sensitive silver halide emulsion layer contains a coupler represented by formula (4):

(4)

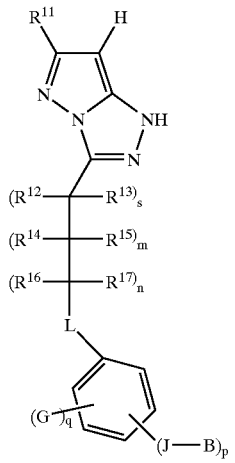

Wherein $R^{11}$ represents a hydrogen atom or a substituent. Each of $R^{12}$, $R^{13}$, $R^{14}$, $R^{15}$, $R^{16}$ and $R^{17}$ independently represents a hydrogen atom, a halogen atom, an alkoxy group, an alkyl group or an aryl group. L represents —$NR^{18}SO_2$—, —$SO_2NR^{18}$—, —$SO_2NR^{18}CO$—, —$NR^{18}COO$—, —$NR^{18}CONR^{19}$— or —COO— (these are bonded with the phenyl group of the formula (4) at the right side of the formulae). Each of $R^{18}$ and $R^{19}$ independently represents a hydrogen atom, a substituted or unsubstituted alkyl group, or a substituted or unsubstituted aryl group. J represents —CO—, —COO—, —O—, —S—, —$CONR^{20}$—, —$NR^{20}CO$—, —$NR^{20}COO$—, —$NR^{20}NR^{21}$—, —$SO_2$—, —$SO_2NR^{20}$— or —$CONR^{20}SO_2$— (these are bonded with the phenyl group of the formula (4) at the right side of the formulae). Each of $R^{20}$ and $R^{21}$ independently represents a hydrogen atom, a substituted or unsubstituted alkyl group, or a substituted or unsubstituted aryl group. B represents a substituted or unsubstituted alkyl group, or a substituted or unsubstituted aryl group. p is an integer of 1 to 5, with the proviso that when p is 2 or greater, a plurality of —J—B groups may be different from each other. G represents a substituent. q is an integer of 0 to 4, with the proviso that when q is 2 or greater, a plurality of G groups may be different from each other. Each of s, m and n independently is 0 or 1.

(5) The silver halide color reversal photographic light-sensitive material according to item (1), wherein the interimage effect intensifying layer contains at least one kind of silver halide grains with sensitivity to bluish green having a weight-averaged wavelength (λia) of spectral sensitivity distribution satisfying the relationship: 490 nm<λia<550 nm, which the weight-averaged wavelength (λia) is calculated by the following formula:

$$\lambda ia = \int_{460}^{600} \lambda Si(\lambda) d\lambda \Big/ \int_{460}^{600} Si(\lambda) d\lambda$$

wherein Si(λ) represents the spectral sensitivity distribution at each wavelength λ determined at a blackened density of 0.2 with respect to a sample obtained by a single coating with an emulsion containing the color-sensitive silver halide grains, the sample having been subjected to black-and-white development.

(6) The silver halide color reversal photographic light-sensitive material according to item (5), wherein the interimage effect intensifying layer contains red-sensitive silver halide grains.

(7) The silver halide color reversal photographic light-sensitive material according to item (1), wherein, in the interimage effect intensifying layer, the amount of contained nonlightsensitive fine grains is greater than that of contained lightsensitive silver halide grains.

(8) The silver halide color reversal photographic light-sensitive material according to item (1), wherein, in the interimage effect intensifying layer, the amount of silver contained in nonlightsensitive fine grains is greater than twice that in lightsensitive silver halide grains.

(9) The silver halide color reversal photographic light-sensitive material according to item (1), wherein the red-sensitive silver halide emulsion layer contains sensitizing dyes represented by formulae (I) and (II):

Formula (I)

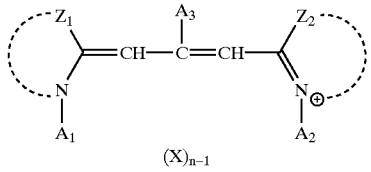

Formula (II)

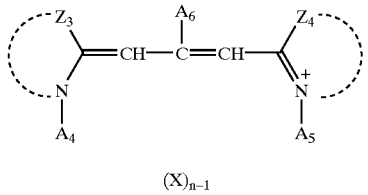

In formula (I), $Z_1$ represents an atomic group needed for constituting a substituted or unsubstituted heterocycle, the heterocycle selected from among benzimidazole, benzoxazole and naphthoxazole. $Z_2$ represents an atomic group needed for constituting a substituted or unsubstituted heterocycle, the heterocycle selected from among benzothiazole, benzoselenazole, naphthothiazole, naphthoselenazole and benzotellurazole. Each of $A_1$ and $A_2$ independently represents a substituted or unsubstituted alkyl or aralkyl group. $A_3$ represents a hydrogen atom, an alkyl group, an aralkyl group or an aryl group. X represents a cation, and n is 1 or 2, with the proviso that n is 1 when an intramolecular salt is formed.

In formula (II), $Z_3$ and $Z_4$ may be identical with or different from each other, and each thereof represents an atomic group needed for constituting a substituted or unsubstituted heterocycle, the heterocycle selected from among benzothiazole, benzoselenazole, benzotellurazole, naphthothiazole and naphthoselenazole. Each of $A_4$ and $A_5$ independently represents a substituted or unsubstituted alkyl or aralkyl group. $A_6$ represents a hydrogen atom, an alkyl group, an aralkyl group or an aryl group. X represents a cation, and n is 1 or 2, with the proviso that n is 1 when an intramolecular salt is formed.

(10) The silver halide color reversal photographic light-sensitive material according to item (9), wherein the mixing molar ratio of sensitizing dye (I)/sensitizing dye (II) is in the range of 0.05 to 4.

(11) The silver halide color reversal photographic light-sensitive material according to item (1), wherein the mixing molar ratio of sensitizing dye (I)/sensitizing dye (II) is in the range of 0.1 to 1.

DETAILED DESCRIPTION OF THE INVENTION

The present invention will be described in detail below.

The lightsensitive material of the present invention comprises a support and, superimposed thereon, at least one blue-sensitive silver halide emulsion layer, at least one green-sensitive silver halide emulsion layer and at least one red-sensitive silver halide emulsion layer. Although it is preferred to provide these layers in the above order from the side remote from the support by coating, the layer arrangement may be different therefrom. In the present invention, it is preferred that from the side close to the support, at least one red-sensitive silver halide emulsion layer, at least one green-sensitive silver halide emulsion layer and at least one blue-sensitive silver halide emulsion layer be provided in this order by coating. Further, it is preferred that each of the color-sensitive layers have a unit arrangement including a plurality of lightsensitive emulsion layers of different photographic speeds. In particular, it is more preferred that each of the color-sensitive layers have a three-layer unit arrangement including three lightsensitive emulsion layers which consist of a low-speed layer, a medium-speed layer and a high-speed layer arranged in this order from the side close to the support. These are described in, for example, Jpn. Pat. Appln. KOKOKU Publication No. (hereinafter referred to as JP-B-) 49-15495 and JP-A-59-202464.

As one preferred embodiment of the present invention, there can be mentioned a lightsensitive material comprising a support and, superimposed thereon by coating in the given order, a subbing layer/an antihalation layer/a first interlayer/an interimage effect intensifying layer (IIE intensifying layer)/a second interlayer/a red-sensitive emulsion layer unit (consisting of three layers, namely, a low-speed red-sensitive layer/a medium-speed red-sensitive layer/a high-speed red-sensitive layer arranged in this order from the side close to the support)/a third interlayer/a green-sensitive emulsion layer unit (consisting of three layers, namely, a low-speed green-sensitive layer/a medium-speed green-sensitive layer/a high-speed green-sensitive layer arranged in this order from the side close to the support)/a fourth interlayer/a yellow-filter layer/a blue-sensitive emulsion layer unit (consisting of three layers, namely, a low-speed blue-sensitive layer/a medium-speed blue-sensitive layer/a high-speed blue-sensitive layer arranged in this order from the side close to the support)/a first protective layer/a second protective layer/a third protective layer.

Each of the first, second, third and fourth interlayers may consist of a single layer or a plurality of layers. It is preferred that the second interlayer consist of a plurality of separable layers, among which the layer directly adjacent to the red-sensitive layer contains yellow colloidal silver. Similarly, it is preferred that the third interlayer consist of a plurality of layers, among which the layer directly adjacent to the green-sensitive layer contains yellow colloidal silver. These interlayers may contain not only, for example, couplers and DIR compounds as described in JP-A's 61-43748, 59-113438, 59-113440, 61-20037 and 61-20038, but also customarily employed color mixing preventive agents.

With respect to common protective layers, a three-layer arrangement consisting of first to third layers is preferably employed. Nonlightsensitive fine grains are often incorporated in the second protective layer in order to reduce processing dependence. The interimage effect intensifying layer of the present invention described in detail below can be used in place of the second protective layer.

The lightsensitive material of the present invention has at least one interimage effect intensifying layer. The interimage effect intensifying layer (IIE intensifying layer) refers to a layer which works to amplify the interimage effect (IIE) exerted during the processing of lightsensitive material. This IIE intensifying layer contains a small amount of lightsensitive silver halide grains and nonlightsensitive silver halide fine grains. For the lightsensitive silver halide grains, those of color sensitivity to which imparting of IIE is desired are selected.

The nonlightsensitive silver halide fine grains are known as adsorbing iodide ions working as a development inhibitor in the first development of color reversal processing to thereby remove them. On the other hand, around the site where the lightsensitive silver halide grains contained therewith are developed in the first development, the nonlightsensitive fine grains are dissolved and eliminated by a solution physical development. Therefore, at part where the lightsensitive silver halide grains have been developed in the IIE intensifying layer, the concentration of iodide ions would be increased, and greater development inhibiting action works to parts remaining undeveloped. As a result, the interimage effect would be intensified in correspondence to the color sensitivity of lightsensitive silver halide grains.

In the present invention, it is preferred that at least one type of silver halide grains with sensitivity to bluish green be contained in the IIE intensifying layer. Herein, the silver halide grains with sensitivity to bluish green refer to color-sensitive silver halide grains whose weight-averaged wavelength ($\lambda ia$) of spectral sensitivity distribution satisfies the relationship: 490 nm<$\lambda ia$<550 nm. The weight-averaged wavelength ($\lambda ia$) of spectral sensitivity distribution of silver halide grains can be calculated by the following formula.

$$\lambda ia = \int_{460}^{600} \lambda Si(\lambda) d\lambda \Big/ \int_{460}^{600} Si(\lambda) d\lambda$$

wherein Si($\lambda$) represents the spectral sensitivity distribution at each wavelength $\lambda$ determined at a blackened density of 0.2 with respect to a sample obtained by a single coating with an emulsion containing the above color-sensitive silver halide grains, the sample having been subjected to black-and-white development.

Examples of sensitizing dyes which can practically be used in the above interimage effect intensifying layer with sensitivity to bluish green will be set out below, Dye-1

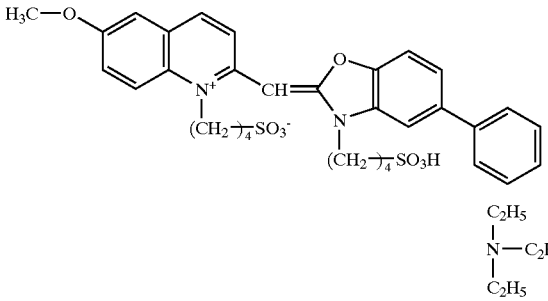

Dye-2

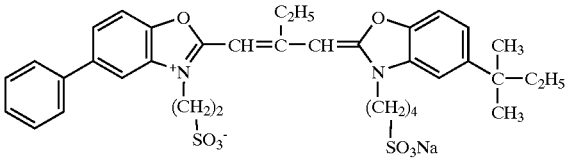

-continued

Dye-3

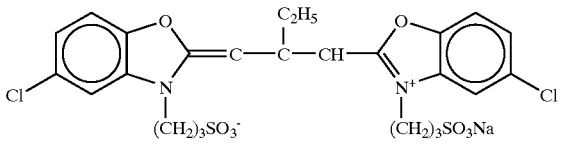

Dye-4

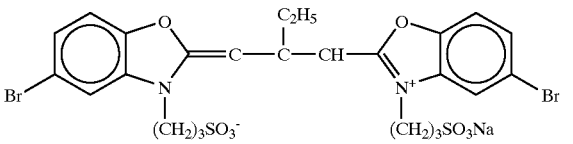

Dye-5

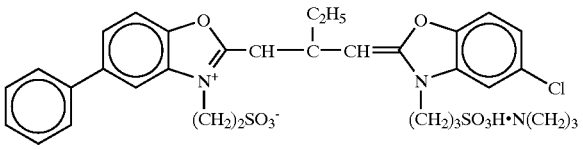

Naturally, in addition to the above silver halide grains with sensitivity to bluish green, two or more types of blue-sensitive and red-sensitive silver halide grains can be incorporated in the IIE intensifying layer according to necessity. In particular, it is preferred to simultaneously incorporate silver halide grains with sensitivity to bluish green and red-sensitive silver halide grains.

It is preferred that the amount of lightsensitive silver halide grains contained in the IIE intensifying layer of the present invention be small be small. For example, a satisfactory IIE intensifying effect can be exerted with the content corresponding to less than 10% (in terms of silver quantity) based on all the lightsensitive silver halide grains contained in the lightsensitive material of the present invention. The use thereof in a large amount is not preferable from the viewpoint of, for example, drop of the sharpness of underlayer.

The nonlightsensitive silver halide fine grains contained in the IIE intensifying layer of the present invention will now be described. The nonlightsensitivity means that substantially any latent image is not formed with exposure intensity with which simultaneously contained lightsensitive grains form a latent image. For example, the nonlightsensitivity refers to a sensitivity 0.5 log E or more lower than that of lightsensitive grains. It is requisite that the solubility of nonlightsensitive silver halide fine grains in the first developer of color reversal processing be satisfactorily higher than that of simultaneously contained lightsensitive silver halide grains. It is also requisite that the equivalent-sphere diameter of nonlightsensitive silver halide fine grains be 0.2 μm or less. The equivalent-sphere diameter of grain refers to the diameter of a sphere having the same volume as that of the grain.

Typically, as in the Lippmann emulsion, use is made of silver halide fine grains. These silver halide fine grains preferably consist of silver bromide, silver iodobromide, silver chloride or silver chlorobromide. When a silver haloiodide is employed, it is preferred that the content of silver iodide be low from the viewpoint of avoiding solubility deterioration. The content of silver iodide is preferably less than 10 mol %. Although small grain size is preferred from the viewpoint of solubility, the stability of grain size in the state of a coating liquid must be ensured from the practical viewpoint, so that the grain size must be a certain level or greater. Accordingly, the equivalent-sphere diameter of nonlightsensitive silver halide fine grains is preferably in the range of 0.03 to 0.2 μm, more preferably 0.08 to 0.15 μm.

In the IIE intensifying layer, the amount of contained nonlightsensitive fine grains is preferably larger than that of contained lightsensitive silver halide grains. The amount of silver contained in nonlightsensitive fine grains is preferably greater than twice that in lightsensitive silver halide grains.

The IIE intensifying layer of the present invention, although may contain a color coupler, is preferably a noncoloring layer wherein substantially no coupler is contained. The noncoloring layer refers to a layer whose contribution to the whole color formation density is only 10% or less. For avoiding the color formation of the IIE intensifying layer, it is preferred that an interlayer containing a color mixing preventive agent be interposed between the IIE intensifying layer and a layer containing a coupler, and that a color mixing preventive agent be contained in the IIE intensifying layer per se.

The IIE intensifying layer of the present invention, although can be interposed between interlayers or between protective layers, is preferably interposed between a yellow filter layer and the support for enhancing color separation performance. On the other hand, it is practicable to provide protective layers of three-layer arrangement and employ the IIE intensifying layer in place of the second protective layer.

Below, the spectral sensitivity of red-sensitive silver halide emulsion layer according to the present invention will be described. The weight-averaged wavelength (λra) of spectral sensitivity distribution of the red-sensitive silver halide emulsion layer is characterized by satisfying the relationship: 600 nm<λra<625 nm. The weight-averaged wavelength λra can be calculated by the following formula.

$$\lambda ra = \int_{500}^{700} \lambda Sr(\lambda)d\lambda \Big/ \int_{500}^{700} Sr(\lambda)d\lambda$$

wherein Sr(λ) represents the spectral sensitivity distribution at a color formation density of 1.0 of the red-sensitive silver halide emulsion layer.

The spectral sensitivity of red-sensitive silver halide emulsion layer according to the present invention can be realized by the use of a mixture of sensitizing dyes of the following general formulae (I) and (II) wherein the mixing ratio (molar ratio of sensitizing dye (I)/sensitizing dye (II)) is in the range of 0.05 to 4, preferably 0.1 to 1.

Formula (I)

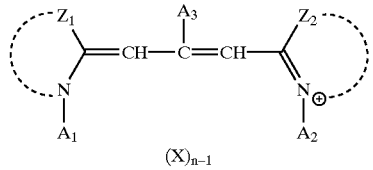

Formula (II)

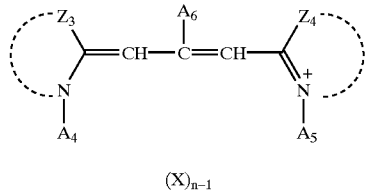

In the general formula (I), $Z_1$ represents an atomic group needed for constituting a substituted or unsubstituted heterocycle, the heterocycle selected from among benzimidazole, benzoxazole and naphthoxazole. $Z_2$ represents an atomic group needed for constituting a substituted or unsubstituted heterocycle, the heterocycle selected from among benzothiazole, benzoselenazole, naphthothiazole, naphthoselenazole and benzotellurazole. Each of $A_1$ and $A_2$ represents a substituted or unsubstituted alkyl or aralkyl group. $A_3$ represents a hydrogen atom, an alkyl group, an aralkyl group or an aryl group. X represents a cation, and n is 1 or 2, with the proviso that n is 1 when an intramolecular salt is formed.

In the general formula (II), $Z_3$ and $Z_4$ may be identical with or different from each other, and each thereof represents an atomic group needed for constituting a substituted or unsubstituted heterocycle, the heterocycle selected from among benzothiazole, benzoselenazole, benzotellurazole, naphthothiazole and naphthoselenazole. Each of $A_4$ and $A_5$ represents a substituted or unsubstituted alkyl or aralkyl group. $A_6$ represents a hydrogen atom, an alkyl group, an aralkyl group or an aryl group. X represents a cation, and n is 1 or 2, with the proviso that n is 1 when an intramolecular salt is formed.

Examples of the sensitizing dyes represented by the general formulae (I) and (II) will be set out below.

Dye-6

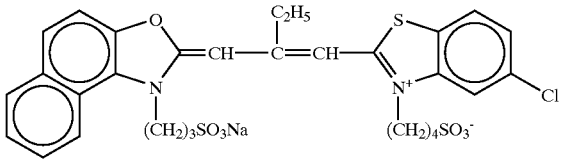

Dye-7

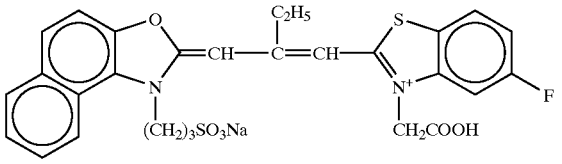

Dye-8

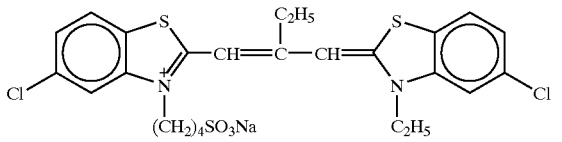

Dye-9

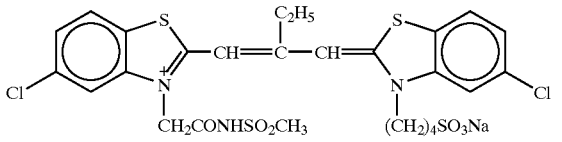

Dye-10

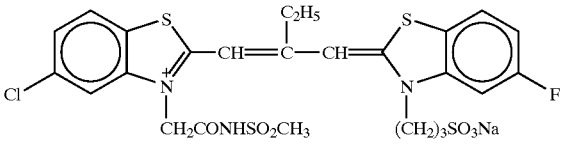

In the same manner as in the red-sensitive silver halide emulsion layer, the weight-averaged wavelength (λga) of spectral sensitivity distribution of green-sensitive silver halide emulsion layer and the weight-averaged wavelength (λba) of spectral sensitivity distribution of blue-sensitive silver halide emulsion layer can be calculated by the following formulae.

$$\lambda ga = \int_{500}^{700} \lambda Sg(\lambda)d\lambda \Big/ \int_{500}^{700} Sg(\lambda)d\lambda$$

$$\lambda ba = \int_{370}^{700} \lambda Sb(\lambda)d\lambda \Big/ \int_{370}^{700} Sb(\lambda)d\lambda$$

In the above formulae, Sg(λ) and Sb(λ) represent the spectral sensitivity distributions, at a color formation density of 1.0, of green-sensitive silver halide emulsion layer and blue-sensitive silver halide emulsion layer, respectively. Sg(λ) preferably satisfies the relationship: 530 nm≦Sg(λ)≦555 nm. Sb(λ) preferably satisfies the relationship: 430 nm≦Sb(λ)≦460 nm.

In the present invention, the lightsensitive material contains an image forming coupler. The image forming coupler refers to a coupler capable of coupling with products of oxidation of an aromatic primary amine color developing agent to thereby form an image forming dye. Generally, a yellow coupler, a magenta coupler and a cyan coupler are employed in combination so as to obtain a color image.

In the use of the image forming coupler of the present invention, it is preferably added to a lightsensitive emulsion layer which is sensitive to light with the relationship with complementary colors with the color formation hue of the image forming coupler. That is, the yellow coupler is added to the blue-sensitive emulsion layer, the magenta coupler to the green-sensitive emulsion layer, and the cyan coupler to the red-sensitive emulsion layer. Further, a coupler without the above relationship of complementary colors may be mixed and used for the purpose of, for example, enhancing shadow imaging characteristics (for example, a cyan coupler is added together with the magenta coupler to the green-sensitive emulsion layer).

The couplers represented by the general formula (1) and the general formula (2) which the lightsensitive material of the present invention can preferably contain (hereinafter also referred to as "couplers of the present invention") will be described below.

First, the couplers of the general formula (1) will be described in detail.

In the general formula (1), each of $R^1$ and $R^2$ independently represents a hydrogen atom or a substituent. $X^1$ represents a hydrogen atom or a group which is split off at coupling with developing agent oxidation products.

Each of $R^1$ and $R^2$ can preferably be, for example, any of a hydrogen atom, a halogen atom, an alkyl group, an alkenyl group, an alkynyl group, a cycloalkyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including anilino), an acylamino group, an aminocarbonylamino group, an alkoxycarbonylamino group, an aryloxycarbonylamino group, a sulfamoylamino group, an alkyl- or arylsulfonylamino group, an alkylthio group, an arylthio group, a heterocyclic thio group, a sulfamoyl group, a sulfo group, a sulfinyl group, a sulfenyl group, an alkyl- or arylsulfonyl group, an acyl group, an aryloxycarbonyl group, an alkoxycarbonyl group, a carbamoyl group, an a20 group, an imido group and a phosphoryl group.

More specifically, each of $R^1$ and $R^2$ can be, for example, any of a hydrogen atom; a halogen atom (e.g., a chlorine atom, a bromine atom or an iodine atom); an alkyl group (linear or branched substituted or unsubstituted alkyl group, preferably an alkyl group having 1 to 30 carbon atoms, e.g., methyl, ethyl, n-propyl, isopropyl, t-butyl, n-octyl, eicosyl, 2-chloroethyl, 2-cyanoethyl or 2-ethylhexyl); an alkenyl group (substituted or unsubstituted alkenyl group, preferably a substituted or unsubstituted alkenyl group having 2 to 30 carbon atoms, e.g., allyl, pulenyl, geranyl or oleyl); an alkynyl group (substituted or unsubstituted alkynyl group, preferably a substituted or unsubstituted alkynyl group having 2 to 30 carbon atoms, e.g., ethynyl or propargyl); a cycloalkyl group (substituted or unsubstituted cycloalkyl group, preferably a substituted or unsubstituted cycloalkyl group having 5 to 7 carbon atoms, e.g., cyclohexyl or cyclopentyl); an aryl group (preferably a substituted or unsubstituted aryl group having 6 to 30 carbon atoms, such as phenyl, p-tolyl, naphthyl, m-chlorophenyl or o-hexadecanoylaminophenyl); a heterocyclic group (preferably a 5- or 6-membered substituted or unsubstituted aromatic or nonaromatic heterocyclic group, more preferably a 5- or 6-membered aromatic heterocyclic group having 3 to 20 carbon atoms, such as 2-furyl, 2-thienyl, 2-pyrimidinyl or 2-benzothiazolyl); a cyano group; a hydroxyl group; a nitro group; a carboxyl group; an alkoxy group (preferably a substituted or unsubstituted alkoxy group having 1 to 30 carbon atoms, such as methoxy, ethoxy, isopropoxy, t-butoxy, n-octyloxy or 2-methoxyethoxy); an aryloxy group (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); a silyloxy group (preferably a silyloxy group having 3 to 20 carbon atoms, such as trimethylsilyloxy or t-butyldimethylsilyloxy); a heterocyclic oxy group (preferably a substituted or unsubstituted heterocyclic oxy group having 2 to 20 carbon atoms, such as 1-phenyltetrazol-5-oxy or 2-tetrahydropyranyloxy); an acyloxy group (preferably a substituted or unsubstituted acyloxy group having 2 to 30 carbon atoms, such as formyloxy, acetyloxy, pivaloyloxy or stearoyloxy); a carbamoyloxy group (preferably a substituted or unsubstituted carbamoyloxy group having 1 to 30 carbon atoms, such as dimethylcarbamoyloxy, diethylcarbamoyloxy, morpholinocarbonyloxy or di-n-octylcarbamoyloxy); an alkoxycarbonyloxy group (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); an aryloxycarbonyloxy group (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); an amino group (including anilino) (preferably a substituted or unsubstituted alkylamino group having 1 to 30 carbon atoms or a substituted or unsubstituted anilino group having 6 to 30 carbon atoms, such as amino, methylamino, dimethylamino, anilino, N-methylanilino or diphenylamino); an acylamino group (preferably a substituted or unsubstituted acylamino group having 2 to 30 carbon atoms, such as formylamino, acetylamino, pivaloylamino or lauroylamino); an aminocarbonylamino group (preferably a substituted or unsubstituted aminocarbonylamino group having 1 to 30 carbon atoms, such as carbamoylamino, dimethylaminocarbonylamino, diethylaminocarbonylamino or morpholinocarbonylamino); an alkoxycarbonylamino group (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methylmethoxycarbonylamino); an aryloxycarbonylamino group (preferably a substituted or unsubstituted aryloxycarbonylamino group having 7 to 30 carbon atoms, such as phenoxycarbonylamino, p-chlorophenoxycarbonylamino or m-n-octylphenoxycarbonylamino); a sulfamoylamino group (preferably a substituted or unsubstituted sulfamoylamino group having 0 to 30 carbon atoms, such as sulfamoylamino, dimethylsulfamoylamino or n-octylsulfamoylamino); an alkyl- or arylsulfonylamino group (preferably a substituted or unsubstituted alkylsulfonylamino group having 1 to 30 carbon atoms, such as methanesulfonylamino or butanesulfonylamino; or a substituted or unsubstituted arylsulfonylamino group having 6 to 30 carbon atoms, such as phenylsulfonylamino (benzenesulfonylamino) or toluenesulfonylamino (p-methylphenylsulfonylamino)); an alkylthio group (preferably a substituted or unsubstituted alkylthio group having 1 to 30 carbon atoms, such as methylthio, ethylthio or n-hexadecylthio); an arylthio group (preferably a substituted or unsubstituted arylthio group having 6 to 30 carbon atoms, such as phenylthio, tolylthio or m-methoxyphenylthio); a heterocyclic thio group (preferably a substituted or unsubstituted heterocyclic thio group having 3 to 30 carbon atoms, such as 2-benzothiazolylthio or 2,4-diphenoxy-1,3,5-triazol-6-ylthio); a sulfamoyl group (preferably a substituted or unsubstituted sulfamoyl group having 0 to 30 carbon atoms, such as N-ethylsulfamoyl, N-(2-dodecyloxyethyl)sulfamoyl or N,N-dimethylsulfamoyl); a sulfo group; a sulfinyl group; a sulfenyl group; an alkyl- or arylsulfonyl group (preferably a substituted or unsubstituted alkylsulfonyl group having 1 to 30 carbon atoms, such as methanesulfonyl or ethanesulfonyl; or a substituted or unsubstituted arylsulfonyl group having 6 to 30 carbon atoms, such as benzenesulfonyl or toluenesulfonyl); an acyl group (preferably a substituted or unsubstituted alkylcarbonyl group having 1 to 30 carbon atoms, such as acetyl, pivaloyl, 2-chloroacetyl or stearoyl; or a substituted or unsubstituted arylcarbonyl group having 7 to 30 carbon atoms, such as benzoyl or p-n-octyloxyphenylcarbonyl); an aryloxycarbonyl group (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); an alkoxycarbonyl group (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); a carbamoyl group (preferably a substituted or unsubstituted carbamoyl group having 1 to 30 carbon atoms, such as aminocarbonyl, N-methylaminocarbonyl, N,N-dimethylaminocarbonyl or N,N-di-n-octylaminocarbonyl); an azo group (preferably a substituted or unsubstituted arylazo group having 6 to 30 carbon atoms, such as phenylazo or p-chlorophenylazo; or a substituted or unsubstituted heterocyclic azo group having 6 to 30 carbon atoms, such as 5-ethylthio-1,3,4-thiadiazol-2-ylazo); an imido group (preferably N-succinimido or N-phthalimido); and a phosphoryl group (preferably a substituted or unsubstituted phosphoryl group having 2 to 30 carbon atoms, such as phenoxyphosphoryl or octyloxyphosphoryl).

More preferably, $R^1$ represents a substituted or unsubstituted alkyl group (having 1 to 20 carbon atoms). Of the alkyl groups, a tertiary substituted or unsubstituted alkyl group (having 4 to 20 carbon atoms) is especially preferred. An unsubstituted tertiary alkyl group (having 4 to 20 carbon atoms) is most preferred.

More preferably, $R^2$ represents a substituted or unsubstituted alkyl group (having 1 to 20 carbon atoms) or a substituted or unsubstituted aryl group (having 6 to 20 carbon atoms). Of the alkyl groups, a secondary substituted alkyl group (having 3 to 20 carbon atoms) is especially preferred. Of the aryl groups, a substituted aryl group (having 6 to 20 carbon atoms) is especially preferred.

It is preferred that $X^1$ represent a halogen atom, an aryloxy group (having 6 to 20 carbon atoms) or a hydrogen atom. More preferably, $X^1$ represents a hydrogen atom or a chlorine atom.

With respect to the structure of the general formula (1), one wherein $R^1$ represents a tertiary unsubstituted alkyl group (having 4 to 20 carbon atoms), $R^2$ represents a substituted aryl group (having 6 to 20 carbon atoms) and $X^1$ represents a chlorine atom is preferred.

Specific examples of the compounds represented by the general formula (1) will be set out below, which however in no way limit the scope of the present invention.

I-1

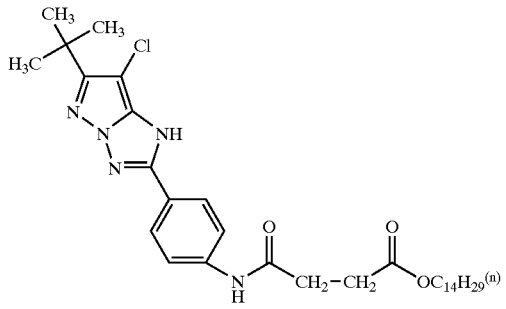

I-2

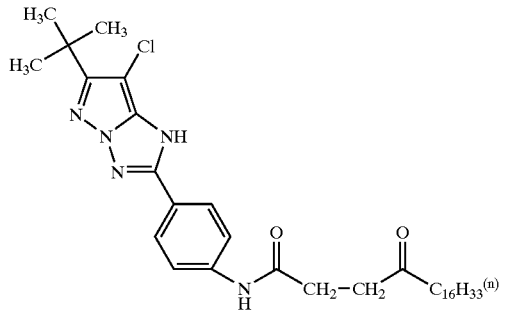

I-3

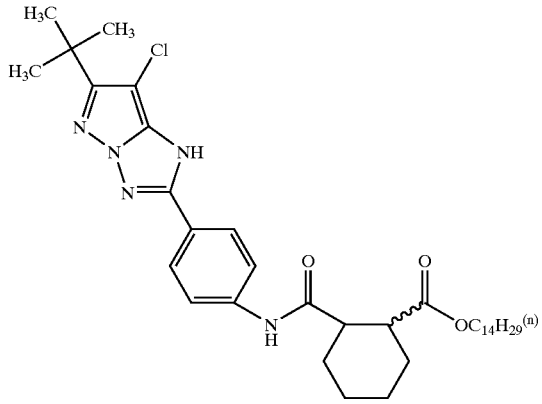

I-4

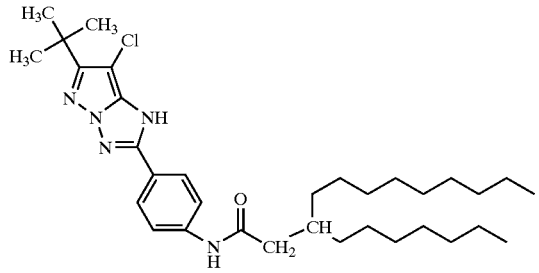

I-5

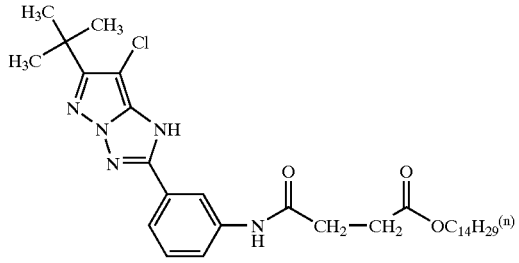

I-6

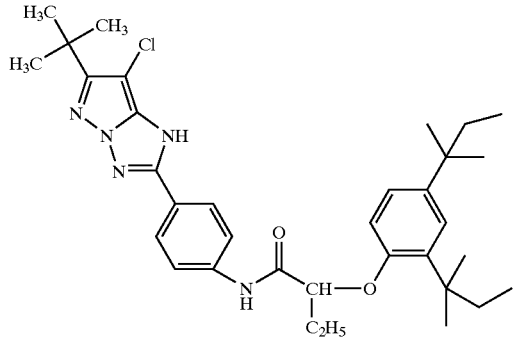

-continued
I-7
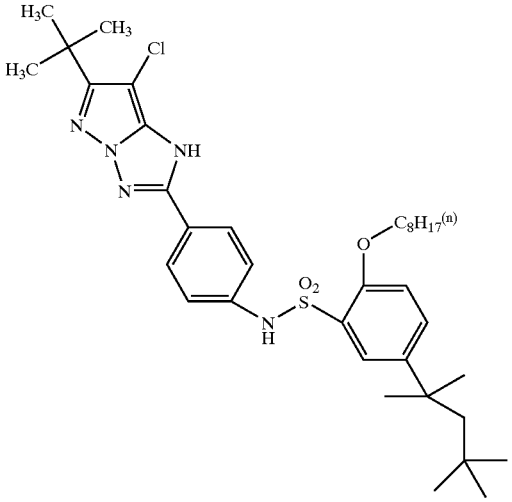
I-8
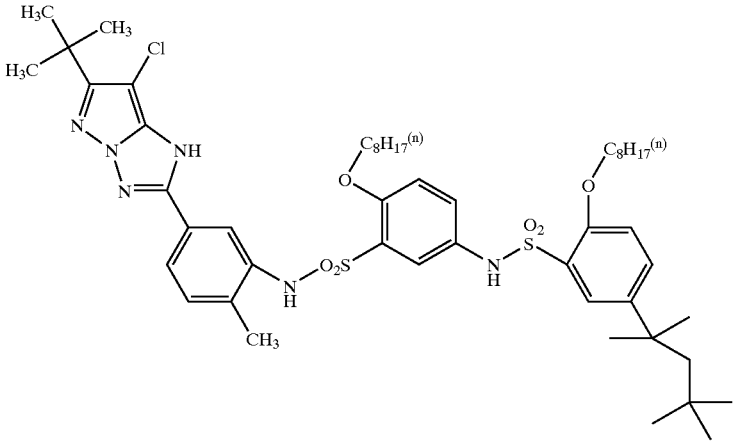
I-9
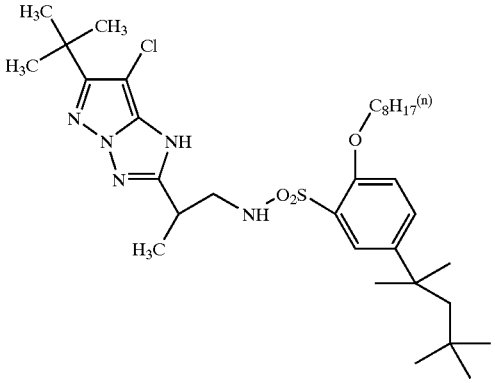
I-10
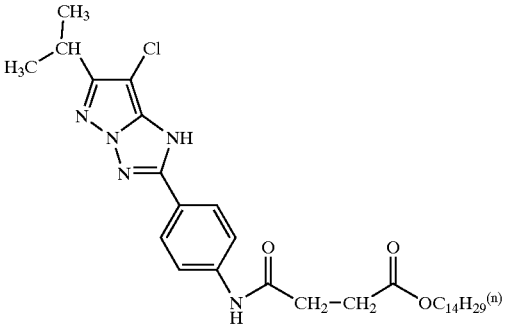
I-11
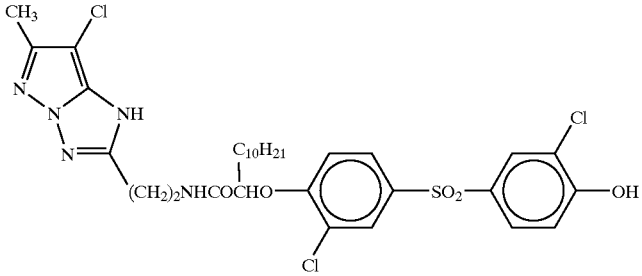

-continued
I-12
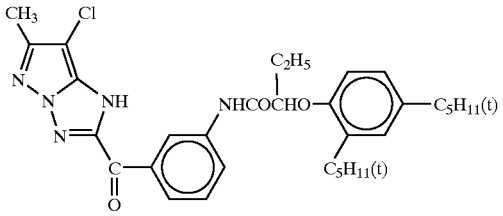
I-13
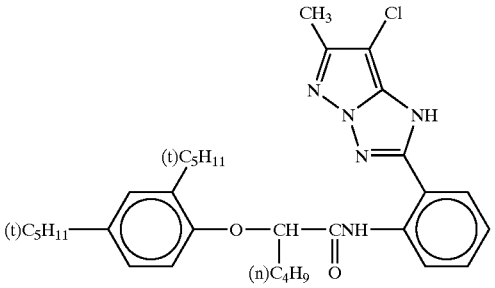
I-14
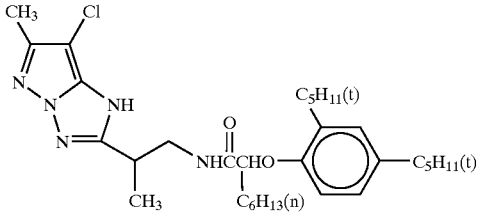
I-15
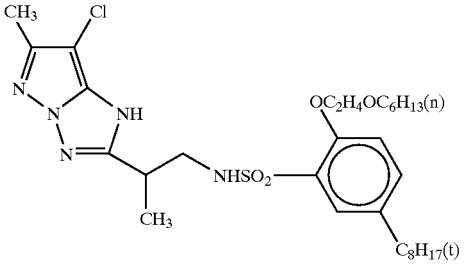
I-16
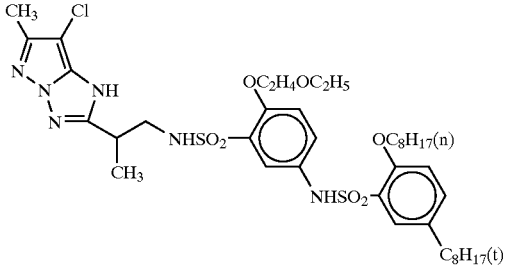
I-17
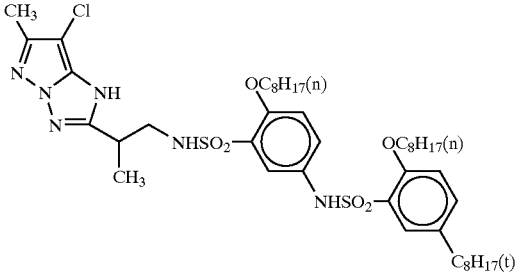
I-18
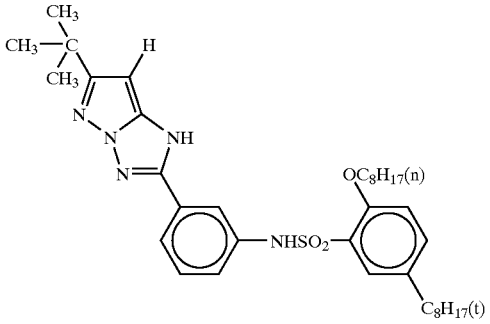
I-19
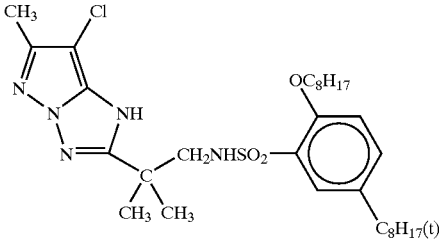
I-20
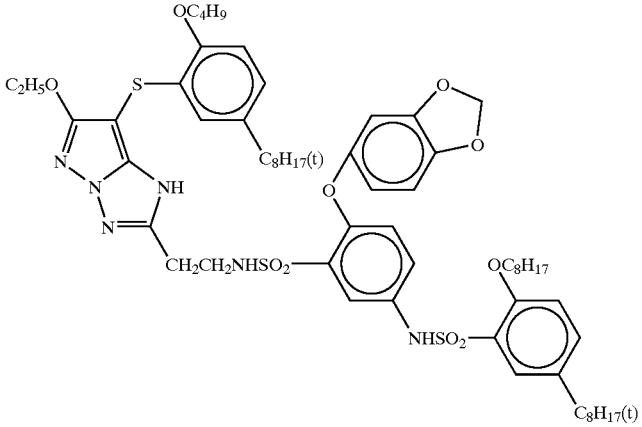

-continued
I-21
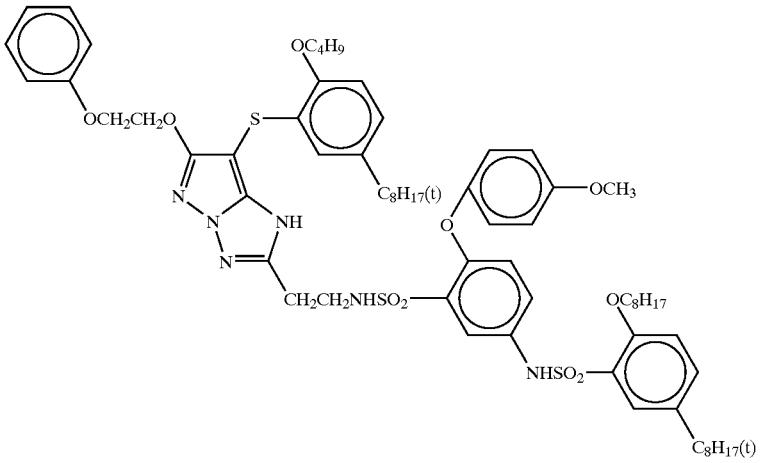
I-22
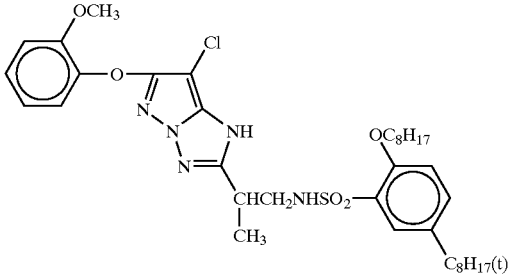
I-23
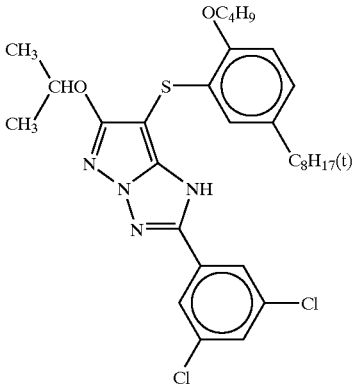
I-24
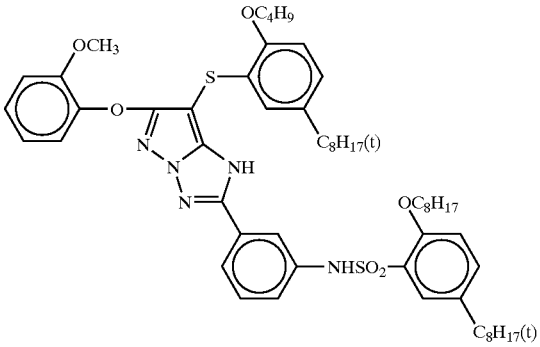
I-25
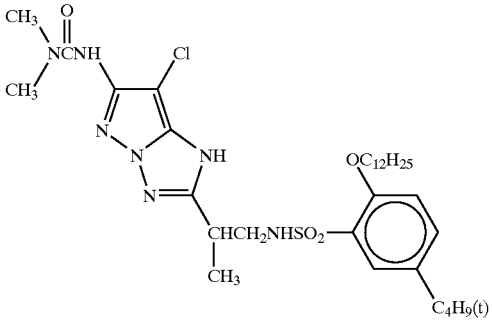
I-26
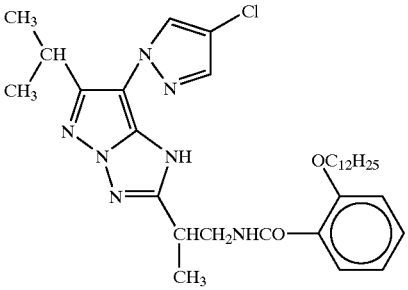

-continued
I-27
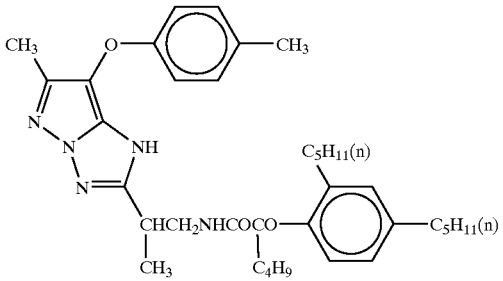
I-28
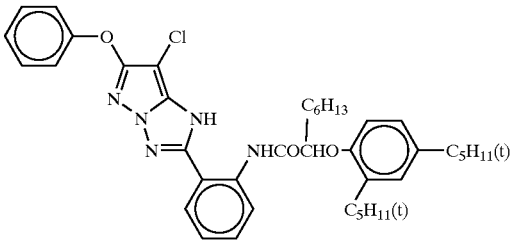
I-29
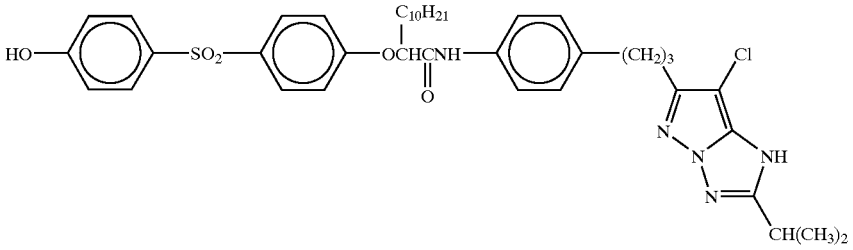
I-30
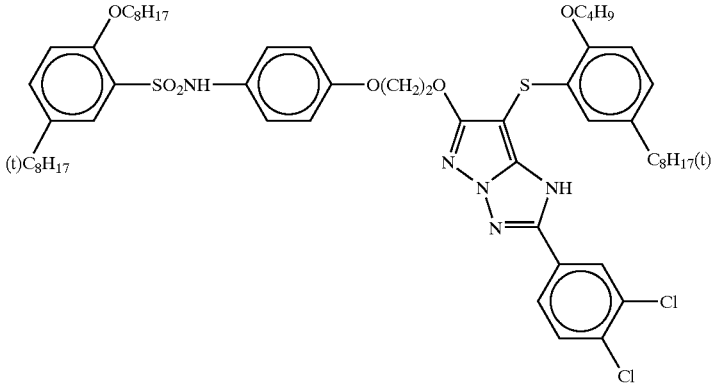
I-31
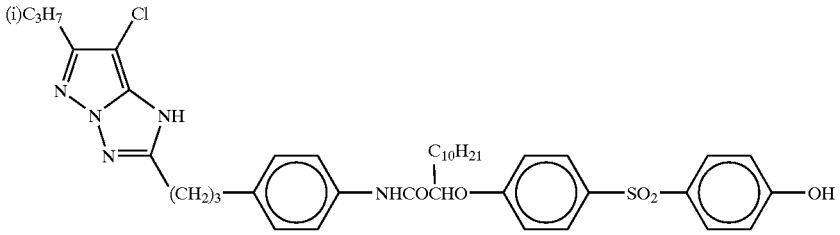
I-32
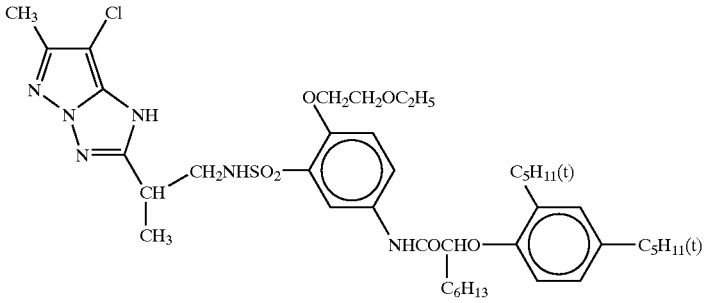

-continued
I-33
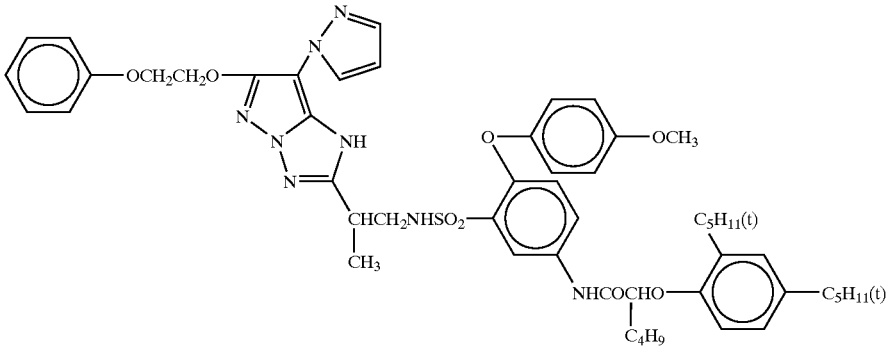
I-34
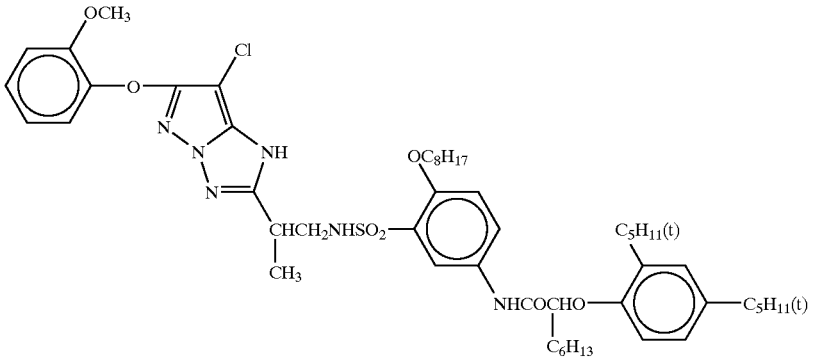
I-35
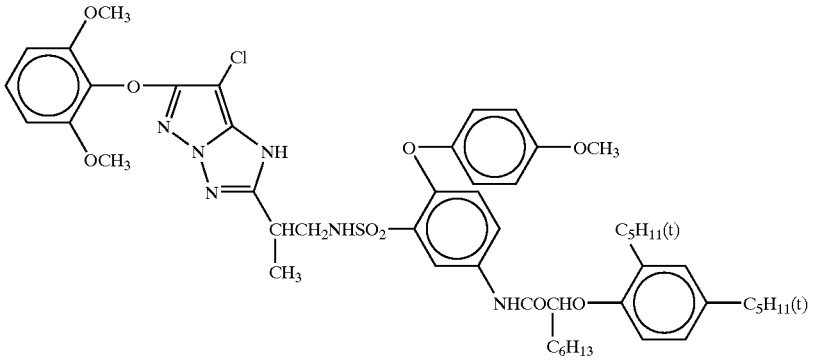
I-36
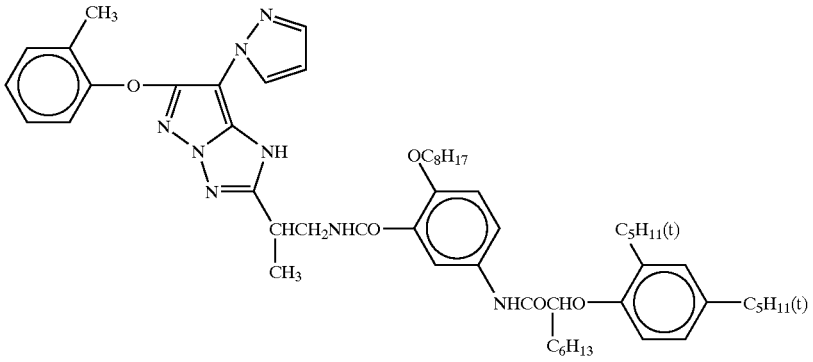

-continued

I-37

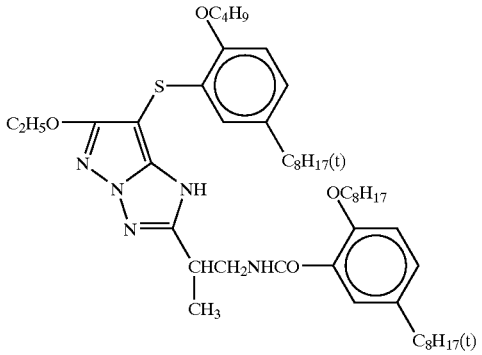

I-38

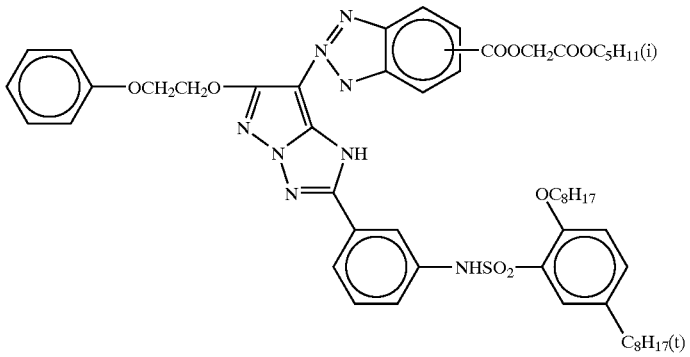

I-39

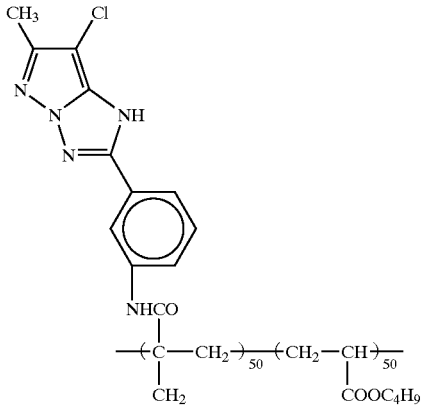

I-40

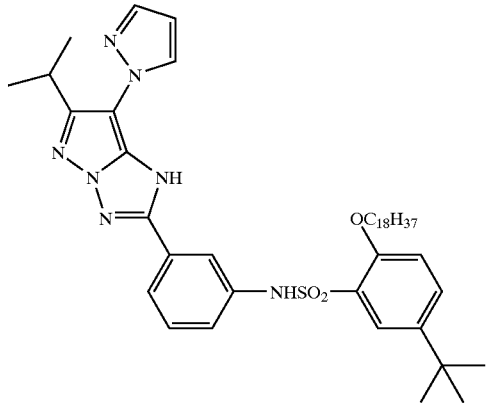

Now, the couplers of the general formula (2) will be described in detail. In the general formula (2), each of $R^3$ and $R^4$ independently represents a hydrogen atom or a substituent. $X^2$ represents a hydrogen atom or a group which is split off at coupling with developing agent oxidation products. $X^2$ preferably represents a halogen atom, an aryloxy group or a hydrogen atom.

The substituents represented by $R^3$ and $R^4$ can be, for example, those mentioned above with respect to $R^1$ and $R^2$ of the general formula (1).

$R^3$ more preferably represents a substituted or unsubstituted alkyl group (having 1 to 20 carbon atoms). $R^4$ preferably represents a substituted or unsubstituted alkyl group (having 2 to 20 carbon atoms) or a substituted or unsubstituted aryl group (having 6 to 20 carbon atoms). $X^2$ preferably represents a hydrogen atom.

It is preferred that the couplers of the general formula (2) have a structure represented by the general formula (3);

Formula (3)

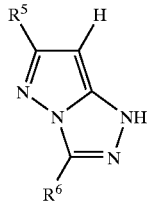

In the general formula (3), $R^5$ represents a substituted or unsubstituted secondary alkyl group (having 5 to 20 carbon atoms) or a substituted or unsubstituted tertiary alkyl group (having 4 to 20 carbon atoms). $R^6$ represents a hydrogen atom or a substituent. It is preferred that $R^5$ represent an unsubstituted tertiary alkyl group (having 4 to 20 carbon atoms, for example, t-butyl), and that $R^6$ represent a substituted or unsubstituted alkyl group (having 2 to 20 carbon atoms) or a substituted or unsubstituted aryl group (having 6 to 20 carbon atoms). Among the alkyl groups, a substituted tertiary alkyl group (having 4 to 20 carbon atoms) or secondary alkyl group (having 3 to 20 carbon atoms) is preferred. Among the aryl groups, a substituted aryl group (having 6 to 20 carbon atoms) is preferred.

Moreover, it is preferred that $R^5$ or $R^6$ have a dissociable substituent whose pKa value as measured in a 6:4 mixture of tetrahydrofuran and water at 25° C. is 10 or less. It is more preferred that $R^6$ have a dissociable substituent whose pKa value as measured in a 6:4 mixture of tetrahydrofuran and water at 25° C. is 10 or less. The pKa value has been measured by acid-base titration.

| Measuring conditions: | |
|---|---|
| tetrahydrofuran:water = | 60:40 |
| temperature | 25° C. |

As the dissociable substituent whose pKa value as measured under the above conditions is 10 or less, there can be mentioned —CO—NH—$SO_2$—, —COOH, a phenolic hydroxyl group or —$NHSO_2$—.

Most preferred example of the structures represented by the general formula (3) is one wherein $R^5$ is an unsubstituted tertiary alkyl group (having 4 to 20 carbon atoms) and $R^6$ is a substituted secondary alkyl group (having 3 to 20 carbon atoms), in particular, one wherein $R^5$ is t-butyl and $R^6$ is a 1-methylalkyl, namely, alkyl substituted with methyl at its 1-position.

Further, preferably, $R^6$ has a dissociable substituent whose pKa value as measured under the above conditions is 10 or less.

Most preferred example of the structures represented by the general formula (3) may be one represented by the following general formula (4).

(4)

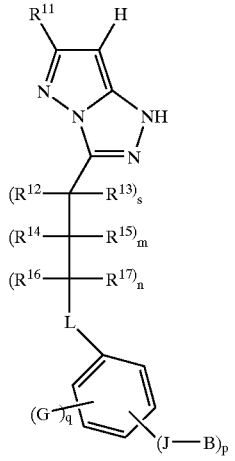

In the general formula (4), $R^{11}$ has the same meaning as that of $R^1$ of the general formula (1). Each of $R^{12}$, $R^{13}$, $R^{14}$, $R^{15}$, $R^{16}$ and $R^{17}$ independently represents a hydrogen atom, a halogen atom, an alkoxy group, an alkyl group or an aryl group. L represents —$NR^{18}SO_2$—, —$SO_2NR^{18}$—, —$SO_2NR^{18}CO$—, —$NR^{18}COO$—, —$NR^{18}CONR^{19}$— or —COO— (these are bonded with the phenyl group of the general formula (4) at the right side of the formulae). Each of $R^{18}$ and $R^{19}$ independently represents a hydrogen atom, a substituted or unsubstituted alkyl group, or a substituted or unsubstituted aryl group. J represents —CO—, —COO—, —O—, —S—, —$CONR^{20}$—, —$NR^{20}CO$—, —$NR^{20}COO$—, —$NR^{20}NR^{21}$—, —$SO_2$—, —$SO_2NR^{20}$— or —$CONR^{20}SO_2$— (these are bonded with the phenyl group of the general formula (4) at the right side of the formulae). Each of $R^{20}$ and $R^{21}$ independently represents a hydrogen atom, a substituted or unsubstituted alkyl group, or a substituted or unsubstituted aryl group. B represents a substituted or unsubstituted alkyl group, or a substituted or unsubstituted aryl group. p is an integer of 1 to 5, with the proviso that when p is 2 or greater, a plurality of —J—B groups may be different from each other. G represents a substituent. q is an integer of 0 to 4, with the proviso that when q is 2 or greater, a plurality of G groups may be different from each other. Each of s, m and n independently is 0 or 1.

The general formula (4) will be described in detail. $R^{11}$ has the same meaning as that of $R^1$ of the general formula (1). Specific examples and preferred examples of the groups represented thereby are also the same as those of $R^1$.

Each of $R^{12}$, $R^{13}$, $R^{14}$, $R^{15}$, $R^{16}$ and $R^{17}$ independently represents a hydrogen atom, a halogen atom, an alkoxy group, an alkyl group or an aryl group. These groups may have substituents. Examples of the substituents can be those mentioned above with respect to $R^1$ of the general formula (1). Moreover, any two of $R^{12}$, $R^{13}$, $R^{14}$, $R^{15}$, $R^{16}$ and $R^{17}$ may be bonded with each other to thereby form a ring structure in cooperation with C—C or C—C—C.

Each of $R^{12}$, $R^{13}$, $R^{14}$, $R^{15}$, $R^{16}$ and $R^{17}$ preferably represents a hydrogen atom, an alkyl group (having 1 to 20 carbon atoms), or an aryl group (having 6 to 20 carbon atoms). More preferably, at least one of $R^{12}$ and $R^{13}$ represents an alkyl group or an aryl group, while each of $R^{14}$, $R^{15}$, $R^{16}$ and $R^{17}$ represents a hydrogen atom, an alkyl group or an aryl group. Most preferably, at least one of $R^{12}$ and $R^{13}$ represents a group selected from among methyl, ethyl and isopropyl, while each of $R^{14}$, $R^{15}$, $R^{16}$ and $R^{17}$ represents a hydrogen atom, an alkyl group or an aryl group.

Each of s, m and n independently is 0 or 1. Preferably, s and m are simultaneously 1 while n is 0, or s is 1 while m and n are simultaneously 0.

L preferably represents —$NR^{18}SO_2$—, —$SO_2NR^{18}$— or —$SO_2NR^{18}CO$—. $R^{18}$ preferably represents a hydrogen atom.

B preferably represents a substituted or unsubstituted alkyl group containing carbon atoms whose total number is in the range of 1 to 70, or a substituted or unsubstituted aryl group containing carbon atoms whose total number is in the range of 6 to 70.

J preferably represents —COO—, —O—, —$CONR^{20}$—, —$NR^{20}CO$—, —$NR^{20}COO$—, —$NR^{20}NR^{21}$—, —$SO_2NR^{20}$— or —$CONR^{20}SO_2$—. Preferably, either of $R^{20}$ and $R^{21}$ represents a hydrogen atom. Preferred substitution position of the group (J—B) is the opposition to L.

G represents a substituent capable of substitution on a phenyl group. The substituent can be, for example, any of those mentioned above with respect to $R^1$ of the general formula (1). G preferably represents an alkyl group, a halogen atom or an alkoxy group. The substitution position of G is preferably the m-position to L, and the p-position to (J—B) when (J—B) is at the o-position to L.

In the structure of the general formula (4), preferably, $R^{11}$ represents an unsubstituted tertiary alkyl group (having 4 to 20 carbon atoms); $R^{12}$ represents an alkyl group (having 1 to 4 carbon atoms); $R^{13}$ represents a hydrogen atom or an alkyl group (having 1 to 4 carbon atoms); s is 1; m and n are simultaneously 0; L represents —$NHSO_2$—, —$SO_2NH$— or —$SO_2NHCO$—; J represents —$SO_2NH$—, —$CONHSO_2$— or —O—; B represents a substituted or unsubstituted alkyl group (having 1 to 30 carbon atoms), or a substituted or unsubstituted aryl group (having 6 to 30 carbon atoms); p is 1; G represents an unsubstituted tertiary alkyl group; and q is 1.

Specific examples of the compounds represented by the general formula (2) will be set out below, which however in no way limit the scope of the present invention.

II-1

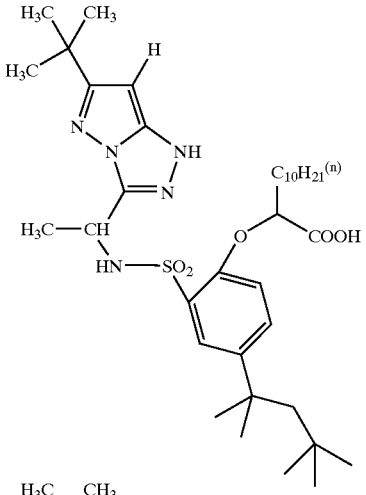

II-2

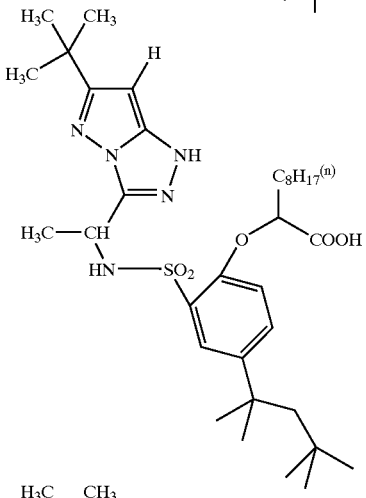

II-3

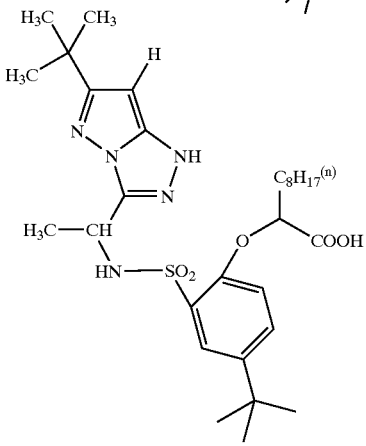

-continued

II-4

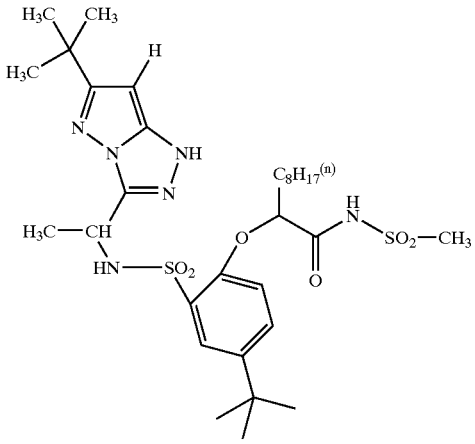

II-5

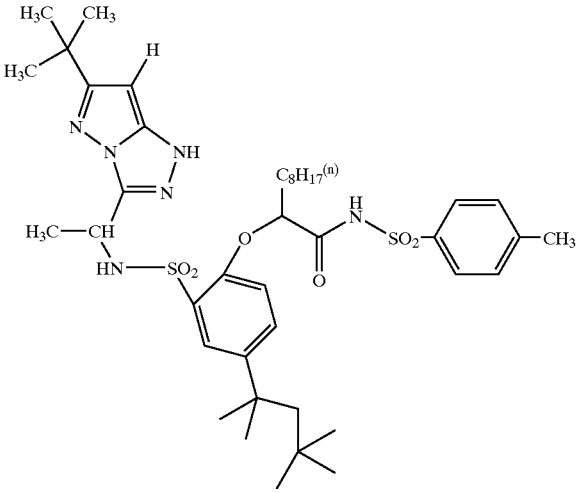

II-6

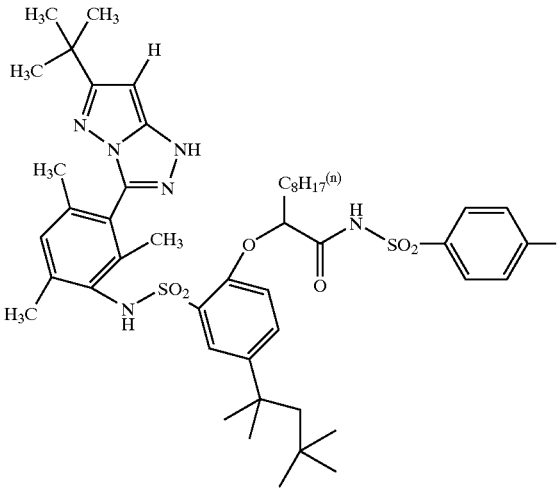

-continued
II-7
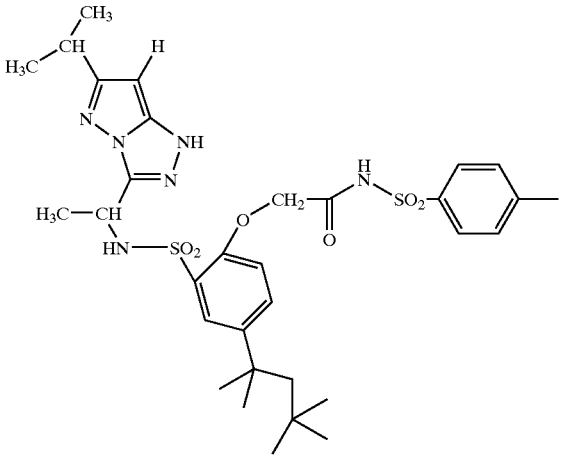
II-8
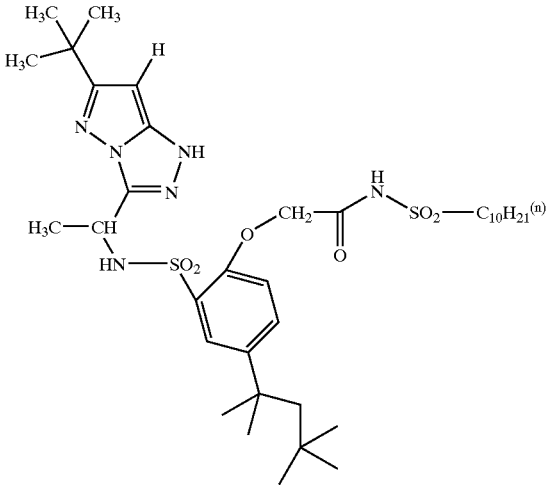
II-9
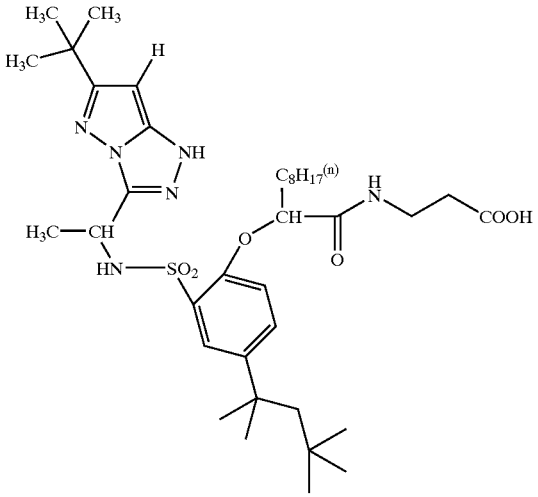
-continued
II-10
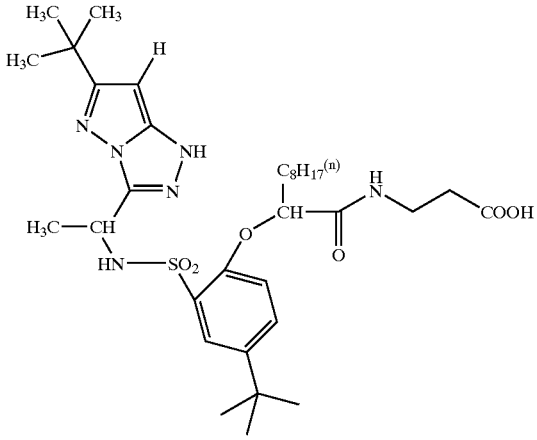
II-11
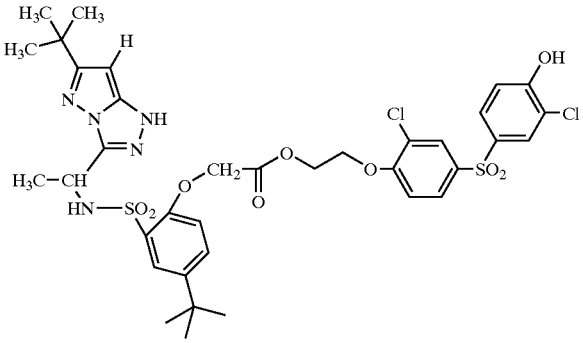
II-12
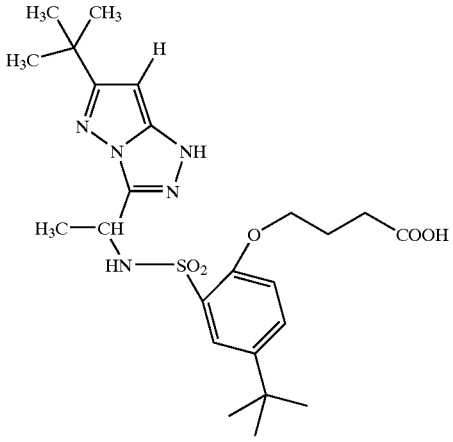

-continued
II-13
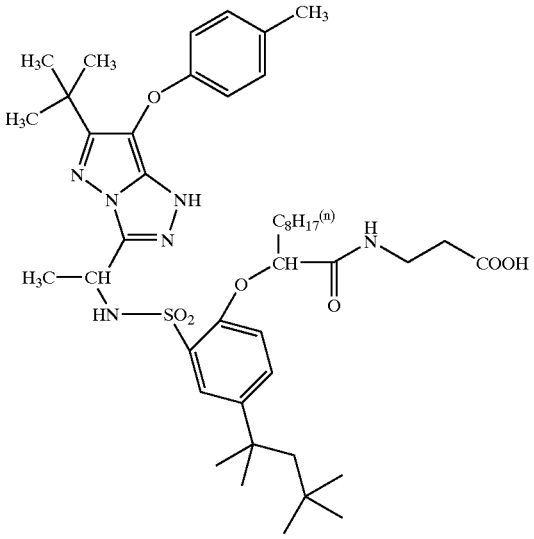
II-14
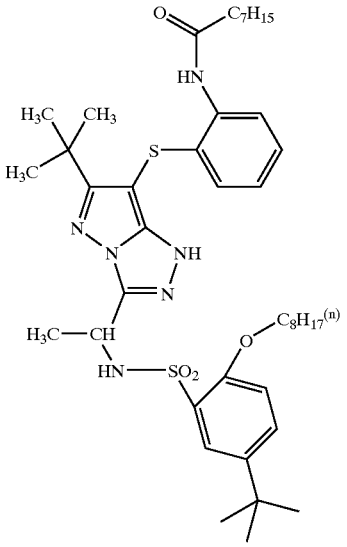
II-15
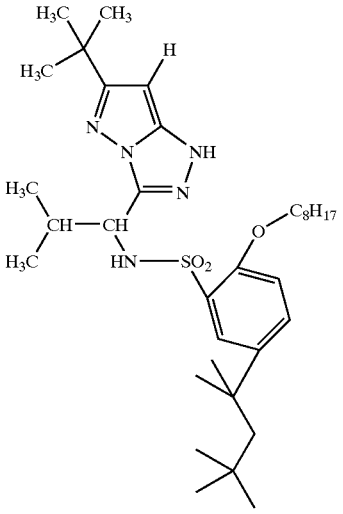
-continued
II-16
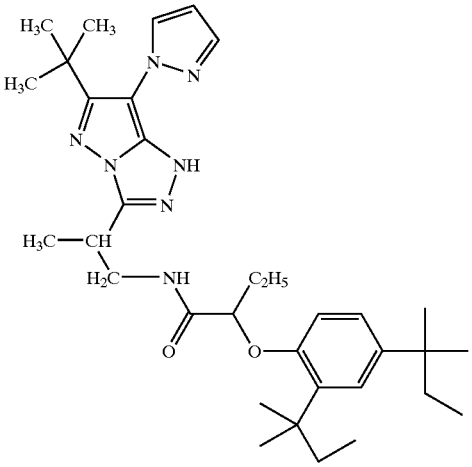
II-17
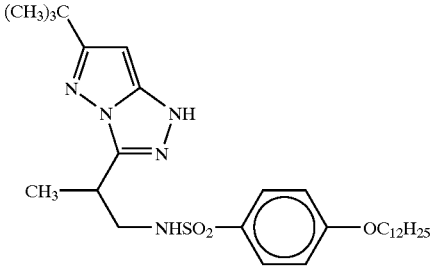
II-18
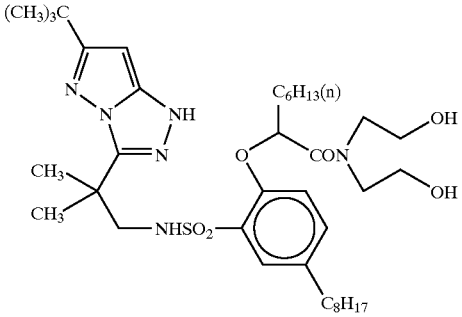
II-19
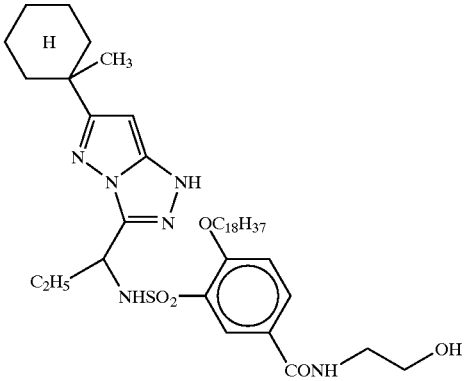

-continued
II-20
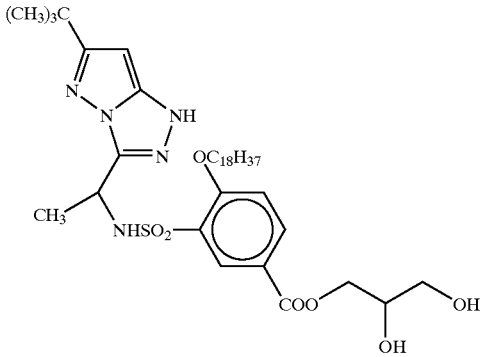
II-21
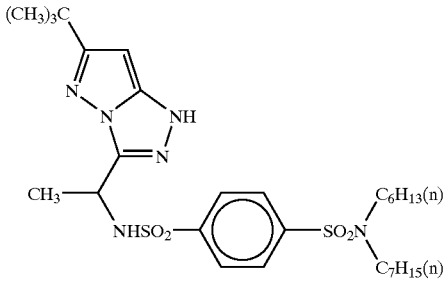
II-22
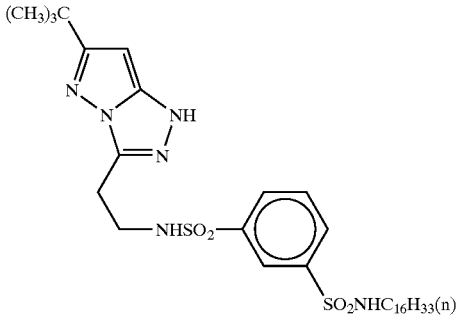
II-23
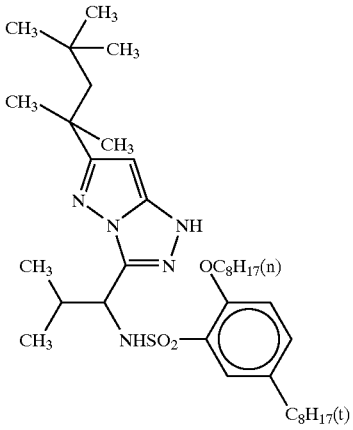
Hereinafter (t)$C_8H_{17}$— means
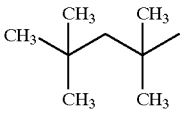
-continued
II-24
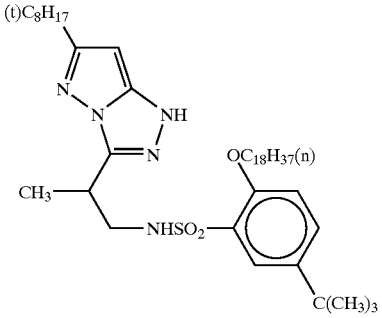
II-25
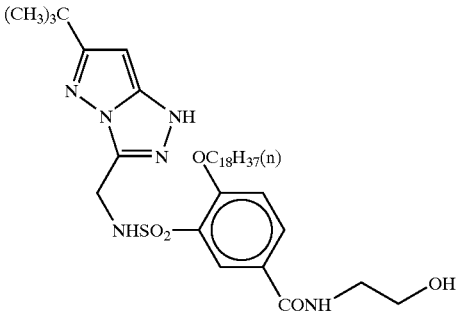
II-26
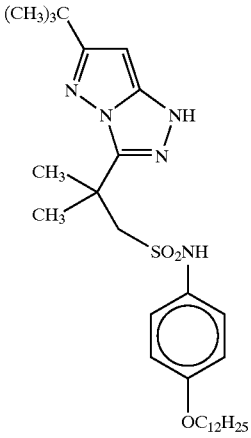
II-27
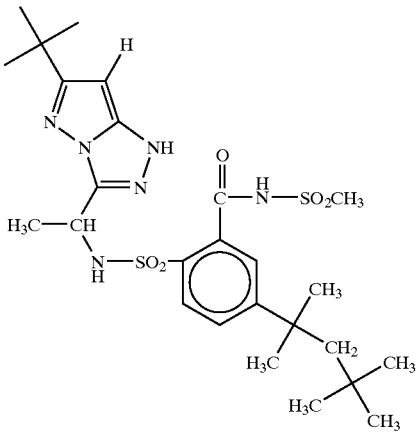

-continued

II-28

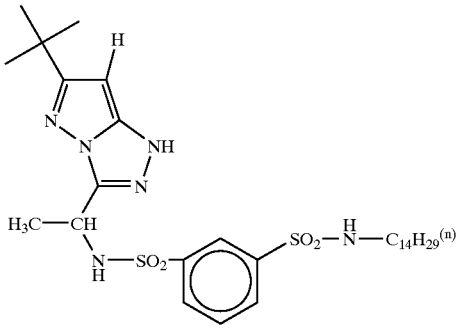

II-29

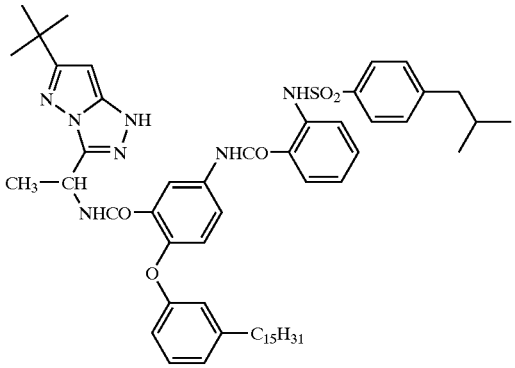

The couplers of the general formulae (1) and (2) according to the present invention can be synthesized by known methods. For example, the synthetic methods are as described in U.S. Pat. Nos. 4,540,654, 4,705,863 and 5,451,501, JP-A's 61-65245, 62-209457, 62-249155 and 63-41851, JP-B's 7-122744, 5-105682, 7-13309 and 7-82252, U.S. Pat. Nos. 3,725,067 and 4,777,121, and JP-A's 2-201442, 2-101077, 3-125143 and 4-242249.

The couplers of the general formulae (1) and (2) according to the present invention can be introduced in a lightsensitive material by the use of various known dispersing methods. Among these, an in-water oil droplet dispersing method, wherein the couplers are dissolved in a high-boiling organic solvent (mixed with a low-boiling solvent according to necessity), an emulsification dispersion thereof in an aqueous gelatin solution is carried out and the thus obtained dispersion is added to a silver halide emulsion, is preferred.

Examples of high-boiling solvents for use in the in-water oil droplet dispersing method are set forth in, for example, U.S. Pat. No. 2,322,027. With respect to a latex dispersing method as one of polymer dispersing methods, the process, effects and examples of impregnation latexes are described in, for example, U.S. Pat. No. 4,199,363, OLS's 2,541,274 and 2,541,230, JP-B-53-41091 and EP 029104. Further, dispersion by means of a polymer soluble in an organic solvent is described in WO 88/00723.

Examples of the high-boiling solvents which can be employed in the above in-water oil droplet dispersing method include phthalic acid esters (e.g., dibutyl phthalate, dioctyl phthalate, dicyclohexyl phthalate, di-2-ethylhexyl phthalate, decyl phthalate, bis(2,4-di-tert-amylphenyl) isophthalate and bis(1,1-diethylpropyl)phthalate), esters of phosphoric acid or phosphonic acid (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate and di-2-ethylhexyl phenyl phosphate), benzoic acid esters (e.g., 2-ethylhexyl benzoate, 2,4-dichlorobenzoate, dodecyl benzoate and 2-ethylhexyl p-hydroxybenzoate), amides (e.g., N,N-diethyldodecanamide and N,N-diethyllaurylamide), alcohols or phenols (e.g., isostearyl alcohol and 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate and trioctyl tosylate), aniline derivatives (e.g., N,N-dibutyl-2-butoxy-5-tert-octylaniline), chlorinated paraffins (paraffins of 10 to 80% chlorine content), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol and 4-(4-dodecyloxyphenylsulfonyl)phenol), carboxylic acids (e.g., 2-(2,4-di-tert-amylphenoxy)butyric acid and 2-ethoxyoctanedecanoic acid) and alkylphosphoric acids (e.g., di(2-ethylhexyl)phosphoric acid and diphenylphosphoric acid). Besides these high-boiling solvents, it is also preferred to use, for example, compounds of JP-A-6-258803, as high-boiling solvents.

Among these, phosphoric acid esters are preferred. It is also preferred to use alcohols or phenols in combination therewith.

In the present invention, the weight ratio of jointly used high-boiling organic solvent to couplers of the general formulae (1) and (2) is preferably in the range of 0 to 2.0, more preferably 0.01 to 1.0, and most preferably 0.01 to 0.5.

Further, as an auxiliary solvent, an organic solvent having a boiling point of 30 to about 160° C. (e.g., ethyl acetate, butyl acetate, ethyl propionate, methyl ethyl ketone, cyclohexanone, 2-ethoxyethyl acetate or dimethylformamide) may be used in combination therewith.

With respect to the content of couplers of the general formulae (1) and (2) according to the present invention in the lightsensitive material, the total content is preferably in the range of 0.01 to 10 g, more preferably 0.1 to 2 g, per $m^2$ of lightsensitive material. In a single lightsensitive emulsion layer, the coupler content is suitably in the range of $1\times10^{-3}$ to 1 mol, preferably $2\times10^{-3}$ to $3\times10^{-1}$ mol, per mol of silver halides.

When each lightsensitive layer has a unit constitution composed of a plurality of lightsensitive emulsion layers of different photographic speeds, a preferred constitution is such that the higher the photographic speed of layer, the greater the content of couplers of the present invention per mol of silver halides in the layer. In this arrangement as well, it is preferred that the total content of couplers be as mentioned above.

In the lightsensitive material of the present invention, both the coupler represented by the general formula (1) and the coupler represented by the general formula (2) are preferably contained in the same lightsensitive emulsion layer, more preferably in the same green-sensitive silver halide emulsion layer.

When both the coupler represented by the general formula (1) and the coupler represented by the general formula (2) according to the present invention are used, the coupler represented by the general formula (1) and the coupler represented by the general formula (2) are preferably contained in a molar ratio of 1:9 to 9;1, more preferably 1:9 to 7:3, and most preferably 2:8 to 5:5.

In a preferred mode of the present invention, magenta couplers represented by the general formulae (1) and (2) are contained. Further, although these can be used in combination with other magenta couplers, the higher the ratio of color forming dyes of couplers of the general formulae (1) and (2) according to the present invention in the contribution to magenta density total, the more preferable the obtained results. In particular, the couplers of the present invention represented by the general formulae (1) and (2) are preferably used in an amount, in terms of molar ratio based on the total amount of magenta couplers, of at least 50%, more preferably at least 70%.

Preferred examples of the image forming couplers for use in the lightsensitive material of the present invention include the following.

Yellow Couplers:

couplers represented by formulae (I) and (II) in EP No. 502,424A; couplers represented by formulae (1) and (2) in EP No. 513,496A (e.g., Y-28 on page 18); a coupler represented by formula (I) in claim 1 of EP No. 568,037A; a coupler represented by general formula (1) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (e.g., D-35); couplers represented by formula (Y) on page 4 in EP No. 447,969A1 (e.g., Y-1 and Y-54); couplers represented by formulae (II) to (IV) in column 7, lines 36 to 58, in U.S. Pat. No. 4,476,219;, etc.

Magenta Couplers:

couplers listed in JP-A-3-39737 (e.g., L-57, L-68 and L-77); couplers listed in EP No. 456,257A (e.g., A-4-63, A-4-73 and A-4-75); couplers listed in EP No. 486,965A (e.g., M-4, M-6 and M-7); couplers listed in EP No. 571,959A (e.g., M-45); couplers listed in JP-A-5-204106 (e.g, M-1); couplers listed in JP-A-4-362631 (e.g., M-22); couplers represented by general formula (MC-1) in JP-A-11-119393 (e.g., CA-4, CA-7, CA-12, CA-15, CA-16 and CA-18); etc.

Cyan Couplers:

couplers listed in JP-A-4-204843 (e.g., CX-1, 3, 4, 5, 11, 12, 14 and 15); couplers listed in JP-A-4-43345 (e.g., C-7, 10, 34, 35, (I-1) and (I-17)); couplers represented by general formulae (Ia) and (Ib) in claim 1 of JP-A-6-67385; couplers represented by general formula (PC-1) in JP-A-11-119393 (e.g., CB-1, CB-4, CB-5, CB-9, CB-34, CB-44, CB-49 and CB-51); couplers represented by general formula (NC-1) in JP-A-11-119393 (e.g., CC-1 and CC-17); etc.

These couplers can be introduced in the lightsensitive material by various known dispersing methods. The introduction can preferably be effected by the in-water oil droplet dispersing method wherein a coupler is dissolved in a high-boiling organic solvent (if necessary, in combination with a low-boiling solvent), emulsified in an aqueous solution of gelatin and added to a silver halide emulsion.

Examples of the high-boiling solvents for use in the in-water oil droplet dispersing method are listed in, for example, U.S. Pat. No. 2,322,027. With respect to a latex dispersing method as one of polymer dispersing methods, the process, effects and examples of immersion latexes are described in, for example, U.S. Pat. No. 4,199,363, OLS's 2,541,274 and 2,541,230, JP-3-53-41091 and EP 029104. Further, a dispersion by organic solvent soluble polymer is described in WO 88/00723.

Examples of the high-boiling solvents which can be employed in the above in-water oil droplet dispersing method include phthalic acid esters (e.g., dibutyl phthalate, dioctyl phthalate, dicyclohexyl phthalate, bis(2-ethylhexyl) phthalate, decyl phthalate, bis(2,4-di-tert-amylphenyl) isophthalate and bis(1,1-diethylpropyl)phthalate), esters of phosphoric acid or phosphonic acid (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridecyl phosphate and bis(2-ethylhexyl)phenyl phosphate), benzoic acid esters (e.g., 2-ethylhexyl benzoate, 2,4-dichlorobenzoate, dodecyl benzoate and 2-ethylhexyl p-hydroxybenzoate), amides (e.g., N,N-diethyldodecanamide, N,N-diethyllaurylamide and N,N,N,N-tetrakis(2-ethylhexyl)isophthalamide), alcohols or phenols (e.g., isostearyl alcohol and 2,4-di-tert-amylphenol), aliphatic esters (e.g., dibutoxyethyl succinate, bis(2-ethylhexyl)succinate, 2-hexyldecyl tetradecanoate, tributyl citrate, diethyl azelate, isostearyl lactate and trioctyl citrate), aniline derivatives (e.g., N,N-dibutyl-2-butoxy-5-tert-octylaniline), chlorinated paraffins (paraffins of 10 to 80% chlorine content), trimresic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol and 4-(4-dodecyloxyphenylsulfonyl)phenol), carboxylic acids (e.g., 2-(2,4-di-tert-amylphenoxy)butyric acid and 2-ethoxyoctanedecanoic acid) and alkylphosphoric acids (e.g., bis(2-ethylhexyl)phosphoric acid and diphenylphosphoric acid). Besides these high-boiling solvents, it is also preferred to use, for example, compounds of JP-A-6-258803 as high-boiling solvents.

With respect to the amount of high-boiling organic solvent used in combination with the couplers, the weight ratio thereof to coupler is preferably in the range of 0 to 2.0, more preferably 0 to 1.0, and most preferably 0 to 0.4.

Further, as an auxiliary solvent, an organic solvent having a boiling point of 30 to about 160° C. (e.g., ethyl acetate, butyl acetate, ethyl propionate, methyl ethyl ketone, cyclohexanone, 2-ethoxyethyl acetate or dimethylformamide) may be used in combination therewith.

With respect to the coupler content of the lightsensitive material, the total weight of yellow coupler, magenta coupler and cyan coupler is preferably in the range of 0.01 to 10 g, more preferably 0.1 to 2 g, per $m^2$ of lightsensitive material. In a single lightsensitive emulsion layer, the coupler content is suitably in the range of $1\times10^{-3}$ to 1 mol, preferably $2\times10^{-3}$ to $3\times10^{-1}$ mol, per mol of silver halides.

When each lightsensitive layer has a unit constitution composed of a plurality of lightsensitive emulsion layers of different photographic speeds, a preferred constitution is such that the higher the photographic speed of layer, the greater the content of couplers of the present invention per mol of silver halides in the layer.

The lightsensitive material of the present invention may further be loaded with a competing compound (compound which reacts with color developing agent oxidation products while competing with image forming couplers but does not form any dye images). As the competing compound, there can be mentioned, for example, a reducing compound selected from among hydroquinones, catechols, hydrazines, sulfonamidophenols, etc. or a compound which couples with color developing agent oxidation products but substantially does not form color images (e.g., any of colorless compound forming couplers as disclosed in DE 1,155,675, GB 861,138 and U.S. Pat. Nos. 3,876,428 and 3,912,513 or any of couplers forming dyes which outflow during processing, as disclosed in JP-A-6-83002).

In the lightsensitive material of the present invention, a non-color-forming interlayer may be incorporated in a lightsensitive unit of single color sensitivity. Further, a compound which can be selected as the above competing compound is preferably contained in the interlayer.

For preventing the deterioration of photographic performance by formaldehyde gas, it is preferred that the light-sensitive material of the present invention be loaded with a compound capable of reacting with formaldehyde gas to thereby immobilize it as described in U.S. Pat. Nos. 4,411,987 and 4,435,503.

The emulsions for use in the silver halide photographic lightsensitive material of the present invention preferably contain tabular silver halide grains having an aspect ratio of 1.5 to less than 100. Herein, the tabular silver halide grains generally refer to silver halide grains having one twin plane or two or more parallel twin planes The twin plane refers to a (111) face on both sides of which the ions of all lattice points are in the relationship of reflected images. These tabular grains are each composed of two main surfaces which are parallel to each other and side surfaces joining the main surfaces to each other. The main surfaces of tabular grains, as viewed from above, have triangular or hexagonal shapes, or circular shapes corresponding to rounding thereof. The triangular, hexagonal and circular tabular grains respectively have triangular, hexagonal and circular main surfaces arranged parallel to each other.

The aspect ratio of tabular grains refers to the quotient of grain diameter divided by grain thickness. The grain thickness can be easily determined by performing a vapor deposition of metal on grains, together with reference latex, in an oblique direction thereof, measuring the length of grain shadow on an electron micrograph and calculating with reference to the length of latex shadow.

In the present invention, the grain diameter refers to the diameter or a circle having the same area as the projected area of mutually parallel main surfaces of grain.

The projected area of grains can be obtained by measuring the grain area on an electron micrograph and effecting a magnification correction thereto.

The diameter of tabular grains is preferably in the range of 0.3 to 5.0 $\mu$m. The thickness of tabular grains is preferably in the range of 0.05 to 0.5 $\mu$m.

The sum of respective projected areas of tabular grains for use in the present invention preferably occupies 50% or more, more preferably 80% or more, of the sum of respective projected areas of all the silver halide grains contained in the emulsion. The aspect ratio of these tabular grains occupying the given area is preferably in the range of 1.5 to less than 100, more preferably 2 to less than 20, and most preferably 2 to less than 8.

More preferred results may be attained by the use of monodisperse tabular grains. The structure of monodisperse tabular grains and the process for producing the same are as described in, for example, JP-A-63-151618. A brief description of the configuration thereof is as follows. 70% or more of the total projected area of silver halide grains is occupied by tabular silver halide grains which are shaped like a hexagon having a ratio of the length of the side with the largest length to the length of the side with the smallest length of 2 or less on main surfaces and which have two mutually parallel planes as external surfaces. Moreover, the grain size distribution of hexagonal tabular silver halide grains is so monodispersed as to exhibit a variation coefficient (quotient of variation (standard deviation) of grain size expressed by the equivalent-circle diameter of projected area thereof divided by an average grain size, the quotient multiplied by 100) of 20% or less.

Tabular grains used in the present invention preferably have dislocation lines.

Dislocation lines in tabular grains can be observed by a direct method performed using a transmission electron microscope at a low temperature, as described in, e.g., J. F. Hamilton, Phot. Sci. Tech. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions of dislocations in each grain viewed in a direction perpendicular to the principal planes of the grain.

The dislocations of the tabular grains for use in the present invention are positioned in the zone extending to each side from a distance of x% of the length from the center to the side along the direction of the major axis of the tabular grains. This x preferably satisfies the relationship $10 \leqq x < 100$, more preferably $30 \leqq x < 98$, and most preferably $50 \leqq x < 95$. The configuration created by tying positions at which the dislocations start is approximately similar to the grain form but is not a completely similar form and may be slightly twisted. The direction of dislocation lines approximately agrees with the direction from the center to each side but is often zigzagged.

With respect to the number of dislocations of the tabular grains for use in the present invention, preferably, grains having 10 or more dislocations occupy 50% or more of the total number of grains. More preferably, grains having 10 or more dislocations occupy 80% or more of the total number of grains. Most preferably, grains having 20 or more dislocations occupy 80% or more of the total number of grains.

The synthetic methods of tabular grains used in the present invention will be described below.

For example, tabular grains used in the present invention can be prepared by methods described in Cleave, "Photography Theory and Practice (1930), p. 13"; Gutoff, "Photographic Science and Engineering, Vol. 14, pp. 248–257 (1970)"; U.S. Pat. Nos. 4,434,226, 4,414,310, 4,433,048 and 4,439,520 and GB No. 2,112,157 and the like.

Silver halide tabular grains of any of silver bromide, silver iodobromide, silver iodochlorobromide and silver chlorobromide compositions may be used in the silver halide emulsions for use in the present invention. Preferred composition of silver halide grains is a silver iodobromide or silver iodochlorobromide containing 30 mol % or less of silver iodide.

In the silver halide emulsions for use in the present invention, the intragranular halogen composition may have a multiple structure. For example, it may have a quintuple structure. Herein, the terminology "structure" refers to a structure of silver iodide distribution, and means that between structures, there is a silver iodide content difference of 2 mol % or more.

The structures concerning the distribution of silver iodide can be basically determined by calculation from the prescription value of preparation process of grains. There can be a case of abrupt variation and a case of mild variation in the variation of the silver iodide content in the interface between the respective structures. It is required to consider the measurement accuracy on analysis in order to confirm these, but the EPMA method (Electron Probe Micro Analyzer method) is usually effective. The elemental analysis of a very fine region to which electron beam was irradiated can be carried out by preparing a sample in which emulsion grains are dispersed so as not to be mutually brought in contact and analyzing X-ray irradiated when electron beam was irradiated thereto. It is preferable to carry out the measurement at this time by cooling at a low temperature in order to prevent the damage of a sample caused by electron beam. The distribution of silver iodide in grains when the tabular grains are viewed front a direction perpendicular to the principal surfaces can be analyzed by the same procedure, but the distribution of silver iodide in grains at the section of the tabular grains can be also analyzed by solidifying the same sample and using samples cut into ultra thin fragments by a microtome.

In the nuclei formation step, it is remarkably effective for the nucleation step of the core of the tabular grains used in the present invention, to use gelatin having small methionine content described in U.S. Pat. Nos. 4,713,320 and 4,942,120, to carry out the nucleation at high pBr described in U.S. Pat. No. 4,914,014, and to carry out the nucleation for a short time described in JP-A-2-222940. It happens to be effective for the ripening step of the core tabular grain emulsion of the present invention, to carry out the ripening step in the presence or a low concentration base described in U.S. Pat. No. 5,254,453 and to carry out it at high pH described in U.S. Pat. No. 5,013,641.

The formation method of tabular grains using a polyalkylene oxide compound described in U.S. Pat. Nos. 5,147,771, 5,147,772, 5,147,773, 5,171,659, 5,210,013 and 5,252,453 is preferably used for preparation of the core grains used in the present invention.

There is a case of additionally adding gelatin during grain formation in order to obtain the tabular grains having a large aspect ratio and monodispersity. The gelatin used at this time is preferably chemically-modified gelatin described in JP-A's-10-148897 and 11-143002 or gelatin having small methionine content described in U.S. Pat. Nos. 4,713,320 and 4,942,120. In particular, the former chemically-modified gelatin is gelatin characterized in newly introducing at least 2 carboxyl groups when amino groups in the gelatin are chemically modified, and succinate gelatin or trimellitate gelatin is preferably used. It is preferable to add said chemically-modified gelatin before the growth step, and more preferable to add it just after the nucleation. The addition amount is preferably 50% or ntore, more preferably 70%, based on the mass of the total dispersing medium during grain formation.

As the silver halide solvent which can be used in the present invention, (a) organic thioethers described in U.S. Pat. Nos. 3,271,157, 3,531,286 and 3,574,628, JP-A's-54-1019 and 54-158917, and the like, (b) thiourea derivatives described in JP-A's-53-82408, 55-77737 and 55-2982, and the like, (c) silver halide solvents having a thiocarbonyl group sandwiched between an oxygen or sulfur atom and a nitrogen atom described in JP-A-53-144319, (d) imidazoles described in JP-A-54-100717, (e) sulfites, (f) ammonia, (g) thiocyanates and the like are mentioned.

Especially preferred solvents are thiocyanates, ammonia, tetramethylthiourea and the like. Further, although the amount of the silver halide solvent used differs depending on the type thereof, for example, in case of thiocyanate, the preferred amount used is $1\times10^{-4}$ mol or more and $1\times10^{-2}$ mol or less per mol of silver halides.

Even in case of using any of solvents, the solvent can be basically removed by providing a washing step after formation of the first shell as fore-mentioned.

The dislocations of tabular grains for use in the present invention are introduced by forming a high iodide phase in the internal portion of grains.

The high iodide phase refers to a silver halide solid solution containing silver iodide. As the silver halide for use therein, silver iodide, silver iodobromide or silver chloroiodobromide is preferred. Silver iodide or silver iodobromide is more preferred, and silver iodide is most preferred.

The amount, in terms of silver quantity, of silver halides forming the high iodide phase is 30 mol % or less, preferably 10 mol % or less, based on the total silver quantity of grains.

It is requisite that the silver iodide content of a phase grown outside the high iodide phase be lower than that of the high iodide phase. The silver iodide content of outside phase is preferably in the range of 0 to 12 mol %, more preferably 0 to 6 mol %, and most preferably 0 to 3 mol %.

A preferred method of forming the high iodide phase comprises adding an emulsion containing silver iodobromide or silver iodide fine grains (hereinafter also referred to as "silver iodide fine grain emulsion"). As these fine grains, those prepared in advance can be used. Preferably, use can be made of fine grains immediately after preparation.

Firstly, a case of using fine grains preliminarily prepared is illustrated. In this case, there is a method of adding fine grains preliminarily prepared, ripening and dissolving. As the more preferable method, there is a method of adding a silver iodide fine grain emulsion, and then adding aqueous an aqueous silver nitrate solution, or an aqueous silver nitrate solution and an aqueous halogen solution. In this case, the dissolution of the fine grains included in the silver iodide fine grain emulsion is accelerated by the addition of the aqueous silver nitrate solution. It is preferable to abruptly add the silver iodide fine grain emulsion.

The abrupt addition of the silver iodide fine grain emulsion means that the silver iodide fine grain emulsion is preferably added within 10 minutes. More preferably, it means the addition within 7 minutes. The condition can be varied depending on the temperature, pBr and pH of the system added, the kind and concentration of protective colloid agents such as gelatin and the like, the presence and absence, kind and concentration of the silver halide solvent and the like, but the shorter the more preferable as described above. At addition, it is preferable that the addition of an aqueous silver salt solution such as silver nitrate and the like is not substantially carried out. It is preferable that the temperature of the system at addition is 40° C. or more and 90° C. or less, and 50° C. or more and 80° C. or less is preferable in particular.

The fine grains included in the silver iodide fine grain emulsion may be substantially silver iodide, and silver bromide and/or silver chloride may be contained so far as it becomes a mixed crystal. 100% Silver iodide is preferable. Silver iodide can be β form, γ form, and α form or a structure similar to the α-from as described in U.S. Pat. No. 4,672,026. In the present invention, the crystalline structure is not specifically limited, but a mixture of β form and γ form and further preferably β form are used. The silver iodide fine grain emulsion treated with a usual washing step is preferably used. The silver iodide fine grain emulsion can be easily prepared by methods as described in U.S. Pat. No. 4,672,026 and the like. The method of adding an aqueous solution of silver salt and an aqueous solution of silver iodide by the double jet process, wherein the grain formation is carried out at a fixed pI value, is preferred. The terminology "pI" is the logarithm of inverse of $I^-$ ion concentration of the system. Although there is no particular limitation with respect to the temperature, pI, pH, the kind and concentration of protective colloid agents such as gelatin and the like, the presence and absence, kind and concentration of the silver halide solvent and the like, but it is advantageous in the present invention that the grain size is 0.1 μm or less, and more preferably 0.07 μm or less. Although the grain configuration cannot be fully specified because of the fine grains, it is preferred that the variation coefficient of the grain size distribution is 25% or less. When it is 20% or less in particular, the effect of the present invention is striking, The size and size distribution of silver iodide fine grain emulsion are determined by placing the fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of the origin. With respect to the size distribution as well, it is determined by the use of the above diameter of a circle having the saute projected area. In the present invention, the most effective silver iodide fine grains have a grain size of 0.02 μm or more and 0.06 μm or less and exhibit a variation coefficient of grain size distribution of 18% or less.

In the formation method of silver iodide fine grain emulsion, after the above-mentioned grain formation, the silver iodide fine grain emulsion is preferably subjected to the usual washing described in U.S. Pat. No. 2,614,929 and the like, and the regulation of pH, pI, the concentration of protective colloid agents such as gelatin and the like, and the concentration of silver iodide contained is carried out. It is preferably that pH is 5 or more and 7 or less. The pI value is preferably set at one minimizing the solubility of silver iodide or one higher than the same. Common gelatin having a weight-average molecular weight of about 100 thousand is preferably used as the protective colloid agent. Also, low-molecular-weight gelatin having a weight-average molecular weight of about 20 thousand or less is preferably used. Further, there are occasions in which the use of a mixture of such gelatins having different weight-average molecular weights is advantageous. The gelatin amount per kg of the emulsion is preferably 10 g or more and 100 g or less, and more preferably 20 g or more and 80 g or less. The silver quantity based on Ag atom per kg of the emulsion is preferably 10 g or more and 100 g or less, and Store preferably 20 g or more and 80 g or less. As the gelatin amount and/or silver quantity, a value suitable for abruptly adding the silver iodide fine grain emulsion is preferably selected.

Although the silver iodide fine grain emulsion is generally dissolved prior to the addition, it is requisite that the agitating efficiency of the system is satisfactorily high at the time of addition. The agitation rotating speed is preferably set higher than usual. The addition of an antifoaming agent is effective for preventing the generation of foaming during the agitation. Specifically, antifoaming agents described in the:embodiments of U.S. Pat. No. 5,275,929 and the like are used.

In a case of using fine grains just after preparation is illustrated. The detail of a mixer for forming the silver halide fine grains can be referred to the description of JP-A-10-43570.

It is preferable that the silver halide grains of the present invention have a variation coefficient of the silver iodide content distribution among grains of 20% or less. It is more preferably 15% or less, and particularly preferably 10% or less. When the fore-mentioned variation coefficient is larger than 20%, it is not contrasty, and it is not preferable because the sensitivity at pressuring is greatly decreased. The silver iodide content of individual grain can be measured by analyzing the composition of grains one by one using an X-ray micro analyzer. The variation coefficient of the silver iodide content distribution among grains is a value defined by a relation equation, (standard deviation/average silver iodide content)×100=variation coefficient, using the standard deviation of silver iodide content and average silver iodide content when the silver iodide content of emulsion grains of at least 100, more preferably 200 or more, and particularly preferably 300 or more was measured. The measurement of the silver iodide content of each individual grains is described in, for example, EU Patent No. 147,868. There are a case of having correlation and a case of having no correlation between the silver iodide content Yi (mol %) of each individual grains and the equivalent-circle diameter Xi (μm), but it is desirable that there is no correlation.

The silver halide emulsion of the present invention is preferably provided a positive hole-capturing zone in at least one portion of the inside of the silver halide grains, The positive hole-capturing zone in the present invention represents a region which has a function of capturing so-called positive holes, for example, positive holes generated in pair with photoelectrons generated by photo-excitation. Such hole-capturing zone is defined in the present invention as a zone provided by an intentional reduction sensitization.

The intentional reduction sensitization in the present invention means an operation of introducing a positive hole-capturing silver nuclei into a portion or the whole in the silver halide grains. The positive hole-capturing silver nuclei means a small silver nuclei having little developing activity, and recombination loss at an exposing process can be prevented and sensitivity can be enhanced by the silver nuclei.

As the reduction sensitizers, stannous chloride, ascorbic acid and its derivatives, amines and polyamines, hydrazine derivatives, formamidinesulfinic acid, a silane compound, a borane compound and the like are known. In the reduction sensitization of the present invention, it is possible to selectively use these known reduction sensitizers, or to use two or more types of compounds together. Preferable compounds as the reduction sensitizers are stannous chloride, thiourea dioxide, dimethylamino borane, and ascorbic acid and its derivatives. Although the addition amount of the reduction sensitizers must be so selected as to meet the emulsion manufacturing conditions, a proper amount is $10^{-7}$ to $10^{-3}$ mol per mol of a silver halide.

The reduction sensitizer is added during grain formation by dissolving thereof to water or solvents such as alcohols, glycols, ketones, esters and amines.

In the present invention, the positive hole-capturing silver nuclei is preferably formed by adding the reduction sensitizer after nucleation and termination of physical ripening and just before grain formation. However, the positive hole-capturing silver nuclei can be introduced on the grain surface by adding the reduction sensitizer after termination of grain formation.

When the reduction sensitizer is added during grain formation, a portion of nuclei formed can remain in the inside of the grain, but nuclei are also formed on grain surface because the portion percolates. The percolated nuclei may be utilized as the positive hole-capturing silver nuclei in the present invention.

In the present invention, it is preferable that the intentional reduction sensitization for forming the positive hole-capturing silver nuclei into the silver halide grains at a step on a way to grain formation is carried out in the presence of the compound of general formula (A) or general formula (B).

Herein, a step after carrying out the final desalting is not included in the step on a way to grain formation. For example, a step in which the silver halide grains grow as a result by adding an aqueous silver salt solution, silver halide fine grains and the like at the step of chemical sensitization and the like, is excluded.

Formula (A)

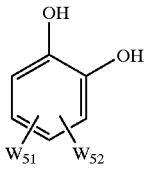

Formula (B)

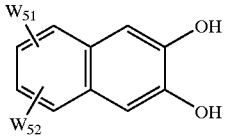

In general formulae (A) and (B), $W_{51}$ and $W_{52}$ represent a sulfo group or a hydrogen atom, with the proviso that at least one of $W_{51}$ and $W_{52}$ represents a sulfo group. The sulfo group is a water-soluble salt such as an alkali metal salt such as sodium, potassium or the like, an ammonium salt or the like. As preferable compounds, specifically, 3,5-disulfocathecoldisodium salt, 4-sulfocathecolammonium salt, 2,3-dihydroxy-7-sulfonaphthalenesodium salt, 2,3-dihydroxy-6,7-disulfonaphthalenepotassium salt and the like are mentioned. The preferable addition amount can be varied depending on the temperature of the system added, pBr and pH, the kind and concentration of protective colloid agents such as gelatin and the like, the presence and absence, kind and concentration of the silver halide solvent and the like, but in general, 0.0005 mol to 0.5 mol, and more preferably 0.003 mol to 0.02 mol, per mol of silver halide, is used.

It is preferable to use an oxidizer for silver during the process of manufacturing emulsions of the present invention. Herein, the oxidizer for silver means a compound having an effect of converting metal silver into silver ion. A particularly effective compound is the one that converts very fine silver grains, as a by-product in the process of formation of silver halide grains and chemical sensitization, into silver ion. The silver ion prepared herein may form a silver salt hard to be dissolved in water, such as a silver halide, silver sulfide, or silver selenide, or a silver salt easy to be dissolved in water, such as silver nitrate. The oxidizer for silver may be an inorganic or organic substance. Examples of the inorganic oxidizer include ozone, hydrogen peroxide and its adducts (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), a peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), a permanganate (e.g., $KMnO_4$), an oxyacid salt such as a chromate (e.g., $K_2Cr_2O_7$), a halogen element such as iodine and bromine, a perhalogenate (e.g., potassium periodate), a salt of a high-valence metal (e.g., potassium hexacyanoferrate (II)), and a thiosulfonate etc.

Further, examples of the organic oxidizer include quinones such as p-quinone, organic peroxides such as peracetic acid, perbenzoic acid and the like, and compounds of releasing active halogen (e.g., N-bromosuccinimide, chloramine T, and chloramine B).

Preferable oxidizers of the present invention include ozone, hydrogen peroxide and its adduct, a halogen element, and thiosulfonate as inorganic oxidizers; and quinones as organic oxidizers. Thiosulfonate described in JP-A-2-191938 and the like preferable in particular.

The addition timing of the oxidizers to the above-mentioned silver may be possible at any time before starting the intentional reduction sensitization, during the intentional reduction sensitization, and just before or just after completion of the reduction sensitization, and they may be separately added at several times. The addition amount is different depending on the type of the oxidizers, and the addition amount of $1\times10^{-7}$ to $1\times10^{31\ 3}$ mol per mol of silver halide is preferable.

It is advantageous to use gelatin as the protective colloid used for preparing the emulsion of the present invention, and as the binder of other hydrophilic colloid layer. However, hydrophilic colloids other than that can be also used.

For example, a gelatin derivative, a graft polymer of gelatin with other polymer; proteins such as albumin, casein, and the like; cellulose derivatives such as hydroxyethyl cellulose, carboxymethyl cellulose, cellulose sulfates and the like; glucose derivatives such as sodium alginate, dextrin derivatives and the like; and many synthetic hydrophilic polymer substances such as homopolymers and copolymers such as a poly(vinyl alcohol), a partially-acetal of poly(vinyl alcohol), a poly(N-vinyl pyrrolidone), a poly(acrylic acid), a poly(methacrylic acid), a poly(acryl amide), a polyimidazole, a poly(vinyl pyrazole) and the like can be used.

As the gelatin, an acid-processed gelatin, and an enzyme-processed gelatin described in Bull. Soc. Sci, Photo. Japan, No, 16, P.30 (1966) in addition to lime-processed gelatin may be used, and the hydrolyzed product and enzyme-decomposed product of gelatin can be also used.

It is preferable that the emulsion of the present invention is washed with water for desalting, and converted to a protective colloid dispersion solution using a newly prepared dispersion. The temperature of washing can be selected in accordance with purposes, and a range of 5° C. to 50° C. is preferably selected. The pH at washing can be selected in accordance with purposes, and a range of 2 to 10 is preferably selected. A range of 3 to 8 is more preferable. The pAg at washing can be selected in accordance with purposes, and a range of 5 to 10 is preferably selected. The method of washing can be used by selecting from a noodle washing method, a dialysis method using a semi-permeable membrane, a centrifugal separation method, a coagulation sedimentation method, and an ion-exchange method. The coagulation sedimentation method can be selected from a method of using a sulfate, a method of using an organic solvent, a method of using a water-soluble polymer, a method of using a gelatin derivative and the like.

In the preparation (e.g., grain formation, desalting step, chemical sensitization, and before coating) of the emulsion of the present invention, it is preferable to make a salt of metal ion exist in accordance with purposes. The metal ion salt is preferably added during grain formation when doped into grains, and after grain formation and before completion of chemical sensitization when used to decorate the grain surface or used as a chemical sensitizer. In addition to a method of doping the salt to all the grains, a method of doping to only the core or the shell of a grain can be selected. As examples of the dopant, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. Those metals can be added as long as they are in the form of salt that can be dissolved during grain formation, such as an ammonium salt, an acetate, a nitrate, a sulfate, a phosphate, a hydroxide, a 6-coordinated complex salt, or a 4-coordinated complex salt. For example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$ are mentioned. The ligand of a coordination compound can be selected from halo, aquo, cyano, cyanate, thiocyanate, nitrosyl, thionitrosyl, oxo and carbonyl. These metal can be used either singly or in the form of a combination of two or more types of them.

The metal compounds are preferably dissolved in an appropriate solvent such as water, methanol, acetone and added in a form of a solution. In order to stabilize the solution, a method of adding an aqueous hydrogen halogenide (e.g., HCl and HBr) or an alkali halide (e.g., KCl, KBr and NaBr) can be used. Further, it is also possible to add an acid or alkali, if necessary The metal compounds may be added to a reaction vessel before or during grain formation. Alternatively, the metal compounds may be added to a water-soluble silver salt (e.g., $AgNO_3$) or an aqueous alkali halide solution (e.g., NaCl, KBr and KI) and added in the from of a solution continuously during formation of silver halide grains. Furthermore, a solution of the metal compounds can be prepared independently of a water-soluble salt or an alkali halide and added continuously at a proper timing during grain formation. It is also preferable to further combine many addition methods.

It is sometimes useful to perform a method of adding a chalcogen compound during preparation of an emulsion described in U.S. Pat. No. 3,772,031. In addition to S, Se and Te, a cyanate, a thiocyanate, a selenocyanate, a carbonate, a phosphate, and an acetate may be present.

In case of the silver halide grains used in the present invention, at least one of chalcogen sensitizations such as sulfur sensitization, selenium sensitization and the like; noble metal sensitizations such as gold sensitization, palladium sensitization, and the like; and the reduction sensitization can be carried out in an arbitrary step of the production steps of the silver halide photographic emulsion. It is preferable to combine 2 or more of sensitization methods.

Various type emulsions can be prepared depending on decision at what steps chemical sensitization is carried out. There is a type of burying chemical sensitization nuclei in the inside of grains, a type of burying them at a shallow position from the grain surface, or a type of making the chemical sensitization nuclei on surface. The position of the chemical sensitization nuclei can be selected in accordance with purposes for the emulsion of the present invention.

With respect to the emulsions for use in the present invention, although the grain surface thereof or a site positioned at an arbitrary distance from the surface may be chemically sensitized, it is preferred to effect a chemical sensitization of the grain surface thereof. When it is intended to carry out a chemical sensitization of an internal part, reference can be made to methods described in JP-A-63-264740.

One of the chemical sensitizations which can be preferably carried out in the present invention is single or a combination of chalcogen sensitization and noble metal sensitization, and can be carried out using active gelatin as described in T. H. James, "The Theory of the Photographic Process, $4^{th}$ edition, (1977), pp. 67–76", published by Macmillan. Further, as described in "Research Disclosure Vol. 120 (April 1974), p. 12008"; "Research Disclosure Vol. 34 (June 1975), p. 13452", U.S. Pat. Nos. 2,642,361, 3,297,446, 3,772,031, 3,857,711, 3,901,714, 4,266,018, 3,904,415, and BG Patent No. 1,315,755, the chemical sensitization can be carried out using sulfur, selenium, tellurium, gold, platinum, palladium, iridium or the combination of a plural number of these sensitizers at a pAg of 5 to 10, a pH of 5 to 8 and a temperature of 30 to 80° C.

Noble metal salts such as gold, platinum, palladium, iridium and the like can be used in the noble metal sensitization, and among these, particularly, gold sensitization, palladium sensitization and a combination of both are preferable. In case of the gold sensitization, known compounds such as chloroauric acid, potassium chloroaurate, potassium chloroauric thiocyanate, gold sulfide, gold selenide and the like; mesoionic gold compound described in U.S. Pat. No. 5,220,030; and azole gold compound described in U.S. Pat. No. 5,049,484, the disclosures of which are incorporated by reference, can be used. The palladium compound means divalent salt of palladium or tetra-valent salt of palladium. The preferable palladium compound is represented by $R_2PdX_6$, and $R_2PdX_4$. Wherein R represents a hydrogen atom, an alkali atom, or an ammonium group. X represents a halogen atom, and represents a chlorine atom, a bromine atom or an iodine atom. Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferable. The gold compound and the palladium compound are preferably used in combination with a thiocyanate or a selenocyanate.

The preferable amount of the gold sensitizer used in the present invention is $1\times10^{-4}$ to $1\times10^{-7}$ mol per mol of silver halide, and more preferably $1\times10^{-5}$ to $5\times10^{-7}$ mol. The preferable range of the palladium compound is $1\times10^{-3}$ to $5\times10^{-7}$ mol. The preferable range of the thiocyan compound or a selenocyan compound is $5\times10^{-2}$ to $1\times10^{-6}$ mol.

As sulfur sensitizers, hypo, a thiourea-based compound, a rhodanine-based compound, and a sulfur-containing compound described in U.S. Pat. Nos. 3,657,711, 4,266,018, and 4,054,457 can be used. Chemical sensitization can be also carried out in the presence of a so-called chemical sensitization aid. As the chemical sensitization aid, compounds such as azaindene, azapyridazine, azapyrimidine and the like which are known as those suppressing the fogging in the process of the chemical sensitization and increasing sensitivity, are used. Examples of the chemical sensitization aid modifier are described in U.S. Pat. Nos. 2,131,038, 3,411,914 and 3,554,757, JP-A-58-126526, and Daffine, "Photographic Emulsion Chemistry pp. 138–143".

The preferable amount of the sulfur sensitizer used in the present invention is $1\times10^{-4}$ to $1\times10^{-7}$ $^{mol}$ per mol of silver halide, and more preferably $1\times10^{-5}$ to $5\times10^{-7}$ mol.

There is the selenium sensitization as the preferable method for the emulsion of the present invention. Selenium compounds disclosed in known conventional patents can be used as the selenium sensitizer used in the present invention. In general, an unstable selenium compound and/or non-unstable selenium compound is used by adding this, and stirring the emulsion at a high temperature (preferably 40° C. or more) for a fixed time. As the unstable selenium compound, compounds described in JP-B's-44-15748 and 43-13489, JP-A's-4-25832 and 4-109240 and the like are preferably used.

As the unstable selenium sensitizer, for example, isoselenocyanates (e.g., aliphatic isoselenocyanates such as allylisoselenocyanate), selenoureas, selenoamides, selenocarboxylic acids (e.g., 2-selenopropionic acid, and 2-selenobutylic acid), selenoesters, diacylselenides (e.g., bis(3-chloro-2,6-dimethoxybenzoyl)selenide), selenophosphates, phosphineselenides, and colloid type metallic selenium are mentioned.

The preferable analogous type of the unstable selenium compounds were described above, but these are not limiting compounds. With respect to the unstable selenium compounds as the sensitizer of the photographic emulsion, it is generally understood by those skilled in the art that the structure of said compounds is not so important as far as selenium is unstable, and the organic portion of the selenium sensitizer molecule supports selenium and has no allotment except for letting it exist in the emulsion in an unstable form. The unstable selenium compound having such wide concept is advantageously used in the present invention.

As the non-unstable selenium compounds used in the present invention, compounds described in JP-B's-46-4553, 52-34492 and 52-34491 are used. As the non-unstable selenium compounds, for example, selenous acid, potassium selenocyanate, selenazoles, quatery salt of selenazoles, diarylselenide, diaryldiselenide, dialkylselenide, dialkyldiselenide, 2-selenazolidinedione, 2-selenooxalidinethione, and derivatives thereof are mentioned.

These selenium sensitizers are added at chemical sensitization by being dissolved in water or organic solvents such as methanol, ethanol and the like alone or in a mix solvent. They are preferably added before starting the chemical sensitization. The selenium sensitizer used is not limited to one, and a combination of 2 or more of the above-mentioned selenium sensitizers can be used. It is preferable to use the unstable selenium sensitizer and the non-unstable selenium sensitizer in combination.

The addition amount of the selenium sensitizer used in the present invention differs depending on the activity of the selenium sensitizer used, the type and size of silver halide, the temperature and time of ripening, and the like, and preferably $1\times10^{-8}$ mol or more per mol of silver halide and more preferably $1\times10^{-7}$ mol or more and $5\times10^{-5}$ mol or less. The temperature of chemical ripening when the selenium sensitizer is used is preferably 40° C. or more and 80° C. or less. pAg and pH are arbitrary. For example, the effect of the present invention is obtained within a wide pH range of 4 to 9.

The selenium sensitization is preferably used in combination of the sulfur sensitization or the noble metal sensitization or both of them. Further, in the present invention, thiocyanate is preferably added to the silver halide emulsion at chemical sensitization. As thiocyanate, potassium thiocyanate, sodium thiocyanate, ammonium thiocyanate and the like are used. It is usually added by being dissolved in an aqueous solution or a water-soluble solvent. The addition amount is $1\times10^{-5}$ to $1\times10^{-2}$ mol per mol of silver halide., and more preferably $5\times10^{-5}$ to $5\times10^{-3}$ mol.

An appropriate amount of calcium ion and/or magnesium ion is preferably contained in the silver halide emulsion of the present invention. Thereby, graininess is made better, image quality is improved and preservation property is also made better. The range of the fore-mentioned appropriate amount is 400 to 2500 ppm based on calcium and/or 50 to 2500 ppm based on magnesium, and more preferably calcium is 500 to 2000 ppm based and magnesium is 200 to 2000 ppm. Herein, 400 to 2500 ppm based on calcium and/or 50 to 2500 ppm based on magnesium means that at least one of calcium and magnesium is in a concentration within a prescribed range. When the content of calcium or magnesium is higher than these values, inorganic salts which calcium salt, magnesium salt or gelatin or the like kept preliminarily are precipitated, and it is not preferable because it becomes the cause of trouble at manufacturing lightsensitive material. Herein, the content of calcium or magnesium is represented by mass converted to calcium atom or magnesium atom with respect to all of compounds containing calcium or magnesium such as calcium ion, magnesium ion, calcium salt, magnesium salt and the like, and represented by a concentration per unit mass of the emulsion.

The adjustment of calcium content in the silver halide tabular grain emulsion of the present invention is preferably carried out by adding calcium salt at chemical sensitization. Gelatin usually used at production of the emulsion contains already calcium by 100 to 4000 ppm in a form of solid gelatin, and it may be adjusted by further adding calcium salt. According to requirement, after carrying out desalting (removal of calcium) from gelatin according to known methods such as a washing method, an ion-exchange method or the like, the content can be also adjusted by calcium salt. As the calcium salt, calcium nitrate and calcium chloride are preferable, and calcium nitrate is most preferable. Similarly, the adjustment of magnesium content can be carried out by adding magnesium salt at production of the emulsion. As the magnesium salt, magnesium nitrate, magnesium sulfate and magnesium chloride are preferable, and magnesium nitrate is most preferable. The quantitative method of calcium or magnesium can be determined by ICP emission spectral analysis method. Calcium and magnesium may be used alone or used in a mixture of both. Calcium is preferably contained. The addition of calcium or magnesium can be carried out at an arbitrary timing of the production steps of silver halide emulsion, but the interval from after grain formation to just after completion of spectral sensitization and chemical sensitization is preferable, and more preferably after addition of a sensitizing dye. Further, it is preferable in particular to add after addition of a sensitizing dye and before carrying out chemical sensitization.

Various compounds can be contained in the photographic emulsion used in the present invention in order to prevent fog in the step of manufacturing a lightsensitive material, during preservation, or during photographic processing, or to stabilize photographic performance. Namely, various compounds which were known as an antifoggant or a stabilizer, such as thiazoles (e.g., benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothisdiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes, for example, triazaindenes, tetrazaindenes (particularly hydroxy-substituted(1,3,3a,7)tetrazaindenes), and pentazaindenes can be added. For example, compounds described in U.S. Pat. Nos. 3,954,474 and 3,982,947, and JP-B-52-28660 can be used. One preferable compound is described in JP-A-63-212932. Antifoggants and stabilizers can be added at any of several different timings such as before, during and after grain formation, during washing with water, during dispersion after washing, before, during and after chemical sensitization, and before coating, in accordance with the intended application. The antifoggants and stabilizers can be added during preparation of an emulsion to achieve their original fog preventing effect and stabilizing effect, and in addition, can be used for various purposes of controlling crystal habit, is decreasing a grain size, decreasing the solubility of grains, controlling chemical sensitization, controlling the arrangement of dyes, and the like.

As a particularly useful compound for reducing the fogging of the silver halide emulsion and suppressing the fogging increase at preservation, a mercaptotetrazole compound having a water-soluble group described in JP-A-4-

16838 is mentioned. Further, it is disclosed in the forementioned Jpn. Pat. Appln KOKAI Publication that the preservation property is enhanced by using the combination of the mercaptotetrazole compound and a mercaptothiadiazole compound.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

The addition amount can be used at $4\times10^{-6}$ to $8\times10^{-3}$ mol per mol of silver halide.

Silver halide grains other than the tabular grains of the present invention used in a lightsensitive material is illustrated below.

The preferable silver halide contained in the photographic emulsion layer of the photographic lightsensitive material of the present invention is silver iodobromide, silver iodochloride, or silver bromochloroiodide containing about 30% or less of silver iodide. A particularly preferable silver halide is silver iodobromide or silver bromochloroiodide containing about 1 mol % to about 10 mol % of silver iodide.

Silver halide grains contained in a photographic emulsion can have regular crystals such as cubic, octahedral, or tetradecahedral crystals, regular crystals such as spherical or tabular crystals, crystals having crystal defects such as twin planes, or composite shapes thereof.

The grain diameter of silver halide may be fine grains having a grain size of about 0.2 $\mu$m or less, or large grains having a projected area diameter of about 10 $\mu$m, and the emulsion can be either a polydisperse or monodisperse.

The silver halide photographic emulsion which can be used in the present invention can be prepared by methods described in, for example, Research Disclosure (RD) No. 17643 (December 1978), pp. 22 and 23, "I. Emulsion preparation and types" RD No. 18716 (November 1979), p. 648, RD No. 30710 (November 1989), pp. 863–865, and P. Glafkides, "Chemie et Phisique Photographique", Paul Montel, (1967), G. F. Daffin, "Photographic Emulsion Chemistry" Focal Press, (1966), and V. L. Zelikman et al., "Making and Coating Photographic Emulsion", Focal Press, (1964).

Monodisperse emulsions described in U.S. Pat. Nos. 3,574,628 and 3,655,394, and GB No. 1,413,748 are also preferable.

A crystal structure can be uniform, can have different halogen compositions in the interior and the surface layer thereof, or can be a layered structure. Alternatively, silver halide have different compositions can be bonded by epitaxial junction, or a compound except for a silver halide such as silver rhodanide or lead oxide can be bonded. Further, a mixture of grains having various types of crystal shapes can also be used.

The above-mentioned emulsion can be any of a surface latent image type emulsion which mainly forms a latent image on the surface of a grain, an internal latent image type emulsion which forms a latent image in the interior of the grain, and another type of emulsion which has latent images on the surface and in the interior of the grain. However, the emulsion must be a negative type emulsion. The internal latent image type emulsion can be a core/shell internal latent image type emulsion described in JP-A-63-264740. A method of preparing the core/shell internal latent image type emulsion is described in JP-A-59-133542. Although the thickness of a shell of the emulsion depends on development conditions and the like, it is preferably 3 to 40 nm and preferably 5 to 20 nm in particular.

It is also possible to preferably use surface fogged silver halide grains described in U.S. Pat. No. 4,082,553, internally fogged silver halide grains described in U.S. Pat. No. 4,626,498, and JP-A-59-214852, colloidal silver, in sensitive silver halide emulsion layer and/or essentially nonsensitive hydrophilic colloid layer. The internally fogged or surface fogged silver halide grains means a silver halide grain which can be developed uniformly (non-imagewise) regardless of whether the location is a non-exposed portion or an exposed portion of the lightsensitive material. A method of preparing the internally fogged or surface fogged silver halide grains is described in U.S. Pat. No. 4,626,498 and JP-A-59-214852.

A silver halide which forms the core of an internally fogged core/shell type silver halide grain can have the same halogen composition or can have a different halogen composition. As the internally fogged or surface fogged silver halide, any of silver chloride, silver chlorobromide, silver bromoiodide, and silver bromochloroiodide can be used. The average grain size of these fogged silver halide grains is not specifically limited, but preferably 0.01 to 0.95 μm and preferably 0.05 to 6 μm in particular. Further, the grain shape is not specifically limited, and can be a regular grain shape. Further, although the emulsion can be a polydisperse emulsion, it is preferably a monodisperse emulsion (in which at least 95% in weight or number of grains of silver halide grains have grain sizes falling within the range of ±40% of the average grain size).

In a lightsensitive material of the present invention, it is possible to mix, in a single layer, two or more types of emulsions different in at least one of characteristics of a lightsensitive silver halide emulsion, for example, a grain size, grain size distribution, halogen composition, grain shape, and sensitivity.

In the production process of the photographic lightsensitive material of the present invention, a photographic useful substance is usually added to a photographic coating liquid, namely, those added to a hydrophilic colloid liquid. With respect to the silver halide photographic emulsion of the present invention, and various techniques and inorganic and organic materials which can be used for the silver halide photographic lightsensitive material using thereof, those described in "Research Disclosure" No. 308119 (1989) and RD No. 37038 (1995) and RD No. 40145 (1997) can be usually used.

In addition, techniques and inorganic and organic materials usable in color photographic light-sensitive materials to which silver halide photographic emulsions of the present invention can be applied are described in portions of EP436, 938A2 and patents cited below, the disclosures of which are herein incorporated by reference.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421, 453A1, page 3, line 5 to page 25, line 55 |
| 5) | Cyan couplers usable together | page 149, lines 29 to 33; EP432, 804A2, page 3, line 28 to page 40, line 2 |
| 6) | Polymer couplers | page 149, lines 34 to 38; EP435, 334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435, 334A2, page 3, line 1 to page 29, line 50 |

-continued

| | Items | Corresponding portions |
|---|---|---|
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing stabilizing | page 153, lines 3 to 37 |

The photographic lightsensitive material of the present invention is usually processed with an alkali developing liquid which contains a main developing agent, after imagewise exposure. After coupling, the color photographic lightsensitive material is treated with an imaging method in which it is treated with a processing liquid having bleaching capability which contains a bleaching agent.

The present invention will be described in detail below by way of its examples. However, the present invention is not limited to these examples.

(Preparation of Sample 101)

(i) Preparation of Cellulose Triacetate Film

Cellulose triacetate was dissolved (13% by mass) in dichloromethane/methanol=92/8 (mass ratio) by a usual solution flow extension method, the plasticizers of triphenyl phosphate and biphenyldiphenyl phosphate were added thereto so that mass ratio is 2:1 and the total is 14% based on cellulose triacetate, and the cellulose triacetate film was prepared by a band method from the solution. The thickness of the support after drying was 91 μm.

(ii) Content of Undercoat Layer

The undercoat below was carried out on both faces of the above-mentioned cellulose triacetate. The Figure represents mass contained in 1.0L of the undercoat liquid.

Further, corona discharge treatment was carried out on both faces before treating the undercoat.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Total (by addition with water) | 1.0 L |

The undercoat layer of one surface of the support was coated with back layers described below.

| | |
|---|---|
| 1st layer Binder: acid-processed gelatin (isoelectric point 9.0) | 1.10 g |

-continued

| | |
|---|---|
| Polymer latex: P-2 (average grain size 0.1 μm) | 0.13 g |
| Polymer latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer Binder: acid-processed gelatin (isoelectric point 9.0) | 3.30 g |
| Polymer latex: P-2 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer Binder: acid-processed gelatin (isoelectric point 9.0) | 3.50 g |
| Surfactant W-3 | 0.020 g |
| Potassium sulfate | 0.30 g |
| Sodium hydroxide | 0.03 g |
| 4th layer Binder: lime-processed gelatin | 1.25 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-3 | 0.060 g |
| Surfactant W-2 | 7.0 mg |
| Hardener H-1 | 0.23 g |

(iv) Coating of Lightsensitive Emulsion Layer

The lightsensitive emulsion layers shown below were coated on the reverse side to a face on which a back layer was coated to make a sample 101. Figure represents addition amount per $m^2$. Further, the effect of the compounds added is not limited to uses described.

| | | |
|---|---|---|
| 1st layer: Antihalation layer | | |
| Black colloidal silver | silver | 0.30 g |
| Gelatin | | 2.10 g |
| Ultraviolet absorbent U-1 | | 0.15 g |
| Ultraviolet absorbent U-3 | | 0.15 g |
| Ultraviolet absorbent U-4 | | 0.10 g |
| Ultraviolet absorbent U-5 | | 0.10 g |
| High-boiling organic solvent Oil-1 | | 0.10 g |
| High-boiling organic solvent Oil-2 | | 0.10 g |
| High-boiling organic solvent Oil-5 | | 0.010 g |
| Dye D-4 | | 1.0 mg |
| Dye D-8 | | 2.5 mg |
| Fine-crystal solid dispersion of dye E-1 | | 0.05 g |
| 2nd layer: 1st interlayer | | |
| Gelatin | | 0.50 g |
| Compound Cpd-A | | 0.2 mg |
| Compound Cpd-M | | 0.03 mg |
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |

-continued

| | | |
|---|---|---|
| 3rd layer: 2nd interlayer | | |
| Gelatin | | 0.60 g |
| Compound Cpd-D | | 0.020 g |
| Compound Cpd-M | | 0.050 g |
| High-boiling organic solvent Oil-3 | | 0.010 g |
| High-boiling organic solvent Oil-8 | | 0.010 g |
| 4th layer: Low-speed red-sensitive emulsion layer | | |
| Emulsion A | silver | 0.10 g |
| Emulsion B | silver | 0.15 g |
| Emulsion C | silver | 0.15 g |
| Silver iodobromide emulsion which surface and internal thereof were fogged in advance. (cubic, av. silver iodide content 1 mol %, equivalent-sphere av. grain diameter 0.06 μm) | silver | 0.010 g |
| Gelatin | | 0.70 g |
| Coupler C-1 | | 0.15 g |
| Coupler C-2 | | 7.0 mg |
| Coupler C-10 | | 3.0 mg |
| Coupler C-11 | | 2.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| High-boiling organic solvent Oil-10 | | 0.030 g |
| Additive P-1 | | 5.0 mg |
| 5th layer: Medium-speed red-sensitive emulsion layer | | |
| Emulsion C | silver | 0.15 g |
| Emulsion D | silver | 0.15 g |
| Gelatin | | 0.70 g |
| Coupler C-1 | | 0.15 g |
| Coupler C-2 | | 7.0 mg |
| Coupler C-10 | | 3.0 mg |
| Compound Cpd-D | | 3.0 mg |
| Ultraviolet absorbent U-3 | | 0.010 g |
| High-boiling organic solvent Oil-10 | | 0.030 g |
| Additive P-1 | | 7.0 mg |
| 6th layer: High-speed red-sensitive emulsion layer | | |
| Emulsion E | silver | 0.15 g |
| Emulsion F | silver | 0.20 g |
| Gelatin | | 1.30 g |
| Coupler C-1 | | 0.60 g |
| Coupler C-2 | | 0.015 g |
| Coupler C-3 | | 0.030 g |
| Coupler C-10 | | 5.0 mg |
| Ultraviolet absorbent U-1 | | 0.010 g |
| Ultraviolet absorbent U-2 | | 0.010 g |
| High-boiling organic solvent Oil-6 | | 0.030 g |
| High-boiling organic solvent Oil-9 | | 0.020 g |
| High-boiling organic solvent Oil-10 | | 0.050 g |
| Compound Cpd-D | | 5.0 mg |
| Compound Cpd-F | | 0.030 g |
| Compound Cpd-K | | 1.0 mg |
| Compound Cpd-L | | 1.0 mg |
| Additive P-1 | | 0.010 g |
| Additive P-4 | | 0.030 g |
| 7th layer: 3rd interlayer | | |
| Gelatin | | 1.0 g |
| Additive P-2 | | 0.15 g |
| Dye D-5 | | 0.020 g |
| Dye D-6 | | 0.020 g |
| Dye D-9 | | 6.0 mg |
| Compound Cpd-A | | 0.050 g |
| Compound Cpd-D | | 0.030 g |
| Compound Cpd-I | | 0.010 g |
| Compound Cpd-M | | 0.090 g |
| Compound Cpd-O | | 3.0 mg |
| Compound Cpd-P | | 5.0 mg |
| High-boiling organic solvent Oil-6 | | 0.100 g |
| High-boiling organic solvent Oil-3 | | 0.010 g |
| Ultraviolet absorbent U-1 | | 0.010 g |
| Ultraviolet absorbent U-3 | | 0.010 g |

-continued

| | | |
|---|---|---|
| 8th layer: Low-speed long-wave green-sensitive emulsion layer | | |
| Emulsion G | silver | 0.25 g |
| Emulsion H | silver | 0.25 g |
| Emulsion I | silver | 0.25 g |
| Silver iodobromide emulsion which surface and internal thereof were fogged in advance. (cubic, average silver iodide content 1 mol %, average equivalent-sphere grain size 0.06 μm) | silver | 0.010 g |
| Gelatin | | 1.30 g |
| coupler C-6 | | 0.20 g |
| Compound Cpd-A | | 5.0 mg |
| Compound Cpd-B | | 0.030 g |
| Compound Cpd-D | | 5.0 mg |
| Compound Cpd-F | | 0.010 g |
| Compound Cpd-G | | 2.5 mg |
| Compound Cpd-K | | 1.0 mg |
| Ultraviolet absorbent U-6 | | 5.0 mg |
| High-boiling organic solvent Oil-2 | | 0.25 g |
| Additive P-1 | | 5.0 mg |
| 9th layer: Medium-speed long-wave green-sensitive emulsion layer | | |
| Emulsion I | silver | 0.30 g |
| Emulsion J | silver | 0.30 g |
| Gelatin | | 0.70 g |
| Coupler C-4 | | 0.25 g |
| Coupler C-7 | | 0.25 g |
| Compound Cpd-A | | 5.0 mg |
| Compound Cpd-B | | 0.030 g |
| Compound Cpd-F | | 0.010 g |
| Compound Cpd-G | | 2.0 mg |
| High-boiling organic solvent Oil-2 | | 0.20 g |
| High-boiling organic solvent Oil-9 | | 0.050 g |
| 10th layer: High-speed long-wave green-sensitive emulsion layer | | |
| Emulsion K | silver | 0.40 g |
| Gelatin | | 0.80 g |
| Coupler C-7 | | 0.30 g |
| Compound Cpd-A | | 5.0 mg |
| Compound Cpd-B | | 0.030 g |
| Compound Cpd-F | | 0.010 g |
| Compound Cpd-K | | 1.0 mg |
| Compound Cpd-L | | 1.0 mg |
| High-boiling organic solvent Oil-2 | | 0.20 g |
| High-boiling organic solvent Oil-9 | | 0.050 g |
| 11th layer: Yellow filter layer | | |
| Yellow colloidal silver | silver | 0.005 g |
| Gelatin | | 1.00 g |
| Compound Cpd-C | | 0.010 g |
| Compound Cpd-M | | 0.10 g |
| High-boiling organic solvent Oil-1 | | 0.020 g |
| High-boiling organic solvent Oil-6 | | 0.10 g |
| Fine-crystal solid dispersion of dye E-2 | | 0.25 g |
| 12th layer: Short-wave blue sensitive emulsion layer | | |
| Emulsion T | silver | 0.27 g |
| Gelatin | | 0.40 g |
| Compound Cpd-Q | | 0.20 g |
| 13th layer: Low-speed long-wave blue-sensitive emulsion layer | | |
| Emulsion L | silver | 0.15 g |
| Emulsion M | silver | 0.20 g |
| Emulsion N | silver | 0.10 g |
| Internally fogged silver bromide emulsion (cubic, average equivalent-sphere grain size 0.11 μm) | silver | 3.0 mg |
| Gelatin | | 0.80 g |
| Coupler C-8 | | 0.020 g |
| Coupler C-9 | | 0.30 g |
| Coupler C-10 | | 5.0 mg |
| Compound Cpd-B | | 0.10 g |
| Compound Cpd-I | | 8.0 mg |

-continued

| | | |
|---|---|---|
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |
| 14th layer: Medium-speed long-wave blue-sensitive emulsion layer | | |
| Emulsion N | silver | 0.20 g |
| Emulsion O | silver | 0.20 g |
| Gelatin | | 0.80 g |
| Coupler C-8 | | 0.020 g |
| Coupler C-9 | | 0.25 g |
| Coupler C-10 | | 0.010 g |
| Compound Cpd-B | | 0.10 g |
| Compound Cpd-E | | 0.030 g |
| Compound Cpd-N | | 2.0 mg |
| High-boiling organic solvent Oil-2 | | 0.010 g |
| 15th layer: High-speed long-wave blue-sensitive emulsion layer | | |
| Emulsion P | silver | 0.20 g |
| Emulsion Q | silver | 0.25 g |
| Gelatin | | 2.00 g |
| Coupler C-3 | | 5.0 mg |
| Coupler C-8 | | 0.10 g |
| Coupler C-9 | | 1.00 g |
| Coupler C-10 | | 0.020 g |
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-N | | 5.0 mg |
| 16th layer: 1st protective layer | | |
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| 17th layer: 2nd protective layer | | |
| Colloidal silver | silver | 2.5 mg |
| Fine-grain silver iodobromide emulsion (av. silver iodide content 1 mol %, equivalent-sphere av. grain diameter 0.06 μm) | silver | 0.10 g |
| Gelatin | | 0.80 g |
| Ultraviolet absorbent U-1 | | 0.030 g |
| Ultraviolet absorbent U-6 | | 0.030 g |
| High-boiling organic solvent Oil-3 | | 0.010 g |
| 18th layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

| Silver bromoiodide emulsions used in Sample 101 | | | | | | | | | | | |
|---|---|---|---|---|---|---|---|---|---|---|---|
| Emulsion | Characteristics | Average equivalent-sphere diameter (μm) | Variation coefficient (%) | Average AgI content (%) | Halogen composition structure of silver halide grain | AgI content of grain surface (%) | Other characteristics 1 | 2 | 3 | 4 | 5 |
| A | Monodisperse tetradecahedral grain | 0.20 | 9 | 3.0 | Triple | 1.5 | | ○ | | | |
| B | Monodisperse (111) tabular grain Average aspect ratio 2.0 | 0.22 | 10 | 3.5 | Quadruple | 1.5 | ○ | | ○ | ○ | ○ |
| C | Monodisperse (111) tabular grain Average aspect ratio 2.2 | 0.30 | 19 | 3.0 | Triple | 0.2 | ○ | ○ | | ○ | ○ |
| D | Monodisperse (111) tabular grain Average aspect ratio 3.0 | 0.35 | 21 | 3.0 | Triple | 1.5 | ○ | ○ | | ○ | ○ |
| E | Monodisperse (111) tabular grain Average aspect ratio 3.0 | 0.40 | 10 | 2.5 | Quadruple | 1.5 | | ○ | | | |
| F | Monodisperse (111) tabular grain Average aspect ratio 4.5 | 0.55 | 12 | 2.0 | Triple | 0.6 | ○ | ○ | | | ○ |
| G | Monodisperse cubic grain | 0.16 | 9 | 3.5 | Quadruple | 2.0 | | | ○ | | |
| H | Monodisperse cubic grain | 0.22 | 12 | 3.5 | Quadruple | 0.1 | ○ | ○ | | ○ | |
| I | Monodisperse (111) tabular grain Average aspect ratio 4.0 | 0.29 | 12 | 2.5 | Quintuple | 4.5 | ○ | ○ | | ○ | ○ |
| J | Monodisperse (111) tabular grain Average aspect ratio 5.0 | 0.40 | 21 | 2.5 | Quadruple | 0.2 | ○ | ○ | | ○ | ○ |
| K | Monodisperse (111) tabular grain Average aspect ratio 5.5 | 0.55 | 13 | 2.0 | Triple | 1.0 | ○ | ○ | | | ○ |
| L | Monodisperse tetradecahedral grain | 0.30 | 9 | 3.5 | Triple | 4.0 | | | ○ | | ○ |
| M | Monodisperse tetradecahedral grain | 0.30 | 9 | 3.5 | Triple | 3.0 | ○ | ○ | | ○ | ○ |
| N | Monodisperse (111) tabular grain Average aspect ratio 7.0 | 0.35 | 13 | 2.5 | Quadruple | 2.0 | ○ | ○ | ○ | | |
| O | Monodisperse (111) tabular grain Average aspect ratio 9.0 | 0.45 | 9 | 2.5 | Quadruple | 1.0 | ○ | ○ | | ○ | ○ |
| P | Monodisperse (111) tabular grain Average aspect ratio 11.0 | 0.80 | 21 | 2.0 | Triple | 0.5 | ○ | ○ | | | ○ |
| Q | Monodisperse (111) tabular grain Average aspect ratio 15.0 | 0.92 | 8 | 1.5 | Quadruple | 0.5 | ○ | ○ | | | ○ |
| R | Monodisperse (111) tabular grain Average aspect ratio 7.0 | 0.90 | 10 | 8.0 | Quadruple | 3.0 | ○ | ○ | | ○ | ○ |
| S | Monodisperse (111) tabular grain Average aspect ratio 9.0 | 0.45 | 8 | 12.0 | Quadruple | 4.0 | ○ | ○ | | | ○ |
| T | Monodisperse (111) tabular grain Average aspect ratio 11.0 | 0.50 | 12 | 6.0 | Quadruple | 4.5 | ○ | ○ | | | ○ |

(Other Characteristics)

(i) A reduction sensitizer was added during the grain formation.

(ii) A selenium sensitizer was used as an afterripening agent.

(iii) A rhodium salt was added during the grain formation.

(iv) After the afterripening, silver nitrate amounting to 10%, in terms of silver molar ratio, based on the emulsion grains at the very moment and an equimolar amount of potassium bromide were added to thereby effect a shell covering.

(v) The presence of 10 or more dislocation lines per grain on the average was observed through a transmission electron microscope.

All the lightsensitive emulsions were afterripened with the use of sodium thiosulfate, potassium thiocyanate and sodium chloroaurate.

Further, an iridium salt was appropriately added during the grain formation.

Still further, with respect to each of the emulsions B, C, E, H, J, N and Q, a chemically modified gelatin wherein amino groups of gelatin were partially converted to phthalamides was added thereto during the emulsion preparation.

TABLE 2

Spectral sensitization of emulsions A to T

| Emulsion | Added sensitizing dye | Addition amount (g) per mol of silver halide | Addition timing of sensitizing dye |
|---|---|---|---|
| A | S-1 | 0.01 | Subsequently to after-ripening |
| | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| B | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| C | S-2 | 0.45 | Prior to after-ripening |
| | S-8 | 0.04 | Prior to after-ripening |
| | S-13 | 0.02 | Prior to after-ripening |
| D | S-2 | 0.5 | Subsequently to after-ripening |
| | S-3 | 0.05 | Subsequently to after-ripening |
| | S-8 | 0.05 | Prior to after-ripening |
| | S-13 | 0.015 | Prior to after-ripening |
| E | S-1 | 0.01 | Prior to after-ripening |
| | S-2 | 0.45 | Prior to after-ripening |
| | S-8 | 0.05 | Prior to after-ripening |
| | S-13 | 0.01 | Subsequently to after-ripening |
| F | S-2 | 0.4 | Prior to after-ripening |
| | S-3 | 0.04 | Prior to after-ripening |
| | S-8 | 0.04 | Prior to after-ripening |
| G | S-4 | 0.3 | Subsequently to after-ripening |
| | S-5 | 0.05 | Subsequently to after-ripening |
| | S-12 | 0.1 | Subsequently to after-ripening |
| H | S-4 | 0.2 | Prior to after-ripening |
| | S-5 | 0.05 | Subsequently to after-ripening |
| | S-9 | 0.15 | Prior to after-ripening |
| | S-14 | 0.02 | Subsequently to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequently to after-ripening |
| | S-12 | 0.1 | Prior to after-ripening |
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequently to after-ripening |
| | S-10 | 0.2 | Subsequently to after-ripening |
| | S-11 | 0.05 | Subsequently to after-ripening |
| N | S-6 | 0.05 | Subsequently to after-ripening |
| | S-7 | 0.05 | Subsequently to after-ripening |
| | S-10 | 0.25 | Subsequently to after-ripening |
| | S-11 | 0.05 | Subsequently to after-ripening |
| O | S-10 | 0.4 | Subsequently to after-ripening |
| | S-11 | 0.15 | Subsequently to after-ripening |
| P | S-6 | 0.05 | Subsequently to after-ripening |
| | S-7 | 0.05 | Subsequently to after-ripening |
| | S-10 | 0.3 | Prior to after-ripening |
| | S-11 | 0.1 | Prior to after-ripening |
| Q | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |
| R | S-15 | 0.25 | Prior to after-ripening |
| | S-4 | 0.25 | Prior to after-ripening |

TABLE 2-continued

Spectral sensitization of emulsions A to T

| Emulsion | Added sensitizing dye | Addition amount (g) per mol of silver halide | Addition timing of sensitizing dye |
|---|---|---|---|
| S | S-15 | 0.30 | Prior to after-ripening |
| | S-4 | 0.30 | Prior to after-ripening |
| T | S-10 | 0.25 | Prior to after-ripening |

C-1

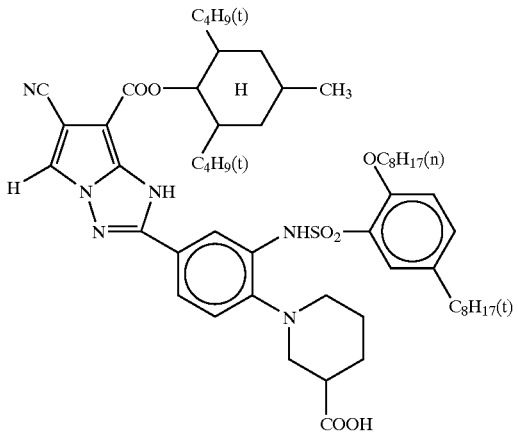

C-2

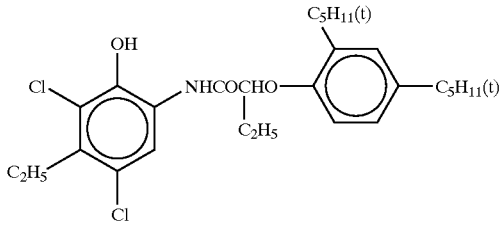

C-3

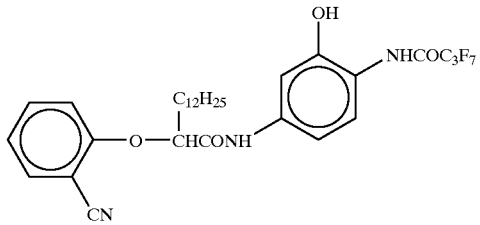

C-6

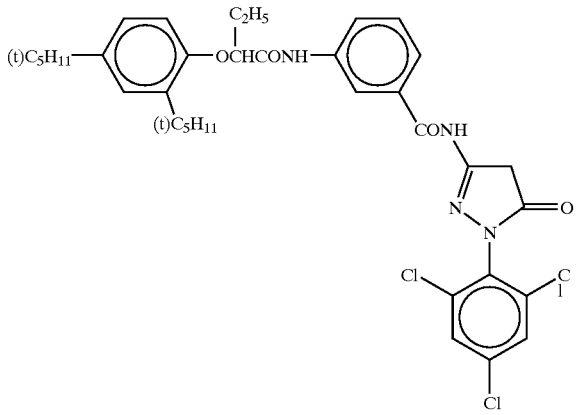

-continued
C-7
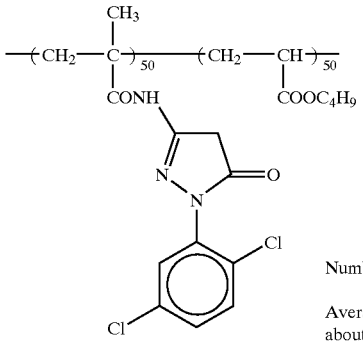
Numbers represent mass %
Average molecular weight: about 25,000
C-8
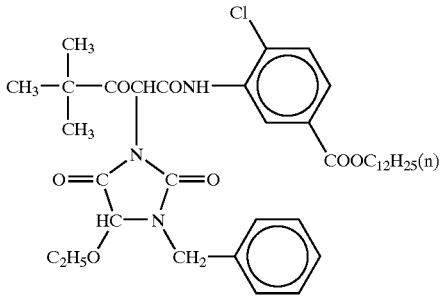
C-9
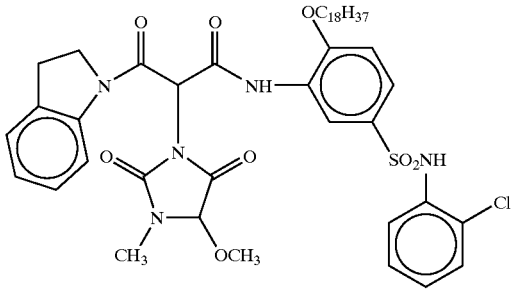
C-10
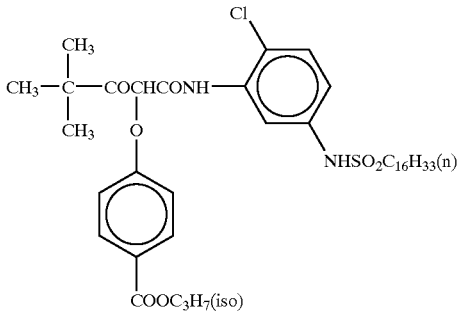
C-11
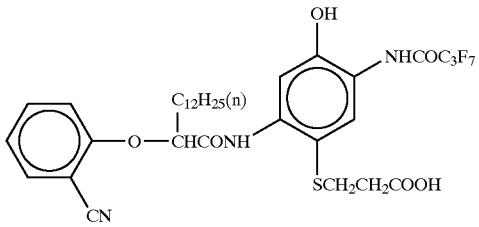
Oil-1
Tri-n-hexyl phosphate
Oil-2
Tricresyl phosphate
Oil-3
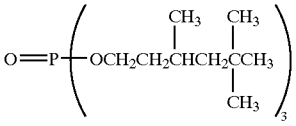
Oil-4
Tricyclohexyl phosphate
Oil-5
Bis(2-ethyl hexyl) succinate
Oil-6
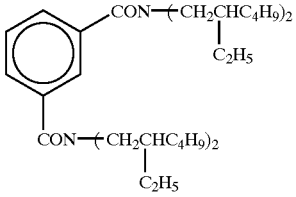
Oil-7
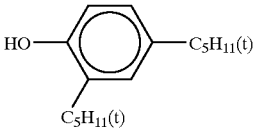
Oil-8
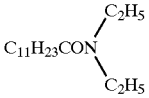
Oil-9
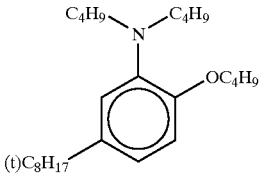
Oil-10
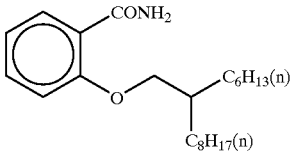
Cpd-A
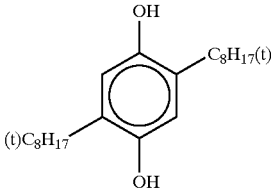
Cpd-B
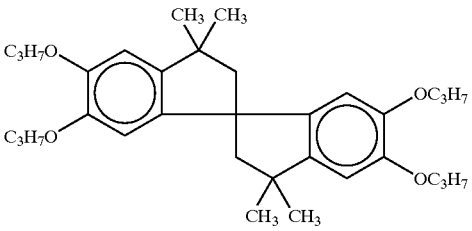

-continued
Cpd-C
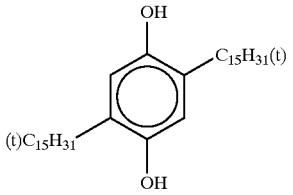
Cpd-D
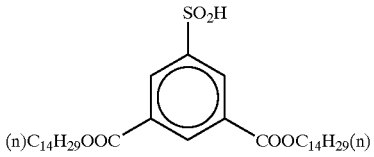
Cpd-E
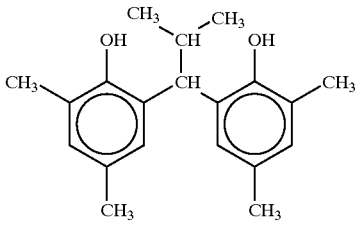
Cpd-F
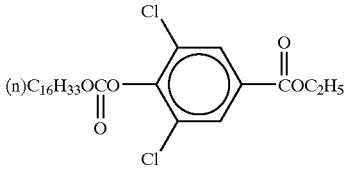
Cpd-G
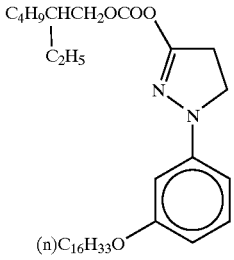
Cpd-H
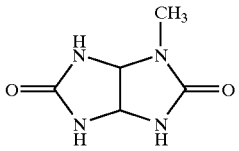
Cpd-I
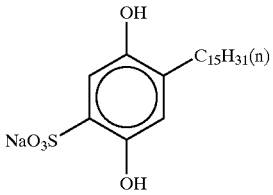
Cpd-J
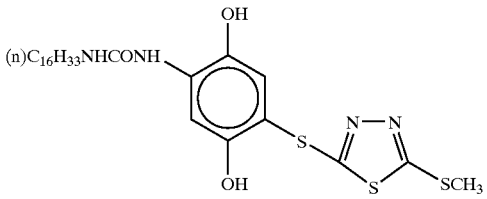
-continued
Cpd-K
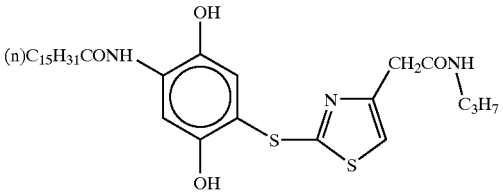
Cpd-L
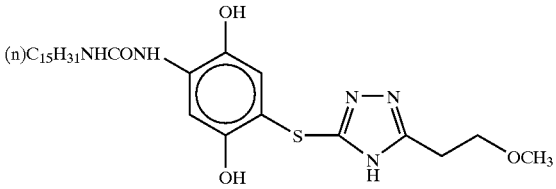
Cpd-M
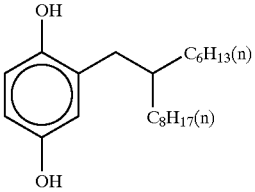
Cpd-N
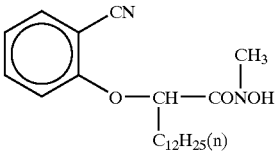
Cpd-O
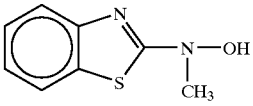
Cpd-P
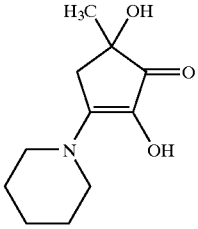
Cpd-Q
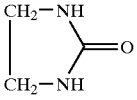
U-1
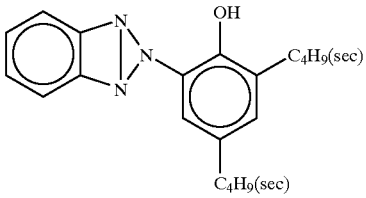

-continued
U-2
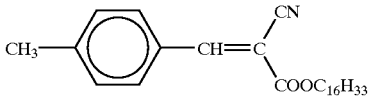
U-3
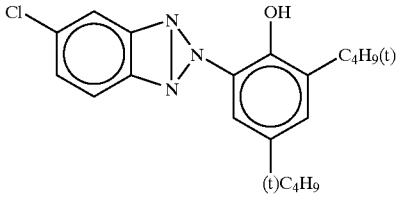
U-4
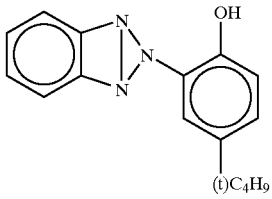
U-5
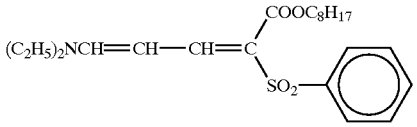
U-6
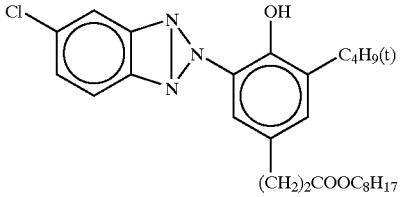
S-1
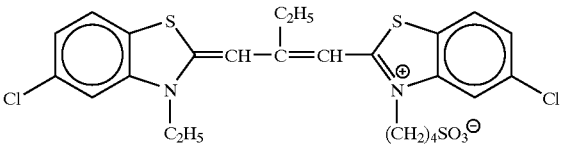
S-2
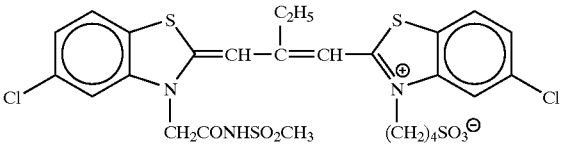
S-3
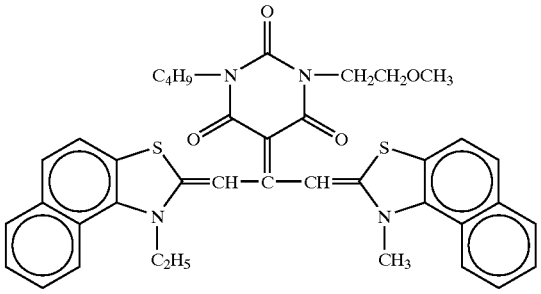
-continued
S-4
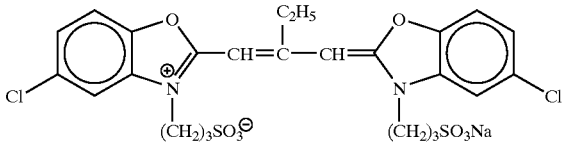
S-5
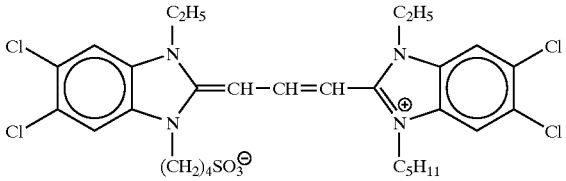
S-6
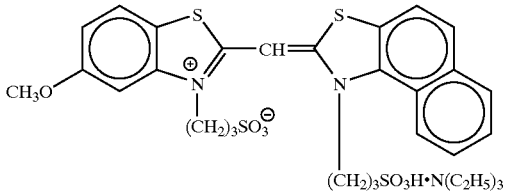
S-7
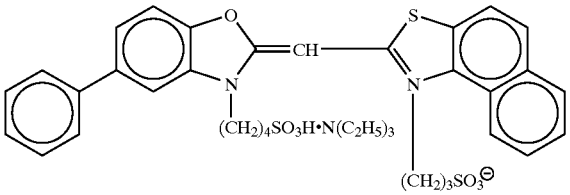
S-8
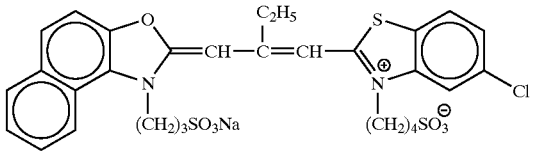
S-9
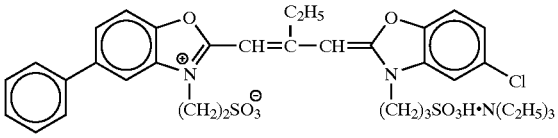
S-10
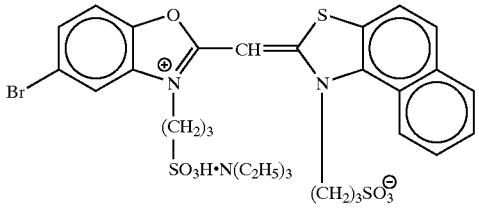
S-11
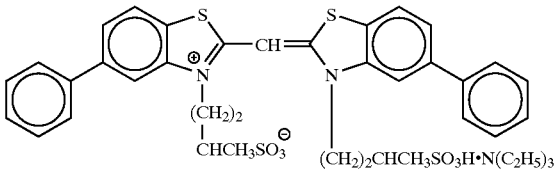

-continued
S-12
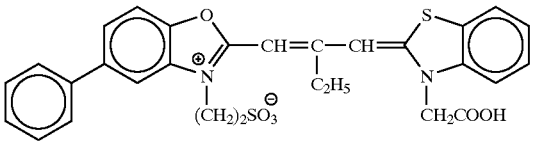
S-13
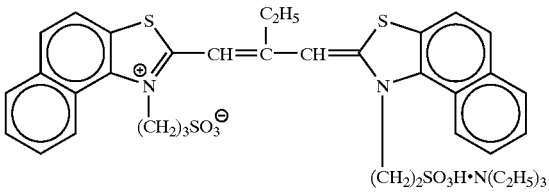
-continued
S-14
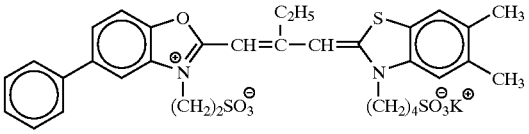
S-15
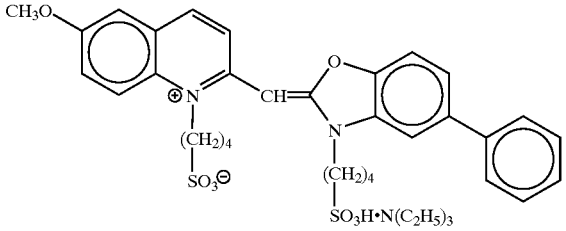
D-1
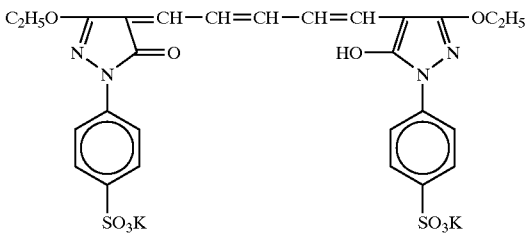
D-2
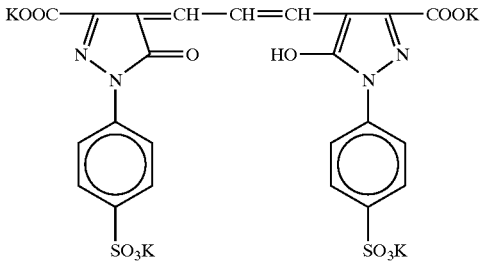
D-3
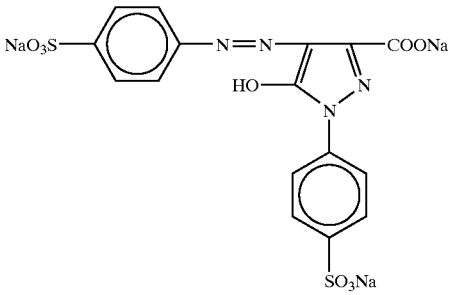
D-4
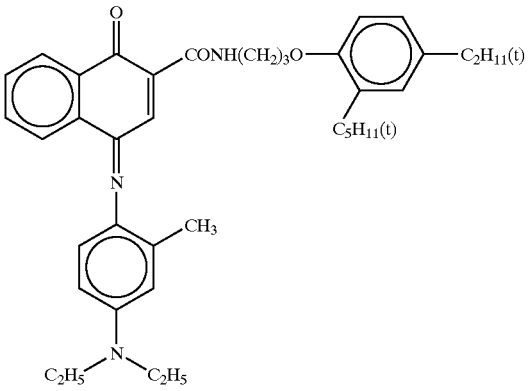
D-5
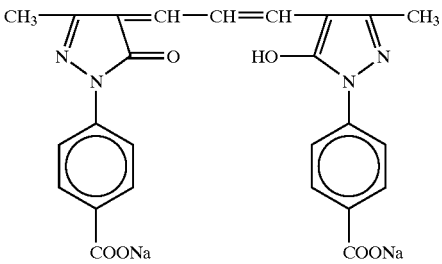

-continued
D-6
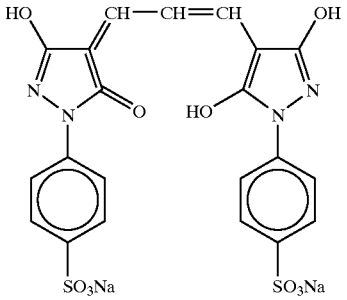
D-7
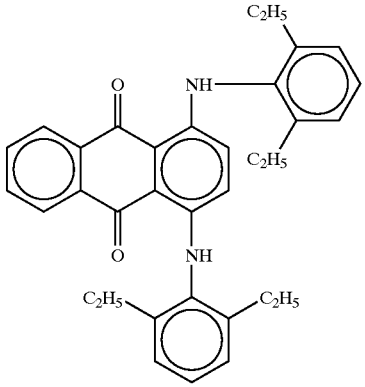
D-8
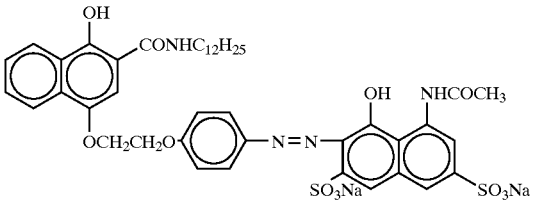
D-9
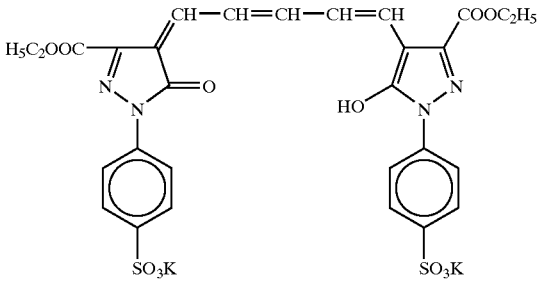
D-10
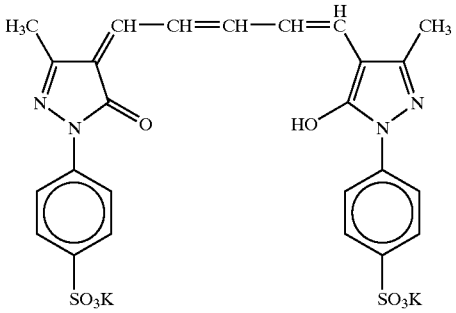
E-1
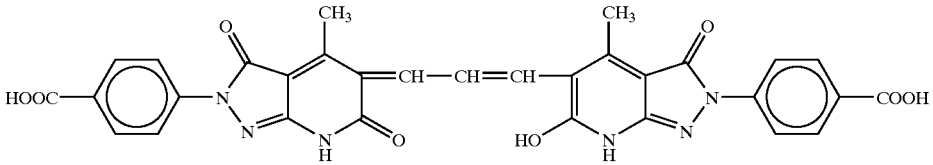

-continued
E-2
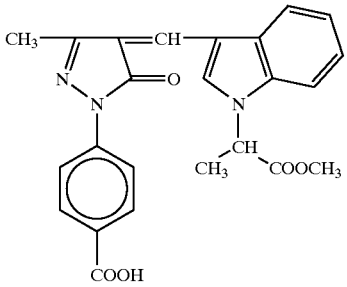
H-1
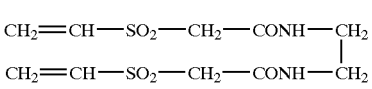
W-1
$C_8F_{17}SO_2NHCH_2CH_2CH_2OCH_2CH_2\overset{\oplus}{N}(CH_3)_3$
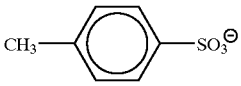
W-2
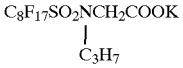
W-3
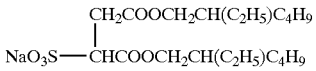
W-4
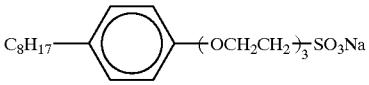
W-5
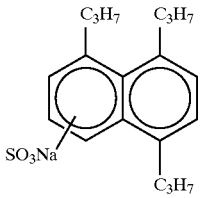
W-6
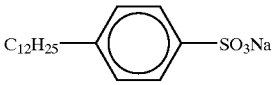
W-7
$C_8F_{17}SO_3Li$
P-1
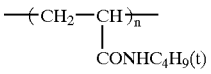
(n = 100~1000)
P-2
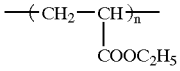
(n = 100~1000)
P-3
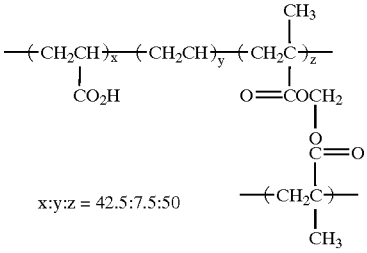
x:y:z = 42.5:7.5:50
P-4
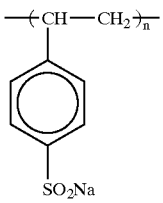
(n = 100~1000)

F-1

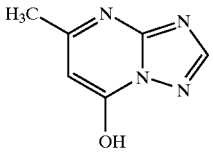

F-2

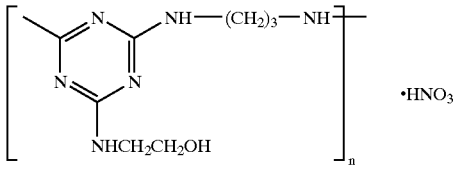

n = 3~4

F-3

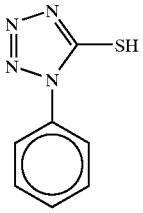

F-4

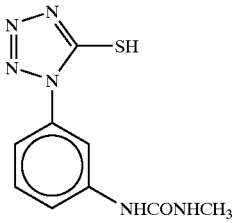

F-5

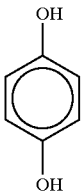

F-6

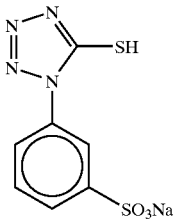

F-7

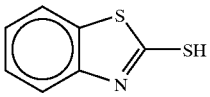

F-8

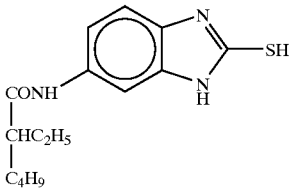

-continued

F-9

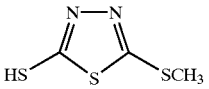

SO-1

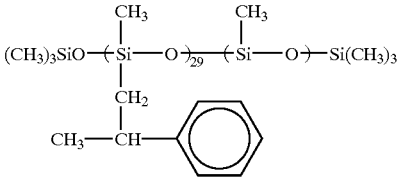

Preparation of Dispersions of Organic Solid Disperse Dyes (Preparation of Fine-crystal Solid Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hrs. The beads were filtered out, and water was added to dilute the material to a dye concentration of 3%. After that, the material was heated to 90° C. for 10 hrs for stabilization. The average grain size of the obtained fine dye grains was 0.30 $\mu$m, and the grain size distribution (grain size standard deviation×100/average grain size) was 20%.

(Preparation of Solid Dispersion of Dye E-2)

Water and 270 g of W-4 were added to 1,400 g of a wet cake of E-2 containing 30 mass % of water, and the resultant material was stirred to form a slurry having an E-2 concentration of 40 mass %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of E-2. This dispersion was diluted to 20 mass % by ion exchange water to obtain a fine-crystal solid dispersion. The average grain size was 0.15 $\mu$m.

The film thickness of sample 101 was 26.5 $\mu$m, and the film thickness thereof after swelling in 25° C. water was 47.8 $\mu$m.

Further, in the sample 101, the weight-averaged wavelength of spectral sensitivity distribution of red-sensitive emulsion layer was 630 nm; the weight-averaged wavelength of spectral sensitivity distribution of green-sensitive emulsion layer was 550 nm; and the weight-averaged wavelength of spectral sensitivity distribution of blue-sensitive emulsion layer was 430 nm.

Moreover, in the sample 101, the silver quantity of silver halide emulsion for image formation was 4.37 g per $m^2$.

In this example, the sample was treated with the development processing step (development processing A) shown below.

With respect to processing, after running processing was carried out until replenishment amount becomes 4 times the tank volume at a ratio 1:1 of an unexposed one to a completely exposed one of Sample 101, the processing for evaluation was carried out.

| Processing Step | Time | Temperature | Tank volume | Replenishment rate |
|---|---|---|---|---|
| 1st development | 6 min | 38° C. | 37 L | 2,200 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid. pentasodium salt | 1.5 g | 1.5 g |
| Diethylenetriamine pentaacetic acid. pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid. pentasodium salt | 3.0 g | the same as tank solution |
| Stannous chloride.dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid. pentasodium salt | 2.0 g | 2.0 g |
| Sodium sulfite | 7.0 g | 7.0 g |
| Trisodium phosphate. dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |

-continued

| <Color developer> | <Tank solution> | <Replenisher> |
|---|---|---|
| N-ethyl-N-(β-methanesulfon amidoethyl)-3-methyl-4 aminoaniline.3/2 sulfuric acid·monohydrate | 10 g | 10 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (weight-average molecular weight = 2,000) | 0.1 g | 0.15 g |
| Water to make | 1,000 mL | 1,000 mL |
| pH | 7.0 | 7.0 |

In the above development process, the solution was continuously circulated and stirred in each bath. In addition, a blowing pipe having small holes 0.3 mm in diameter formed at intervals of 1 cm was attached to the lower surface of each tank to continuously blow nitrogen gas to stir the solution.

(Method of Evaluating Color Reproduction)

The prepared sample was cut into Brownie size of 60 mm width, processed, charged in a Brownie camera, and used to simultaneously photograph a Macbeth color chip (24 colors including 6 stages of grays), a Japanese woman model and a European woman model. At the photographing, the color temperature was set for 5300 K.

There was a slight disorder in color balance among samples. Therefore, for each sample, the camera was equipped with a color correction filter, and a color balance correction was carried out so that the gray chart of Macbeth color chip photographed was reproduced as gray. The photographing was performed with seven varied exposure intensities, the exposure intensities varied by ⅓ apertures from −1 aperture to +1 aperture around the standard exposure intensity. The standard exposure intensity refers to an exposure intensity with which the No. 22 gray patch of the Macbeth color chip exhibits a density of 0.85±0.05 on the film (test photographing was performed in advance, thereby determining the standard exposure intensity and the magnitude of color filter correction). Thereafter, the samples after photographing were subjected to the above-mentioned development processing A, and a frame wherein the density of No. 22 gray chart part was the closest to 0.85 was chosen (hereinafter referred to as "evaluation image"). In all the samples, the density at this part fell within the range of 0.85±0.03. The spectral transmittance of the i-th color (i=1 to 24) of Macbeth chart part of this evaluation image was measured, and the colorimetric values L*i, a*i and b*i on CIELAB color space were calculated. Further, the color difference ΔE1 thereof from the colorimetric values L*0i, a*0i and b*0i calculated from the corresponding original spectral reflectance was calculated. These calculations were carried out with respect to all the Macbeth 24 colors, and the average color difference ΔEave for the 24 colors was determined.

Moreover, with respect to the evaluation images, five persons working with the Ashigara Laboratory of Fuji Photo Film Co., Ltd. and engaged in photograph evaluation carried out a sensory evaluation of color reproduction including that of skin color by visual inspection.

(Preparation of Samples 102 to 118)

Samples 102 to 104 varied in the weight-averaged wavelength λra of spectral sensitivity distribution of red-sensitive emulsion layer were prepared in the same manner as the sample 101 except that the ratio of sensitizing dye added to the emulsions A to F of red-sensitive emulsion layers was varied.

Subsequently, sample 105 (present invention) was prepared in the same manner as the sample 102 except that the following IIE intensifying layer was interposed between the 2nd layer and the 3rd layer, and that the amount of color mixing preventive agent Cpd-M in the 3rd layer was increased from 0.05 g/m$^2$ to 0.35 g/m$^2$.

The numeric values indicate the addition amount per m$^2$. The addition amount of silver halide emulsions is in terms of silver quantity.

IIE Intensifying Layer:

| | | |
|---|---|---|
| Emulsion R (sensitive to short-wave green) | silver qty. | 0.11 g |
| Fine-grain silver iodobromide emulsion (av. silver iodide content 1 mol % and equivalent-sphere av. grain diameter 0.06 μm) | silver qty. | 0.35 g |
| Gelatin | | 0.45 g. |

The λia of the above emulsion R was 530 nm.

Samples 106 and 107 were prepared by removing, from the IIE intensifying layer of the sample 105, only the fine-grain silver iodobromide emulsion and only the emulsion R, respectively.

Samples 108 to 111 were prepared in the same manner as the sample 105 except that the amounts of emulsion R and fine-grain silver iodobromide emulsion of the IIE intensifying layer were varied as specified in Table 3. Further, samples 112 to 116 were prepared in the same manner as the samples 105 and 108 to 111, respectively, except that the couplers C-6 and C-7 of 8th, 9th and 10th layers thereof were replaced by a mixture (molar ratio 1:1) of coupler examples I-40 and II-29 according to the present invention. This coupler replacement was performed so that the color formation densities were substantially equal to each other.

Sample 117 was prepared by adding not only the emulsion R (sensitive to bluish green) but also low-speed red-sensitive emulsion A in an amount of 0.1 g/m$^2$ to the IIE intensifying layer of the sample 105. Further, sample 118 was prepared by replacing the emulsion of the red-sensitive layer of the sample 105 by that of the sample 103. Samples 119 to 121 varied in the weight-averaged wavelength λra of spectral sensitivity distribution of red-sensitive emulsion layer were prepared in the same manner as the sample 108 except that the emulsions contained in the red-sensitive emulsion layer thereof were replaced by those used in Samples 101, 103 and 104, respectively.

Further, sample 122 having λra shifted to shorter wave were prepared by adding sensitizing dye S-4 used in green-sensitive emulsion layer to red-sensitive emulsion layer.

For the changes of photographic speed, gradation, etc. caused by the above recipe factor changes, correction was effected by appropriately varying the emulsion grain sizes and emulsion mixing ratio in relevant layers so that the photographic speed and gradation of each sample agreed with those of the sample 101 as completely as possible (Comparison Among Varied Samples)

With respect to each of the samples 101 to 122, the weight-averaged wavelength λra of spectral sensitivity distribution of red-sensitive emulsion layer, the types and amounts of lightsensitive emulsion and fine-grain emulsion of IIE intensifying layer, the type of magenta coupler, the average color difference of Macbeth color chip and the sensory evaluation results are listed In Table 3

TABLE 3

| Sample No. | | Weight-averaged wavelength λra (nm) of RL spectral sensitivity | IIE intensifying layer: Light-sensitive grain Color sensitivity and silver amount (g/m²) | IIE intensifying layer: Nonlight-sensitive fine grain Silver amount (g/m²) | Magenta coupler | Average color difference ΔEave | Sensory evaluation Faithfulness and skin color reproduction |
|---|---|---|---|---|---|---|---|
| 101 | Comp. | 630 | Non | Non | Convenional type (C-6, 7) | 6.2 | Purple was deviated toward red. |
| 102 | Comp. | 620 | Non | Non | Convenional type (C-6, 7) | 4.6 | Saturations of red and skin color were low. |
| 103 | Comp. | 610 | Non | Non | Convenional type (C-6, 7) | 4.5 | Saturations of red and skin color were low. |
| 104 | Comp. | 600 | Non | Non | Convenional type (C-6, 7) | 4.7 | Saturations of red and skin color were extremely low. |
| 105 | Inv. | 620 | Short-wave green 0.11 | 0.35 | Convenional type (C-6, 7) | 3.5 | Hue of purple was accurate, and saturation of skin color was also suitable. |
| 106 | Comp. | 620 | Short-wave green 0.11 | Non | Convenional type (C-6, 7) | 5.5 | Saturations of red and skin color were low. |
| 107 | Comp. | 620 | Non | 0.35 | Convenional type (C-6, 7) | 4.9 | Saturations of red and skin color were low. |
| 108 | Inv. | 620 | Short-wave green 0.11 | 0.50 | Convenional type (C-6, 7) | 3.7 | Hue of purple was accurate, and saturation of skin color was also suitable. |
| 109 | Inv. | 620 | Short-wave green 0.11 | 0.72 | Convenional type (C-6, 7) | 3.6 | Do. |
| 110 | Inv. | 620 | Short-wave green 0.22 | 0.35 | Convenional type (C-6, 7) | 3.5 | Do. |
| 111 | Inv. | 620 | Short-wave green 0.22 | 0.72 | Convenional type (C-6, 7) | 3.5 | Do. |
| 112 | Inv. | 620 | Short-wave green 0.11 | 0.35 | Invention (I-40, II-29) | 2.9 | Saturation was superior to Sample 105. |
| 113 | Inv. | 620 | Short-wave green 0.11 | 0.50 | Invention (I-40, II-29) | 2.8 | Do. |
| 114 | Inv. | 620 | Short-wave green 0.11 | 0.72 | Invention (I-40, II-29) | 2.9 | Do. |
| 115 | Inv. | 620 | Short-wave green 0.22 | 0.35 | Invention (I-40, II-29) | 2.8 | Do. |
| 116 | Inv. | 620 | Short-wave green 0.22 | 0.72 | Invention (I-40, II-29) | 2.9 | Do. |
| 117 | Inv. | 620 | Short-wave green 0.11 + red 0.10 | 0.35 | Invention (I-40, II-29) | 2.8 | Skin tone continuity was superior to Sample 112. |
| 118 | Inv. | 610 | Short-wave green 0.11 | 0.35 | Invention (I-40, II-29) | 2.8 | Hue of purple was accurate, and saturation of skin color was also suitable. |
| 119 | Comp. | 630 | Short-wave green 0.11 | 0.50 | Convenional type (C-6, 7) | 6.8 | Purple was greatly deviated toward red. |
| 120 | Inv. | 610 | Short-wave green 0.11 | 0.50 | Convenional type (C-6, 7) | 3.7 | Hue of purple was accurate, and saturation of skin color was also suitable. |
| 121 | Comp. | 600 | Short-wave green 0.11 | 0.50 | Convenional type (C-6, 7) | 3.9 | Hue of purple was accurate, but saturations of red and skin color were slightly low. |
| 122 | Comp. | 590 | Short-wave green 0.11 | 0.50 | Convenional type (C-6, 7) | 4.0 | Saturations of red and skin color were slightly low. |

Spectral sensitivity distribution of red-sensitive emulsion layer and color reproduction.

When the weight-averaged wavelength of spectral sensitivity distribution of red-sensitive emulsion layer shifts to shorter wave than 625 nm from 630 nm, the reproduction color difference of Macbeth color chip would be sharply reduced, thereby coming to exhibit a color reproduction of increased faithfulness. In particular, the reproduction of Macbeth color chip No. 5 (blue flower) and No. 10 (purple) with red tinge intensified over the real can be improved conspicuously. With respect to this trend, the extent of improvement is slight even if the shift is effected to far shorter wave than 625 nm (610 or 600 nm). However, as the spectral sensitivity shifts to shorter wave, unfavorably the saturations of red-series color and skin color would drop extremely.

By contrast, it has been found that the sample 105 of the present invention wherein not only is the spectral sensitivity of the emulsion of the red-sensitive layer shifted to short wave but also the IIE intensifying layer of the present invention has been introduced successfully reconcile color reproduction faithfulness and saturation. It is further seen from comparison of the results of the sample 105 with those of the samples 106 and 107 that in the above IIE intensifying layer, a lightsensitive emulsion and a nonlightsensitive fine grain silver halide emulsion are essential. With respect to the lightsensitive emulsion and nonlightsensitive fine grain silver halide emulsion are essential of the IIE intensifying layer, there are optimum amounts, over which further enhancement of faithfulness cannot be attained. However, the sample 112 obtained by introducing a coupler of the present invention in the sample 105 exhibits not only further enhanced color reproduction faithfulness but also enhanced saturation, thereby exhibiting preferred color reproduction performance.

As apparent front the sample 117, it is preferred to incorporate a red-sensitive emulsion, in addition to the emulsion with sensitivity to short-wave green, In the IIE intensifying layer. The sample 117 is characterized in that although the faithfulness of color reproduction is equivalent to that of the sample 105, the skin color reproduction in sensory evaluation is excellent.

It Is further seen from comparison of the evaluation results of the samples 108, 119–122 that when IIE intensifying layer exists and the spectral sensitivity of the red-sensitive layer is extremely long or extremely short, the effects of the present invention are not obtained.

EXAMPLE 2

(Preparation of Samples 201 to 204)

Sample 201 was prepared in the same manner as the sample 101 except that the following IIE intensifying layer and interlayer for color mixing prevention which were similar to those introduced in the sample 105 were interposed between the 7th layer and the 8th layer in such an arrangement that the IIE intensifying layer was closer to the support than the interlayer for color mixing prevention.

The numeric values indicate the addition amount per $m^2$. The addition amount of silver halide emulsions is in terms of silver quantity.

IIE Intensifying Layer:

| | | |
|---|---|---|
| Emulsion R (sensitive to short-wave green) | silver qty. | 0.11 g |
| Fine-grain silver iodobromide emulsion (av. silver iodide content 1 mol % and equivalent-sphere av. grain diameter 0.06 μm) | silver qty. | 0.35 g |
| Gelatin | | 0.45 g. |

-continued

| | |
|---|---|
| Color mixing preventive layer | |
| Gelatin | 0.60 g |
| Compound Cpd-D | 0.020 g |
| Compound Cpd-M | 0.350 g |
| High-boiling org. solvent Oil-3 | 0.010 g |
| High-boiling org. solvent Oil-8 | 0.010 g. |

For the changes of photographic speed, gradation, etc. caused by the above recipe factor changes, correction was effected by appropriately varying the emulsion grain sizes in relevant layers so that the photographic speed and gradation of each sample agreed with those of the sample 101 as completely as possible.

Subsequently, sample 202 was prepared in the same manner as the sample 101 except that the following IIE intensifying layer and color mixing preventive layer were interposed between the 11th layer and the 12th layer in such an arrangement that the IIE intensifying layer was closer to the support than the color mixing preventive layer.

| | | |
|---|---|---|
| Color mixing preventive layer | | |
| Gelatin | | 0.60 g |
| Compound Cpd-D | | 0.020 g |
| Compound Cpd-M | | 0.350 g |
| High-boiling org. solvent Oil-3 | | 0.010 g |
| High-boiling org. solvent Oil-8 | | 0.010 g. |
| IIE intensifying layer: | | |
| Emulsion R (sensitive to short-wave green) | silver qty. | 0.11 g |
| Fine-grain silver iodobromide emulsion (av. silver iodide content 1 mol % and equivalent-sphere av. grain diameter 0.06 μm) | silver qty. | 0.35 g |
| Gelatin | | 0.45 g. |

Further, sample 203 was prepared by changing the IIE intensifying layer of the sample 202 to the following formulation.

IIE Intensifying Layer:

| | | |
|---|---|---|
| Emulsion R (sensitive to short-wave green) | silver qty. | 0.11 g |
| Emulsion A (sensitive to red) | silver qty. | 0.05 g |
| Fine-grain silver iodobromide emulsion (av. silver iodide content 1 mol % and equivalent-sphere av. grain diameter 0.06 μm) | silver qty. | 0.35 g |
| Gelatin | | 0.45 g. |

Still further, sample 204 was prepared by introducing the following IIE intensifying layer as a substitute for the 18th layer of the sample 101.

IIE Intensifying Layer:

| | | |
|---|---|---|
| Emulsion R (sensitive to short-wave green) | silver qty. | 0.11 g |
| Fine-grain silver iodobromide emulsion (av. silver iodide content 1 mol % and equivalent-sphere av. grain diameter 0.06 μm) | silver qty. | 0.35 g |
| Gelatin | | 0.80 g |
| Ultraviolet absorber U-1 | | 0.030 g |
| Ultraviolet absorber U-6 | | 0.030 g |
| High-boiling org. solvent Oil-3 | | 0.010 g. |

With respect to the samples 201 to 204, the same evaluations as for the samples 101 to 118 were carried out, and the obtained results were listed in Table 4. As compared with the sample 101, the samples 201 to 203 of the present invention produced the same favorable results as those of the sample 105.

TABLE 4

| Sample No. | | Weight-averaged wavelength λra (nm) of RL spectral sensitivity | IIE intensifying layer: Light-sensitive grain Color sensitivity and silver amount ($g/m^2$) | IIE intensifying layer: Nonlight-sensitive fine grain Silver amount ($g/m^2$) | Magenta coupler | Average color difference ΔEave | Sensory evaluation Faithfulness and skin color reproduction |
|---|---|---|---|---|---|---|---|
| 201 | Inv. | 620 | Short-wave green 0.11 | 0.35 | Convenional type (C-6, 7) | 3.4 | Hue of purple was accurate, and saturation of skin color was also suitable. |
| 202 | Inv. | 620 | Short-wave green 0.11 + red 0.05 | 0.35 | Convenional type (C-6, 7) | 3.2 | Do. |
| 203 | Inv. | 620 | Short-wave green 0.11 | 0.35 | Convenional type (C-6, 7) | 3.9 | Do. |
| 204 | Inv. | 620 | Short-wave green 0.11 | 0.35 | Convenional type (C-6, 7) | 4.2 | Hue of purple was accurate, however, saturations of red and skin color were slightly low. |

The obtained results showed that the sample 204 wherein the IIE intensifying layer was interposed between protective layers was slightly inferior in faithful color reproduction to the samples 105 and 201 to 203. The reason therefor would be that the IIE intensifying layer was positioned remoter from the support than the yellow filter, so that spectral color mixing (contribution of blue sensitivity) of the lightsensitive emulsion of the IIE intensifying layer occurred.

What is claimed is:

1. A silver halide color reversal photographic lightsensitive material comprising a support and, superimposed thereon, at least one red-sensitive silver halide emulsion layer, at least one green-sensitive silver halide emulsion layer and at least one blue-sensitive silver halide emulsion layer, the red-sensitive silver halide emulsion layer having a weight-averaged wavelength (λra) of spectral sensitivity distribution satisfying the relationship: 600 nm<λra<625 nm, which silver halide color reversal photographic lightsensitive material contains at least one interimage effect intensifying layer substantially not forming any image, the interimage effect intensifying layer containing:

(a) at least one kind of lightsensitive silver halide grains in an amount of less than 10% in terms of silver quantity based on all the silver halide grains for image formation; and (b) nonlightsensitive silver halide fine grains.

2. The silver halide color reversal photographic lightsensitive material according to claim 1, wherein at least one green-sensitive silver halide emulsion layer contains at least one kind of a coupler represented by formula (1) or (2):

Formula (1)

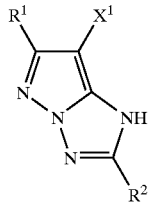

-continued

Formula (2)

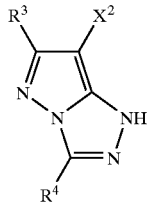

wherein, in the formulae (1) and (2), each of $R^1$, $R^2$, $R^3$ and $R^4$ independently represents a hydrogen atom or a substituent and each of $X^1$ and $X^2$ independently represents a hydrogen atom or a group which is split off at coupling with developing agent oxidation products, with the proviso that when both the coupler represented by the formula (1) and the coupler represented by the formula (2) are contained in the green-sensitive silver halide emulsion layer, at least one of $X^1$ and $X^2$ is a hydrogen atom.

3. The silver halide color reversal photographic lightsensitive material according to claim 1, wherein at least one green-sensitive silver halide emulsion layer contains a coupler represented by formula (3):

Formula (3)

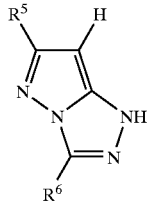

wherein $R^5$ represents a substituted or unsubstituted secondary alkyl group having 5 to 20 carbon atoms or a substituted or unsubstituted tertiary alkyl group having 4 to 20 carbon atoms and R6 represents a hydrogen atom or a substituent.

4. The silver halide color reversal photographic lightsensitive material according to claim 1, wherein at least one green-sensitive silver halide emulsion layer contains a coupler represented by formula (4):

(4)

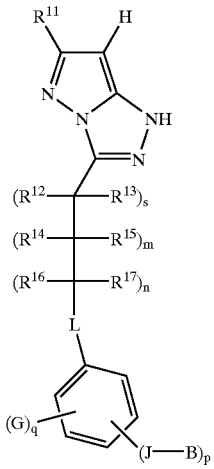

wherein $R^{11}$ represents a hydrogen atom or a substituent, each of $R^{12}$, $R^{13}$, $R^{14}$, $R^{15}$, $R^{16}$ and $R^{17}$ independently represents a hydrogen atom, a halogen atom, an alkoxy group, an alkyl group or an aryl group, L represents —$NR^{18}SO_2$—, —$SO_2NR^{18}$—, —$SO_2NR^{18}CO$—, —$NR^{18}COO$—, —$NR^{18}CONR^{19}$— or —COO— (these are bonded with the phenyl group of the formula (4) at the right side of the formulae), each of $R^{18}$ and $R^{19}$ independently represents a hydrogen atom, a substituted or unsubstituted alkyl group, or a substituted or unsubstituted aryl group, J represents —CO—, —COO—, —O—, —S—, —$CONR^{20}$—, —$NR^{20}CO$—, —$NR^{20}COO$—, —$NR^{20}NR^{21}$—, —$O_2$—, —$SO_2NR^{20}$— or —$CONR^{20}SO_2$— (these are bonded with the phenyl group of the formula (4) at the right side of the formulae), each of $R^{20}$ and $R^{21}$ independently represents a hydrogen atom, a substituted or unsubstituted alkyl group, or a substituted or unsubstituted aryl group, B represents a substituted or unsubstituted alkyl group, or a substituted or unsubstituted aryl group, p is an integer of 1 to 5, with the proviso that when p is 2 or greater, a plurality of —J—B groups may be different from each other, G represents a substituent, q is an integer of 0 to 4, with the proviso that when q is 2 or greater, a plurality of G groups may be different from each other, each of s, m and n independently is 0 or 1.

5. The silver halide color reversal photographic lightsensitive material according to claim 1, wherein the interimage effect intensifying layer contains at least one kind of silver halide grains with sensitivity to bluish green having a weight-averaged wavelength (λia) of spectral sensitivity distribution satisfying the relationship: 490 nm<λia<550 nm, which the weight-averaged wavelength (λia) is calculated by the following formula:

$$\lambda ia = \int_{460}^{600} \lambda Si(\lambda) d\lambda \Big/ \int_{460}^{600} Si(\lambda) d\lambda$$

wherein Si(λ) represents the spectral sensitivity distribution at each wavelength A determined at a blackened density of 0.2 with respect to a sample obtained by a single coating with an emulsion containing the color-sensitive silver halide grains, the sample having been subjected to black-and-white development.

6. The silver halide color reversal photographic lightsensitive material according to claim 5, wherein the interimage effect intensifying layer contains red-sensitive silver halide grains.

7. The silver halide color reversal photographic lightsensitive material according to claim 1, wherein, in the interimage effect intensifying layer, the amount of contained nonlightsensitive fine grains is greater than that of contained lightsensitive silver halide grains.

8. The silver halide color reversal photographic lightsensitive material according to claim 1, wherein, in the interimage effect intensifying layer, the amount of silver contained in nonlightsensitive fine grains is greater than twice that in lightsensitive silver halide grains.

9. The silver halide color reversal photographic lightsensitive material according to claim 1, wherein the red-sensitive silver halide emulsion layer contains sensitizing dyes represented by formulae (I) and (II):

Formula (I)

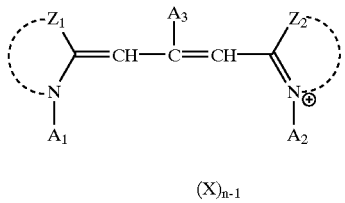

Formula (II)

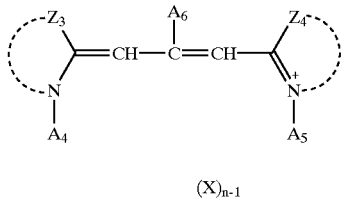

in formula (I), $Z_1$ represents an atomic group needed for constituting a substituted or unsubstituted heterocycle, the heterocycle selected from among benzimidazole, benzoxazole and naphthoxazole, $Z_2$ represents an atomic group needed for constituting a substituted or unsubstituted heterocycle, the heterocycle selected from among benzothiazole, benzoselenazole, naphthothiazole, naphthoselenazole and benzotellurazole, each of $A_1$ and $A_2$ independently represents a substituted or unsubstituted alkyl or aralkyl group, $A_3$ represents a hydrogen atom, an alkyl group, an aralkyl group or an aryl group, X represents a cation, and n is 1 or 2, with the proviso that n is 1 when an intramolecular salt is formed, in formula (II), $Z_3$ and $Z_4$ may be identical with or different from each other, and each thereof represents an atomic group needed for constituting a substituted or unsubstituted heterocycle, the heterocycle selected from among benzothiazole, benzoselenazole, benzotellurazole, naphthothiazole and naphthoselenazole, each of $A_4$ and $A_5$ independently represents a substituted or unsubstituted alkyl or aralkyl group, $A_6$ represents a hydrogen atom, an alkyl group, an aralkyl group or an aryl group, X represents a cation, and n is 1 or 2, with the proviso that n is 1 when an intramolecular salt is formed.

10. The silver halide color reversal photographic lightsensitive material according to claim 9, wherein the mixing molar ratio of sensitizing dye (I)/sensitizing dye (II) is in the range of 0.05 to 4.

11. The silver halide color reversal photographic light-sensitive material according to claim 9, wherein the mixing molar ratio of sensitizing dye (I)/sensitizing dye (II) is in the range of 0.1 to 1.

12. The silver halide color reversal photographic light-sensitive material according to claim 2, wherein the coupler contained in said at least one green-sensitive silver halide emulsion layer is represented by the formula (1).

13. The silver halide color reversal photographic light-sensitive material according to claim 2, wherein the coupler contained in said at least one green-sensitive silver halide emulsion layer is represented by the formula (2), and $R^3$ of formula (2) is a substituted or unsubstituted tertiary alkyl group.

14. The silver halide color reversal photographic light-sensitive material according to claim 2, wherein said at least one green-sensitive silver halide emulsion layer contains said at least one coupler represented by the formula (1), and said at least one green-sensitive silver halide emulsion layer contains said at least one coupler represented by the formula (2).

15. The silver halide color reversal photographic light-sensitive material according to claim 1, further comprising a yellow filter layer, and wherein the interimage effect intensifying layer is located on the support side with respect to the yellow filter layer.

16. The silver halide color reversal photographic light-sensitive material according to claim 1, further comprising at least three protection layers.

* * * * *